US005407186A

United States Patent [19]

Hayama et al.

[11] Patent Number: 5,407,186

[45] Date of Patent: Apr. 18, 1995

[54] SHEET FINISH-PROCESSING UNIT IN IMAGE FORMING APPARATUS

[75] Inventors: Satoru Hayama; Keiichi Taguchi; Noriaki Okamoto; Keiji Okumura; Jun Miyoshi, all of Osaka, Japan

[73] Assignee: Mita Industrial Co., Ltd., Japan

[21] Appl. No.: 53,952

[22] Filed: Apr. 28, 1993

[30] Foreign Application Priority Data

| | | | |
|---|---|---|---|
| Apr. 30, 1992 | [JP] | Japan | 4-111934 |
| Apr. 30, 1992 | [JP] | Japan | 4-111935 |
| Apr. 30, 1992 | [JP] | Japan | 4-111936 |
| Apr. 30, 1992 | [JP] | Japan | 4-111939 |
| Apr. 30, 1992 | [JP] | Japan | 4-111940 |

[51] Int. Cl.[6] ..... B31B 1/68; B65H 39/02; B42C 1/12

[52] U.S. Cl. ..... 270/53; 355/324; 270/58

[58] Field of Search ..... 270/53, 58; 355/324

[56] References Cited

U.S. PATENT DOCUMENTS

| | | | |
|---|---|---|---|
| 4,376,529 | 3/1983 | George et al. | 270/53 |
| 4,946,152 | 8/1990 | Ishikawa et al. | 270/53 |
| 4,971,302 | 11/1990 | Morii et al. | 270/53 |
| 5,100,119 | 3/1992 | Komada et al. | 270/53 |
| 5,125,634 | 6/1992 | Lawrence | 270/53 |
| 5,186,445 | 2/1993 | Nakanishi et al. | 270/53 |
| 5,201,503 | 4/1993 | Matsui et al. | 270/53 |
| 5,290,020 | 3/1994 | Matsui et al. | 270/53 |

*Primary Examiner*—Edward K. Look
*Assistant Examiner*—John Ryznic
*Attorney, Agent, or Firm*—Beveridge, DeGrandi, Weilacher & Young

[57] ABSTRACT

Image forming apparatus including a sheet finish-processing unit for finish-processing sheets discharged from a copying machine to which the unit is laterally positioned and stored thereby into a plurality of stacks. A sheet stack finish-processing mechanism of the unit, incorporating a stapler, is shiftable by an associated drive mechanism in the widthwise direction along the adjacent end of a positioned stack in storage. A sheet stack handling mechanism therein draws the end of the positioned stack into a finishing locale of the finish-processing mechanism, and subsequent to a finishing (stapling) operation, returns the finished sheet stack into storage. Thereupon, the stack is transversely discharged frontward of the image forming apparatus from storage, during which operation a subsequent finishing operation is concurrently executable; by such discharge a number of copy stacks greater than the number of stacking storages can be processed. The stacks are linearly inserted into and withdrawn from the finish-processing mechanism, eliminating the need for complex movements thereof, and allowing the finish-processing mechanism to be functional at a number of linear positions along the stack end margin. Furthermore, the sheet stacks are discharged to the apparatus front, wherein they are readily accessible for removal by an operator.

29 Claims, 42 Drawing Sheets

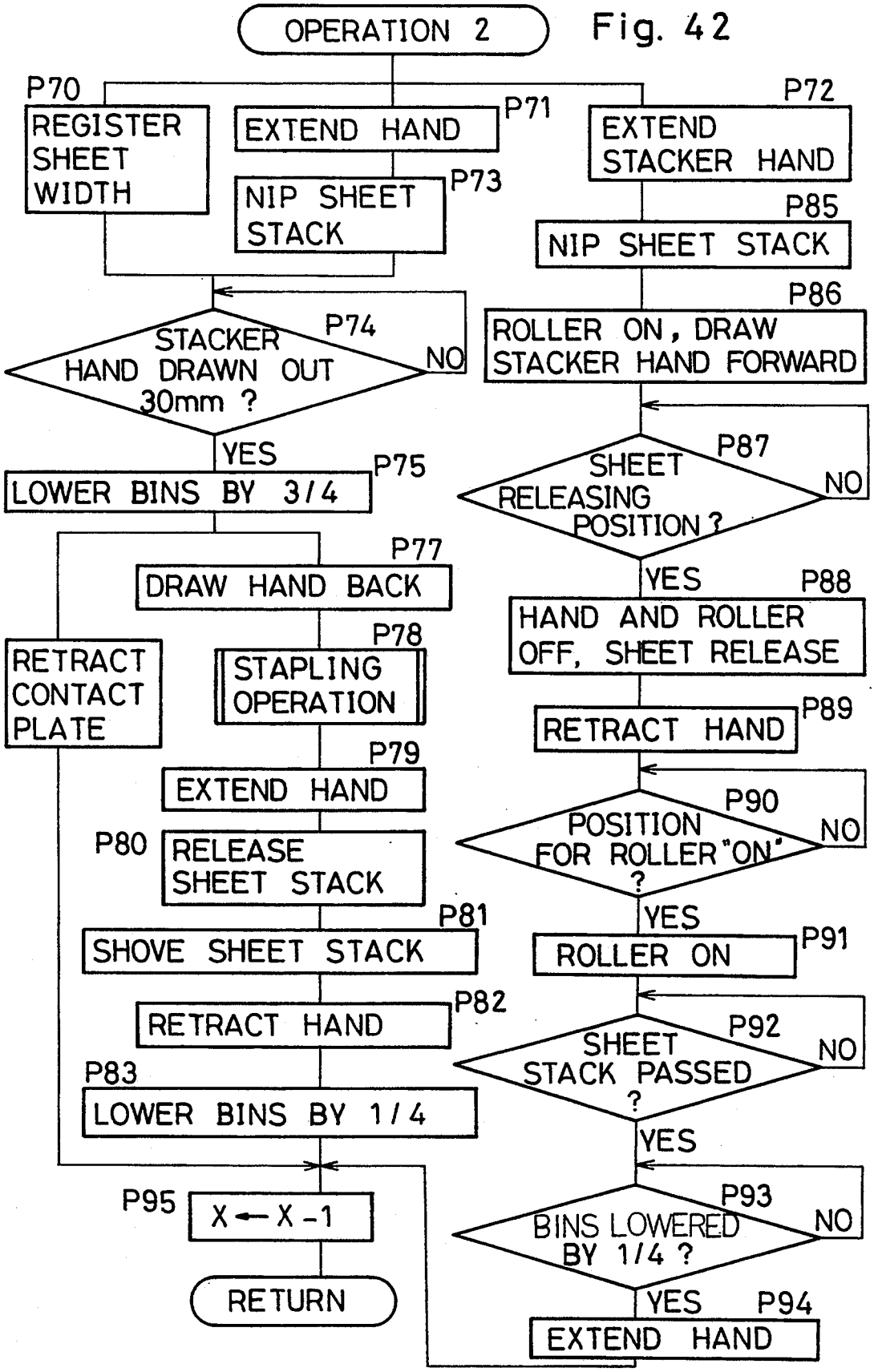
OPERATION 2
Fig. 42
P70
REGISTER SHEET WIDTH
EXTEND HAND
P71
NIP SHEET STACK
P73
P72
EXTEND STACKER HAND
P85
NIP SHEET STACK
P86
ROLLER ON, DRAW STACKER HAND FORWARD
STACKER HAND DRAWN OUT 30mm ?
P74
NO
YES
LOWER BINS BY 3/4
P75
P87
SHEET RELEASING POSITION ?
NO
YES
P88
HAND AND ROLLER OFF, SHEET RELEASE
P77
DRAW HAND BACK
RETRACT CONTACT PLATE
P78
STAPLING OPERATION
P89
RETRACT HAND
P79
EXTEND HAND
P90
POSITION FOR ROLLER "ON" ?
NO
P80
RELEASE SHEET STACK
YES
P81
SHOVE SHEET STACK
P91
ROLLER ON
P82
RETRACT HAND
P92
SHEET STACK PASSED ?
NO
P83
LOWER BINS BY 1/4
YES
P95
X ← X -1
P93
BINS LOWERED BY 1/4 ?
NO
RETURN
YES
P94
EXTEND HAND

SHEET FINISH-PROCESSING UNIT IN IMAGE FORMING APPARATUS

BACKGROUND OF THE INVENTION

The present invention relates to a sheet stack finish-processing unit, and more specifically, it relates to such a unit disposed lateral of an image forming apparatus such as a copying machine, for finish-processing sheets discharged from the image forming apparatus. In addition, the present invention relates to an image forming apparatus including the sheet stack finish-processing unit.

A conventional image forming apparatus such as a copying machine may have a sorter for sorting and storing into stacks image-formed sheets. One type of sorter includes a stapler for stapling the stacks of sheets.

Japanese Patent Laying-Open No. 231757/1989 discloses a conventional sorter provided with a stapler. The sorter has a plurality of bins sorting slicers by receiving them into storage in a given order. The bins can be translated vertically; and in the conventional sorter, as the bins are translated, a predetermined spacing is provided above that bin brought adjacent a sheet supplier, through which spacing sheets are transported from the sheet supplier into each bin in turn. A stapler provided in the sheet supplier is pivotal through a predetermined angle, assuming either a drawn position, wherein it will not interfere with passage of the bins, or a stapling position, in which its stapling operation is carried out.

In the above-described sorter, a stapler pivoting mechanism must be provided, complicating the structure. In addition, since the stapling operation can only be performed in the fixed location, the stapling position along the corresponding end of a sheet stack is not variable, nor can the slack be stapled in a plurality of marginal positions. Hence use of the stapling function is singularly restricted.

In addition, the above-described sorter cannot accommodate any number of stacks of stapled sheets greater than the number of bins. Therefore, when a greater number of copies are to be produced, an operator must empty stapled stacks of sheets from the bins in order to allow succeeding sheets to pass thereinto.

Japanese Patent Application Laid-Open No. 165270/1988 discloses a sorter consisting of a sorting portion and a stapling portion. When sheets are to be stapled by the sorter, stacks formed in the sorting portion are transported to the stapling portion, and then a stapler provided in the stapling portion staples the stacked sheets. Accordingly, the sorter can handle a number of copies greater than the number of bins provided in the sorting portion. In the foregoing sorter, however, the stapler is provided under the bins, and a stacking portion into which finish-processed stacks of sheets are stored is disposed under the stapler. Therein, it is difficult for an operator to take out the stacks of sheets. Moreover, before each stack of sheets is stapled, the previously stapled stack of sheets is discharged into the stacking portion, adding to required operating time.

SUMMARY OF THE INVENTION

An object of the present invention is to enable performance of a sheet stack finishing operation such as stapling at a plurality of marginal positions along an end of a stack of sheets, by means of a relatively simply-structured unit.

Another object of the present invention is to enable an operator to readily take out finish-processed stacks of sheets from the unit.

Still another object of the present invention is to reduce operating time therein.

(1) A sheet finish-processing unit according to an aspect of the present invention finish-processes sheets discharged from an image forming apparatus to which the unit is lateral. The unit includes sheet storing means sheet stack finish-processing means shiftable by an associated drive means, and sheet stack handling means.

The sheet storing means is capable of storing into stacks sheets discharged from the image forming apparatus. The sheet stack finish-processing means is mounted lateral of an end of the sheet storing means directed toward the image forming apparatus, wherein it is shiftable along an adjacent margin of the stack of sheets in a direction transverse to the direction in which sheets are discharged from the image forming apparatus, and it performs a finishing operation on the stacks stored in the sheet storing means. The drive means can shift the finish-processing means in the transverse direction, equivalent to the widthwise direction of the stored sheets. The sheet stack handling means draws each stack of sheets as stored in the sheet storing means into a finishing locale of the finish-processing means, and subsequent to the finishing operation returns the finished stack to the sheet storing means.

In this unit, the sheets discharged from the image forming apparatus are stored into bins of the sheet storing means. The finish-processing means, for example, a stapler and a puncher, is thus shiftable widthwise along the adjacent margin of the sheet stack in the sheet storing means. When the finish-processing operation is carried out, the stack of sheets is drawn by the sheet stack handling means from the sheet storing means into the finishing locale. In tills location, the stapling operation can be performed at a predetermined position along the stack end margin. Furthermore, since the finish-processing means is shiftable widthwise therein, the stack of sheets can alternatively be stapled at two points, For example. Subsequent to the finish-processing operation, the stack of sheets is returned to the sheet storing means by the sheet handling means.

Since the stack of sheets in the sheet storing means is drawn into the finishing locale by the sheet handling means, and the finished stack of sheets is subsequently returned to the sheet storing means, the finish-processing means is not pivoted, eliminating need for a pivoting mechanism, thus simplifying the finish-processing mechanism. Furthermore, since the finish-processing means is shiftable in the sheet width direction, the finishing operation can be performed at one or more positions along the sheet stack end margin.

(2) A sheet finish-processing unit according to another aspect sorts sheets discharged from an image forming apparatus to which the unit is lateral. The unit includes a plurality of vertically translatable bins storing the discharged sheets supplied thereto, bin movement control means for controlled vertical indexing in translation of the bins, sheet supply means for supplying the sheets discharged from the image forming apparatus into the bins, and a body frame. The body frame supports the plurality of bins and contains an outlet provided on its front wall, with respect to the user-directed side of the image forming apparatus, through which the stack of sheets in each of the bins in turn translated into a predetermined position corresponding to the outlet is discharged frontward.

In this unit, the sheets supplied from the sheet supply means are sorted and stored into the bins as the plurality of bins is vertically translated in indexing by the bin movement control means. The outlet provided in the body frame is opposite the bin in the predetermined position of the bin plurality, and through it the stack of sheets in the bin thus can be discharged transversely.

Wherein a stack reservoir is provided adjacent the discharge outlet of the unit, a number of copies greater than the number of bins can be finish-processed. Moreover, since the outlet is contained in the front wall of the unit body frame, the stacks of sheets can be withdrawn into a more readily accessible, frontward region of the image forming apparatus.

(3) A sheet finish-processing unit according to a further aspect of the present invention is for discharging the stacks of sheets from the sheet storing means as disposed lateral of an image forming apparatus. The unit comprises a body housing disposed on the front side of the sheet storing means, sheet stack discharging means and a reservoir. The sheet stack discharging means is disposed with the body housing, and withdraws the stacks of sheets frontward from the sheet storing means and discharges them exterior of the sheet storing means. The reservoir stores the stacks of sheets discharged from the sheet storing means by the sheet stack discharging means.

With this unit, the stacks of sheets stored in the sheet storing means are discharged by the sheet stack discharging means frontward of the image forming apparatus. Therefore, wherein the unit is mounted adjacent the image forming apparatus, a number of sorting operations greater than the number of bins in the sorter can be performed lateral of the image forming apparatus. Furthermore, since the finish-processed stacks of sheets are discharged toward the frontward of the apparatus, an operator is provided ready access in taking out the finish-processed stacks.

(4) An image forming apparatus according to a still further aspect comprises an image forming apparatus body wherein an image is formed onto a sheet, sheet storing means, sheet stack finish-processing means, sheet stack discharging means, operation selection means and operation control means. The sheet storing means includes a plurality of bins each capable of storing into a stack a set of sheets discharged from the body of the image forming apparatus. The sheet stack finish-processing means performs predetermined operation(s) finishing the stacks of sheets in the bins. The discharging means discharges the stack of sheets finished by the sheet stack finish-processing means from the storing bin in a discharge operation. The operation selection means selects execution of the processing means and discharging means operations. The operation control means controls the operations executed by the sheet stack finish-processing means and the sheet stack discharge means.

In this apparatus, an image is formed in the image forming apparatus body onto sheets discharged therefrom and stored into the bins. Wherein the finish-processing operation, for example, a stapling operation, is selected by the operation selection means, the stacks of sheets in the bins are accordingly finish-processed; wherein the discharging operation is selected, the finish-processed stacks of sheets are discharged from the bins.

If the discharging operation were carried out exclusive of the finish-processing operation, the non-stapled sheets would become disarranged when discharged. Therefore, if only the discharging operation is selected, the operation control means nevertheless forces execution of the finish-processing operation.

These and other objects and advantages of the present invention will he more fully apparent frown the following detailed description.

BRIEF DESCRIPTION OF THE DRAWINGS

FIGS. 41, 42, and 43 are process control flow charts of operations 1, 2, and 3, respectively, as indicated in FIG. 39;

DESCRIPTION OF THE PREFERRED EMBODIMENT

Figure 1:
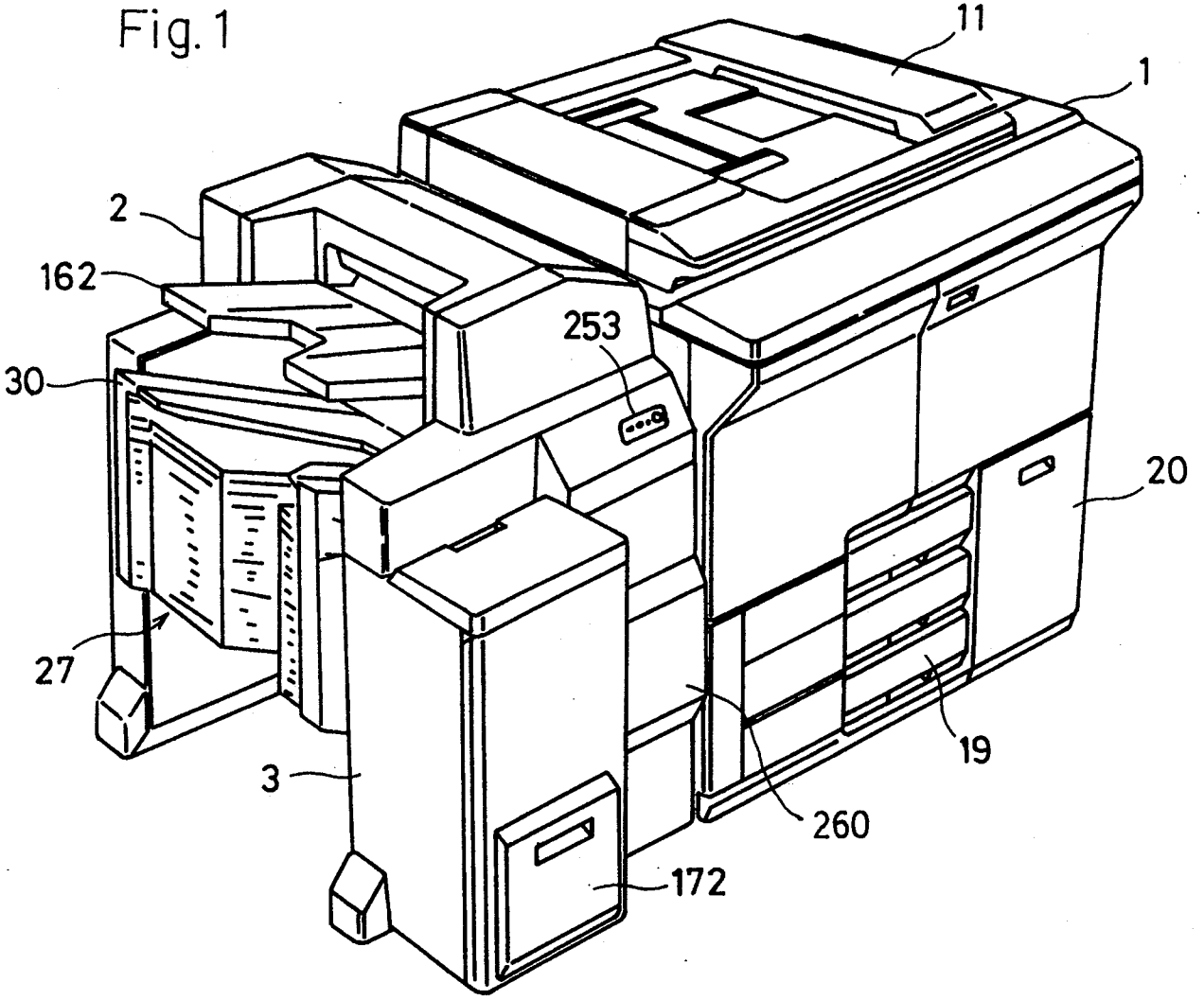
FIG. 1 is a schematic perspective view of a copying machine including an embodiment of the present invention.
Figure 2:
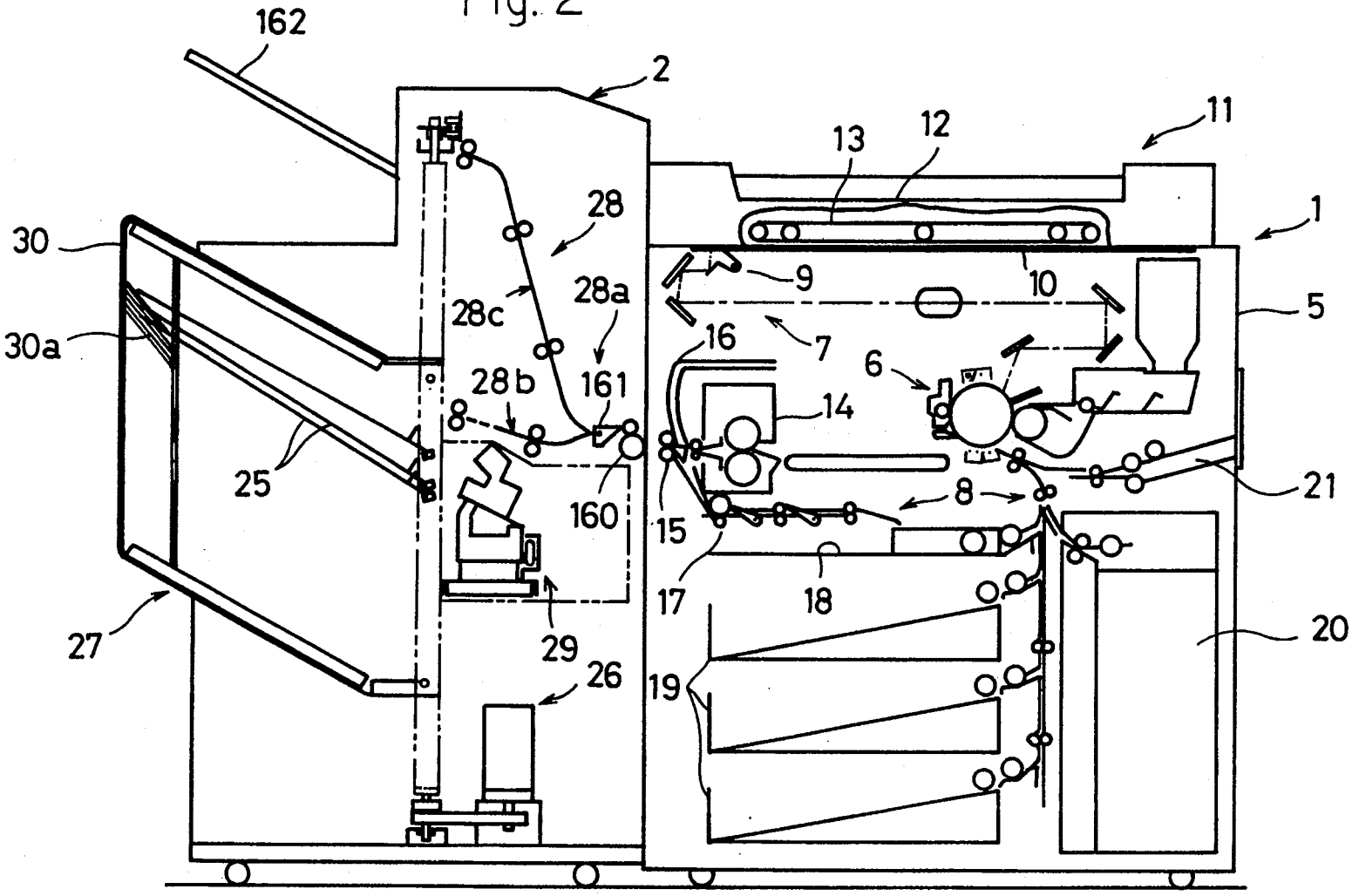
FIG. 2 is a schematic sectional elevation of the copying machine.

FIGS. 1 and 2 show the overall structure of a copying apparatus according to an embodiment of the present invention.

Referring to FIG. 1, a copying apparatus is shown therein to comprise a copying machine body 1, a sorter 2 which incorporates a stapler (referred to in brief as the sorter hereinafter) located on the left side of the body 1, and a discharger 3 located on the front side of the sorter 2 along the front of the body 1).

Referring to FIG. 2, the copying machine body 1 includes a housing 5, an image forming part 6 disposed in a central portion of the housing 5, an original scanner 7 disposed above the image forming part 6, and a sheet-transport unit 8 for feeding and discharging sheets to and from the image forming part 6.

The image forming part 6 has a photoconductive drum disposed at the center, and a charger, a developing unit, a transfer unit, a detach unit, and a cleaning unit disposed surrounding the photoconductive drum. The original scanner 7 has an optical exposure system 9 disposed above the image forming part 6, an original retainer 10 disposed over the optical exposure system 9, and an automatic original-transport device 11 provided on the original retainer 10. The automatic original-transport device 11 has an original-receiving portion 12 in an upper surface of its case, and an original transport unit 13 consisting of an original-transport belt and related elements disposed inside the housing 5. The sheet-transport unit 8 includes a sheet feeding path provided between the sheet feeding unit and the image forming part, and a sheet discharge path provided beyond the image forming part. A fixing unit 14 is provided in the sheet discharging path. Between the fixing unit 14 and the sorter 3, there are discharge rollers 15 for discharging sheets to the sorter 2, and a reversing device 16 for reversing a sheet therein.

Provided in a lower portion of the housing 5 are a middle transport path 17, which transports sheets from the reversing device 16, and a temporary storage tray 18 for temporary storage of the reversed sheets. A plurality of feed cassettes 19 are vertically provided under the storage tray 18. A feed deck 20 for feeding a large quantity of sheets in succession is disposed in the right lower portion of the housing 5. A feed path 21 is disposed above the feed deck 20.

Sorter

The sorter 2 includes a bin unit 27 consisting of a plurality of bins 25 and a bin drive 26 for driving the bins vertically, a transport unit 28 disposed between the copying machine body 1 and the bin unit 27 for transporting sheets from the copying machine body 1 to the bin unit 27, and a finish-processing unit 29 disposed under the transport unit 28.

Figure 3:
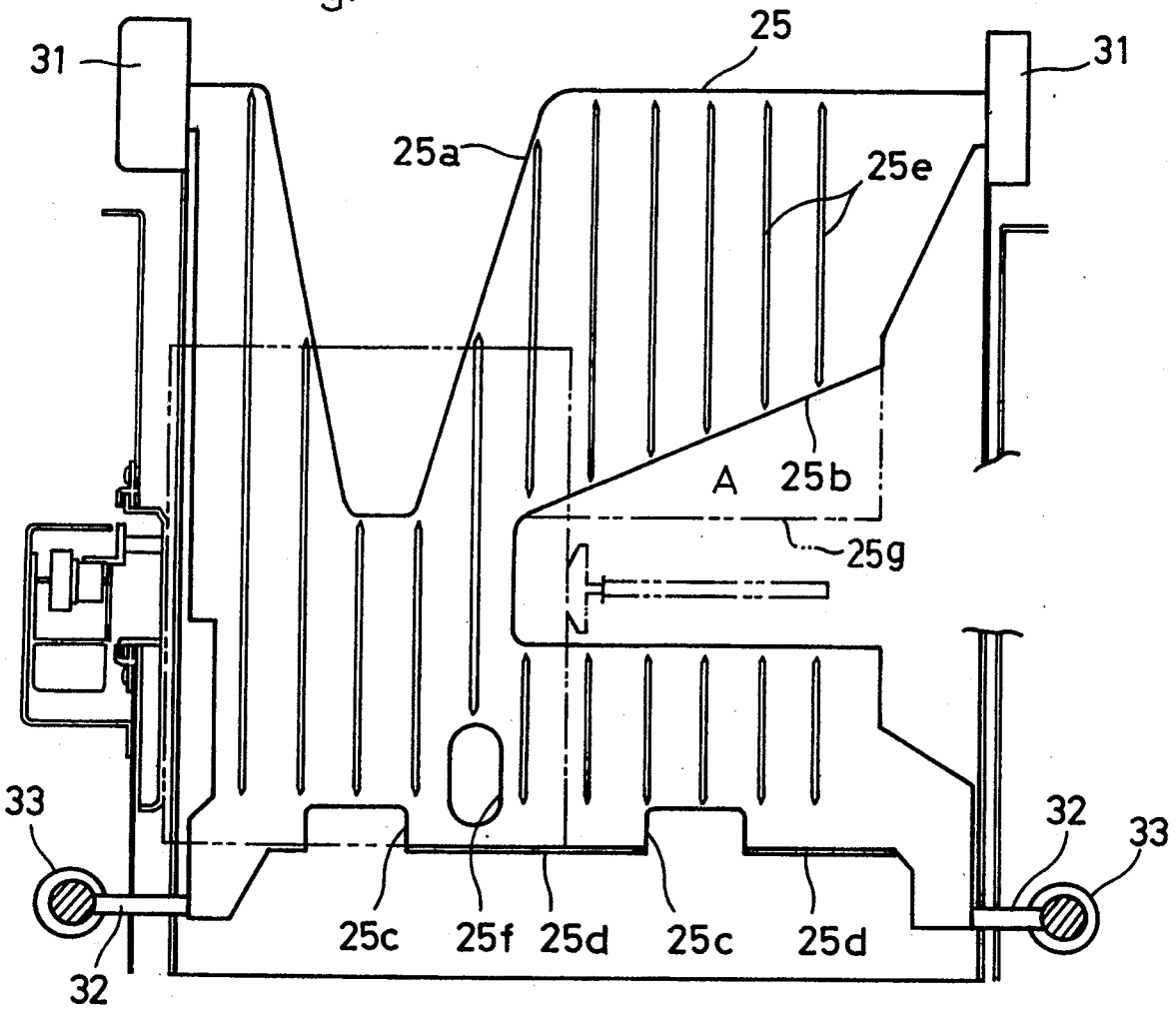
FIG. 3 is a plan view of a bin provided in a sorter of the copying machine.

The bin unit is flanked by a support frame 30 supporting both sides, as well as the sheet-discharge side of the bins 25. Each of the bins 25 is formed of a flat board as shown in plan view in FIG. 3. A cutout 25*a* for withdrawing the sheets is formed inward from the sheet-forward end (sheet-discharging side) of the bins. Another cutout 25*b* through which a stack of sheets in the bin is registered widthwise is formed inward from the rear side of the bin. In addition, two notches 25*c* for withdrawing the stack of sheets for finish-be processing by the process unit 29 are formed at a predetermined interval at the sheet-trailing end (sheet-incoming side) of the bin. The sheet-forward edge 25*g* of the cutout 25*b* widens from the central portion of sheet storage outward in the sheet-discharging direction, so that the leading edge of a first fedsheet is smoothly guided along the widening edge 25*g* in discharge onto the bin 25. Furthermore, since the sheet-forward edge 25*g* widens out, area (A) in the sheet-forward section of the bin is smaller than that of a conventional bin in which the forward edge corresponding to 25*g* is formed to be parallel with the leadlug edge of sheets, as indicated by chain lines; consequently bin deformation, which can occur in molding the bin, is preventable.

Figure 4:
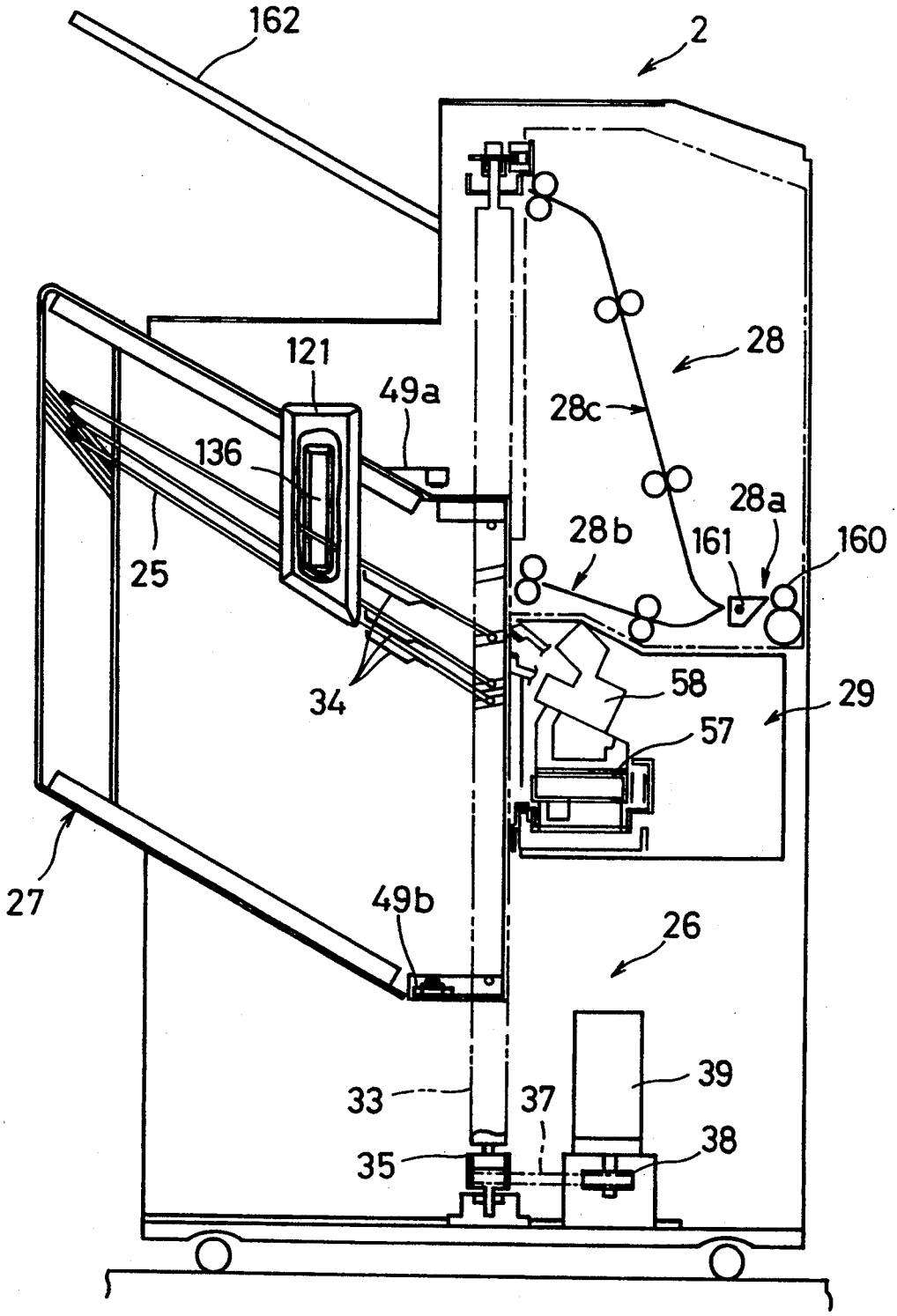
FIG. 4 is a schematic vertical section view of a sorter.

Holders 31 are provided on either side of the bin at the sheet-forward end and trunnions 32 protrude from either side of the bin at the sheet-trailing end. The holders 31 of each bin are supported by support units 30*a* (referring to FIG. 2) provided in the supporting Frame 30 on the sheet-discharging side. Each trunnion 32 is engaged with a groove of a spiral cam 33 partly composing the drive portion 26. As shown in FIG. 4, impelling mechanisms 34 are provided on the lower surface of the bins 25 each for pressing down the sheets stored in the bin 25 immediately below.

Thus, the bin 25 is supported by the support units 30*a* and the spiral cams 33 and sloped such that the sheet-forward end thereof is positioned higher than the sheet-trailing end thereof, as shown in FIG. 2. A standing wall 25*d* protrudes upward from the paper-incoming end of each bin 25, which, in that the bins 25 are slanted, prevents the stored sheets from falling out. A plurality of ribs 25*e* are formed on the upper surface of the bin 25 along the sheet-discharging direction.

Figure 5:
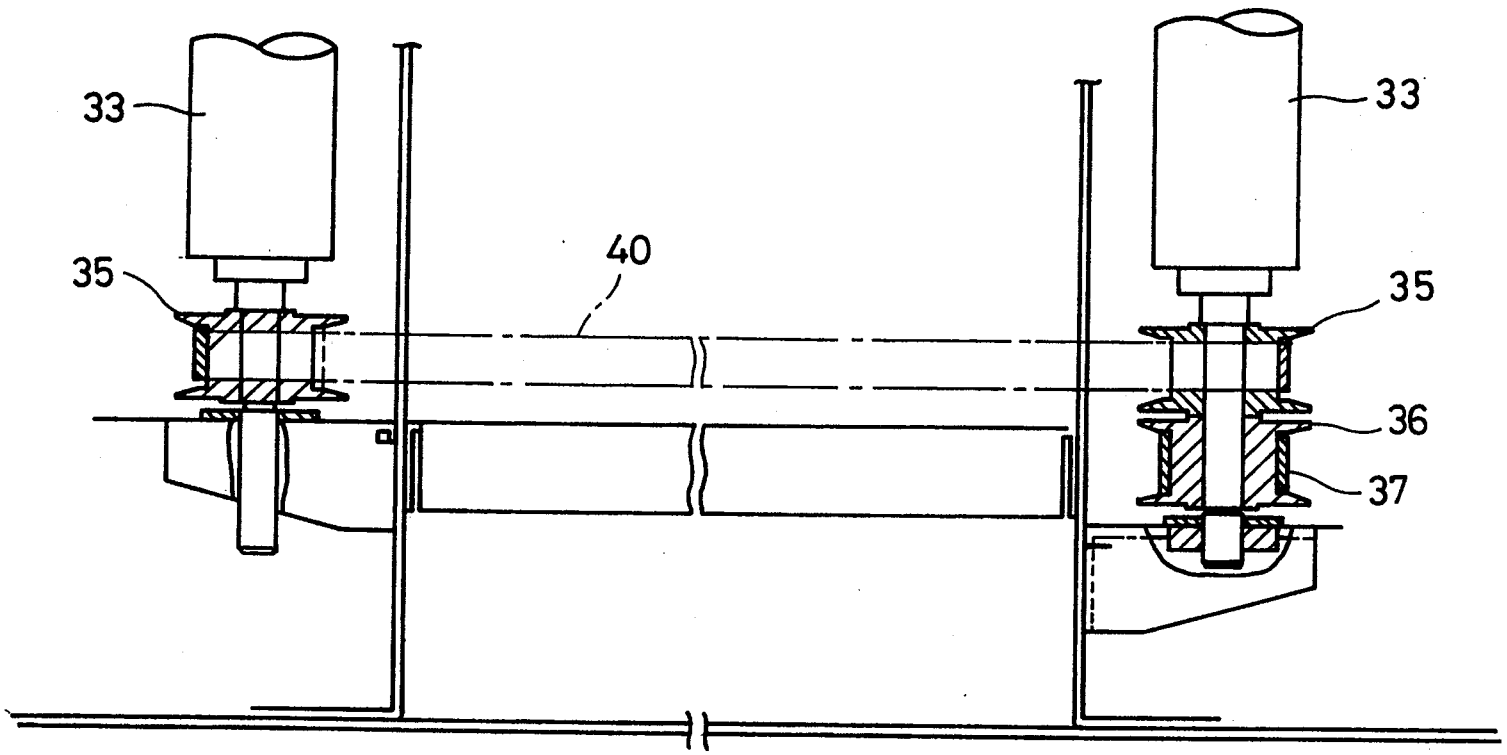
FIG. 5 is a partial section view of a bin drive.

The drive portion 26 of the bin unit 27 includes a pair of spiral cams 33 provided at front and rear ends of the bins 25 on the sheet-incoming side thereof so as to be opposite each trunnion 32. Each spiral cam 33 is threaded by a spiral groove on its cylindrical surface and is vertically disposed along the sorter 2. The upper and lower ends of the spiral cams 33 are rotatably supported by a frame of the sorter 2 and, as enlargedly shown in FIG. 5, a pulley 35 is fixed to the lower ends thereof. A drive pulley 36 is fixed to the lower end of the spiral cam 33 provided in the rear of the apparatus. As shown in FIG. 4, a drive motor 39 is connected to the drive pulley 36 through a belt 37 and a pulley 38. Thus, the spiral cam 33 at the rear side of the apparatus is rotated by the motor 39, which rotation is transferred to the spiral earn 33 at the front side through a belt 40 and the pulleys 35. The pair of spiral cams is rotated synchronously thereby.

Figure 16:
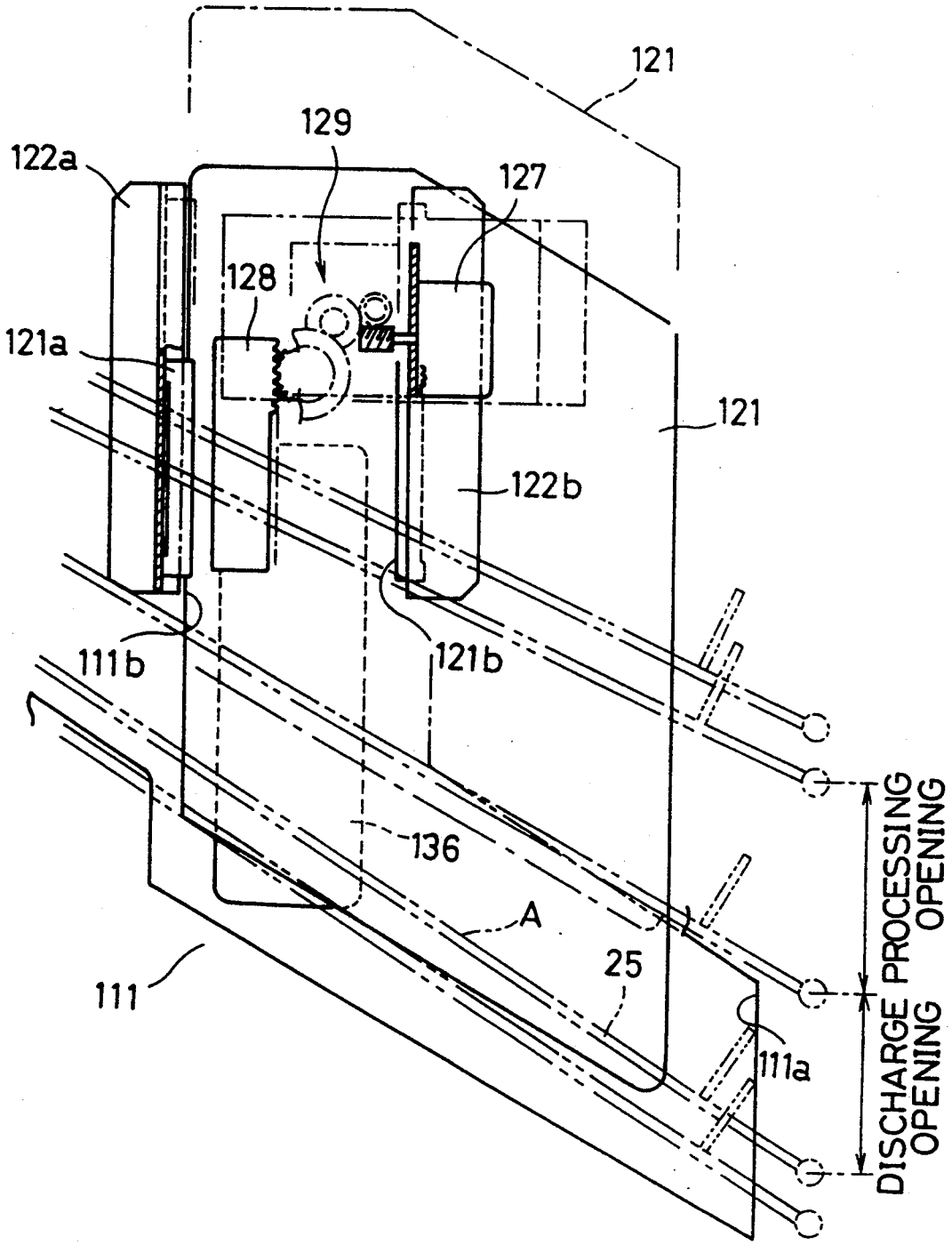
FIG. 16 is a front view of a shutter member and its drive.
Figure 20:
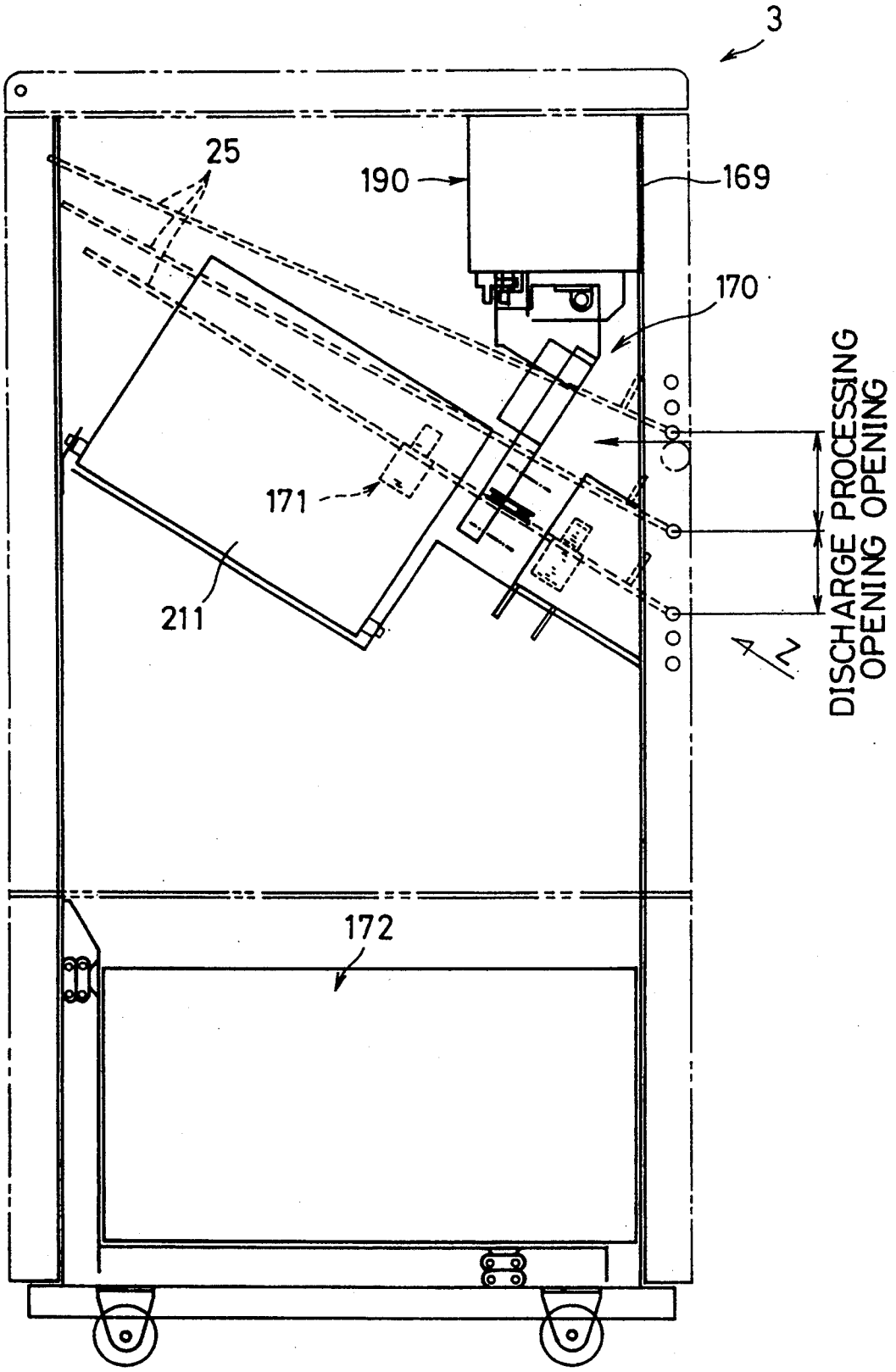
FIG. 20 is a sectional front elevation of a stacker.

The spiral groove 33*a* (referring to FIG. 7) on the outer surface of each spiral cam 33 is formed at uniform pitch along its upper and lower portions, however, each of two pitches along a portion of each of the earns 33 adjacent the process unit 29 (approximately along the central portion of the unit) is larger than the other pitches as indicated in FIGS. 16 and 20. Thus, corresponding spacing above and below the bin opposite the process unit 29, each of them larger than spacing between remaining adjacent bins, are provided an opening through which sheets are discharged from the apparatus body toward the bin unit and stacks of slicers pass to be processed (which opening is referred to as a process opening hereinafter), and an opening through which the stacks of sheets are discharged from the bin unit toward the front side of the apparatus (which opening is referred to as a discharge opening hereinafter).

As a result, introduction of sheets into that bin 25 disposed at the process opening as well as removal from the bins 25 toward the process unit 29 is reliable.

Figure 6:
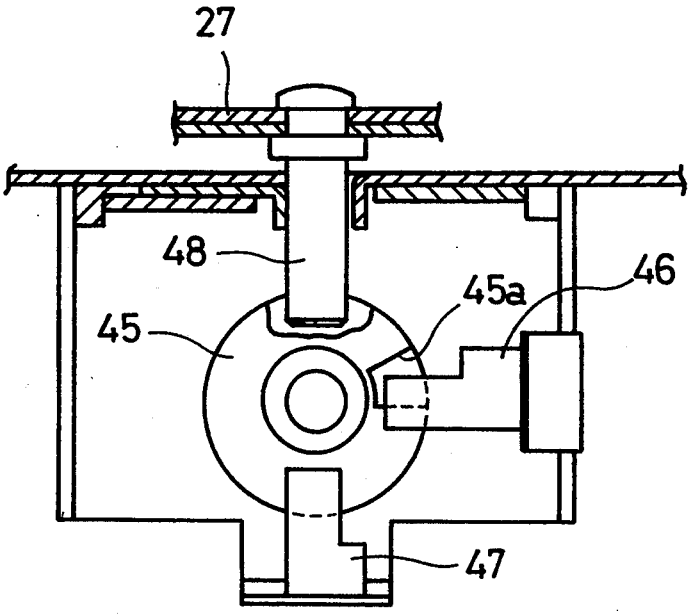
FIG. 6 shows a rotation detecting plate and a sensor for controlling bin movement.
Figure 7:
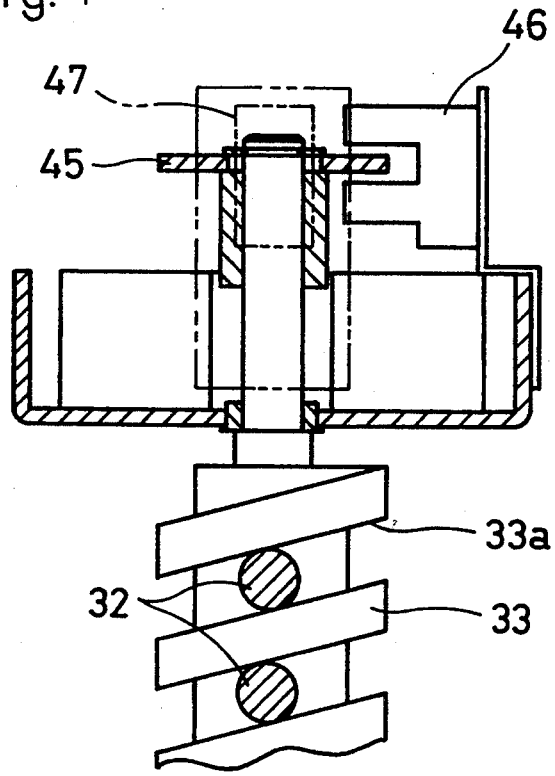
FIG. 7 is a partly in sectional front view of FIG. 6.

As shown in FIGS. 6 and 7, a detect plate 45 for detecting rotational position of the spiral cam 33 is fixed to the upper end thereof. A cutout 45*a* for detecting an angle is formed in the detect plate 45. A photosensor 46 for rotation control and a photosensor 47 for finishing operation control are provided around the detect plate 45. These photosensors 46 and 47 are disposed at a rotational difference of ¼. A support pin 48 for guiding vertical translation of the bins 25 is provided in the bin unit 27. The support pin 48 is engaged with the spiral groove 33*a* of the spiral cam 33.

Referring to FIG. 4, photosensors 49*a* and 49*b* are disposed at upper and lower ends of the bin unit 27, respectively whereby an optical axis may be positioned in the vicinity of the back ends of the bins 25. A slot 25*f* (referring to FIG. 3) is formed at a corresponding part of the bin 25 through which the optical axis formed by the photosensors 49*a* and 49*b* passes. Thus, it is detected whether sheets are stored in the bins 25 or not.

Figure 8:
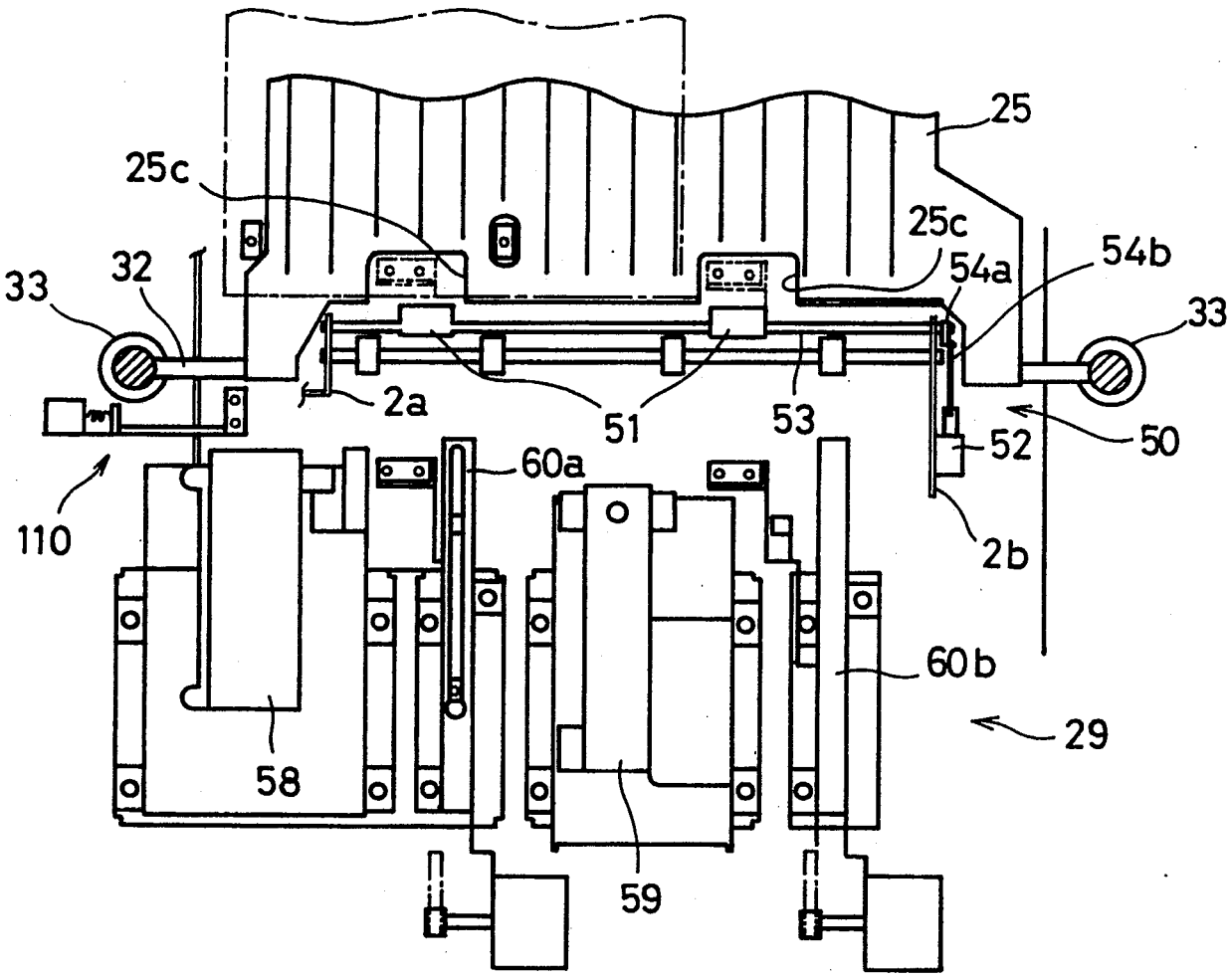
FIG. 8 is a plan view of a finish-processing unit.
Figure 9:
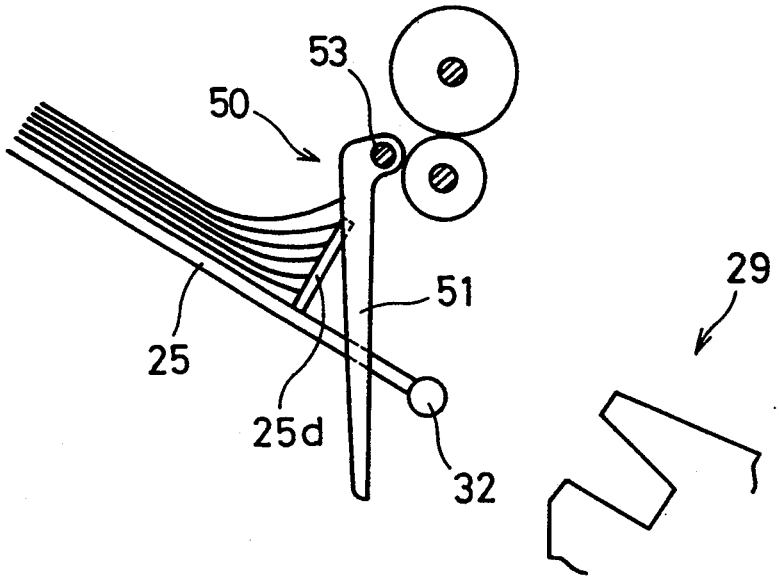
FIGS. 9 and 10 are views illustrating operation of a sheet guide and retain mechanism.
Figure 10:
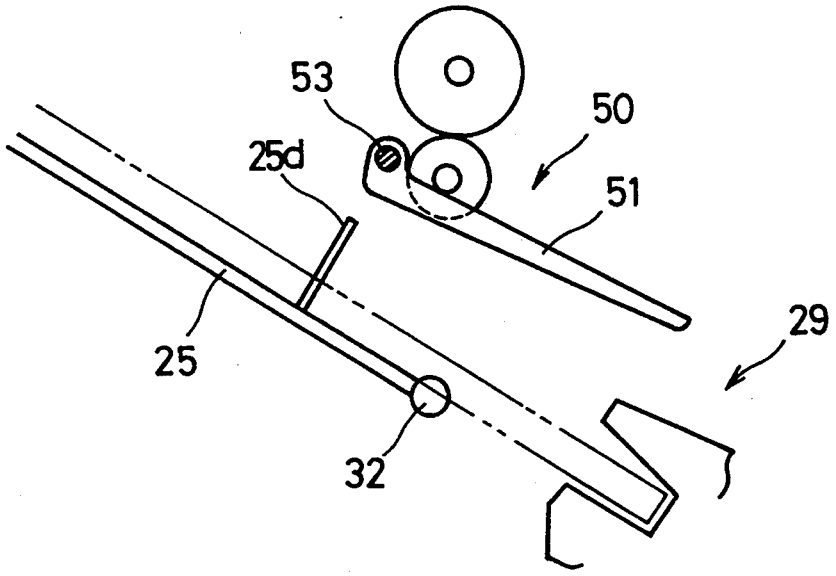

Referring to FIGS. 8 to 10, a mechanism 50 for preventing the sheets from falling down from the slanting bin 25 is disposed between the process unit 29 and the bin unit 27. The mechanism 50 includes two stops 51 and a solenoid 52 for switching their position. The two stops 51 are fixed at a predetermined interval to a rotator rod 53 provided in the front-to-rear direction of the apparatus. The rotator rod 53 is rotatably supported on front and rear support frames 2*a* and 2*b*. The rear end of the rotator rod 53 is coupled to a plunger of the solenoid 52 through linking units 54*a* and 54*b*. While the solenoid 52 is off, the stops 51 are in the position preventing the sheets from dropping down as shown in FIG. 9, and widen the solenoid 52 goes on, they stops 51 are swung up, allowing the sheets to drop as shown in FIG. 10.

As described above, the sheets are prevented from dropping down even in the event that a sheet curled at its trailing edge is fed into the bin 25 such that it goes beyond the standing wall 25*d*.

Figure 11:
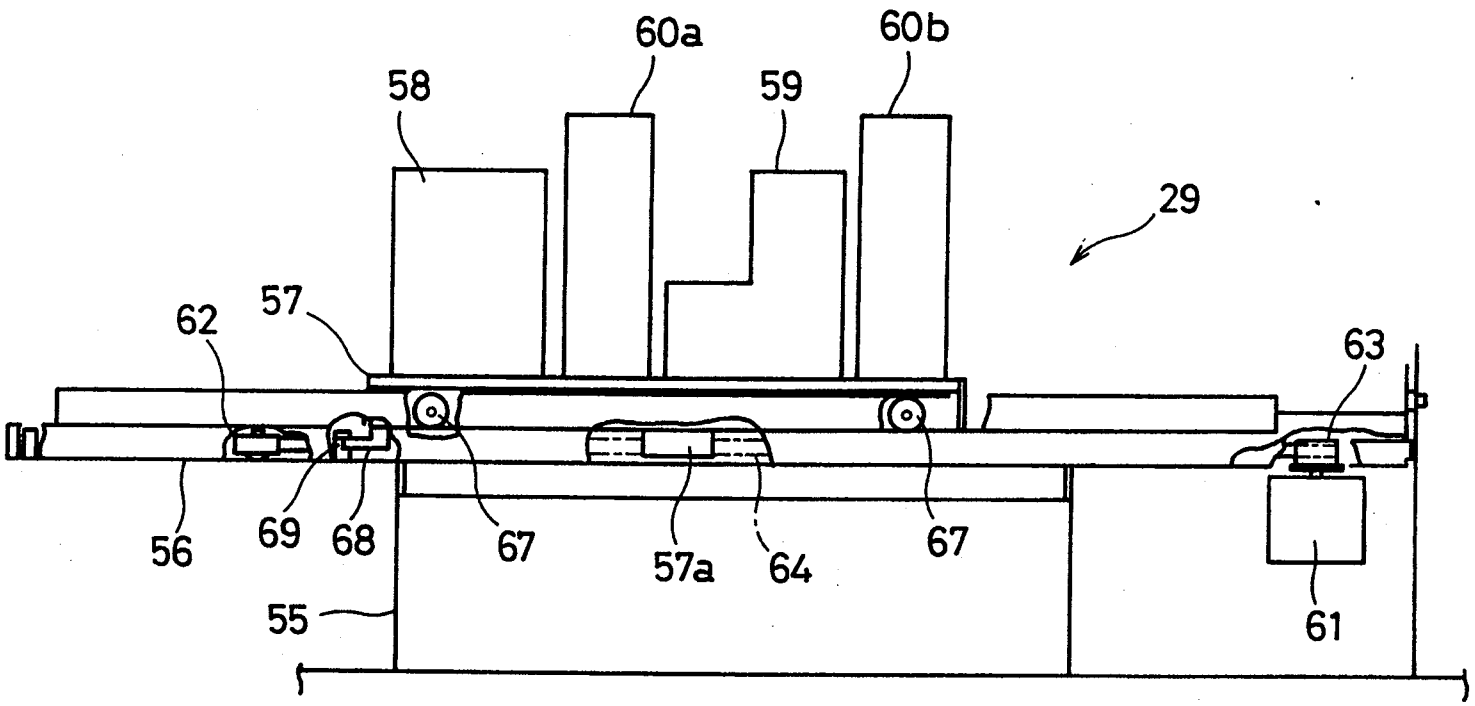
FIG. 11 is an elevation finish-processing unit drive, as seen from the right of the sorter.

Referring to FIGS. 8 and 11, the process unit 29 includes a fixed frame 55, a base table 56 slidable from the fixed frame 55 to be drawn out toward the front side of the apparatus, and a shifting table 57 which can be moved along the base table 56. A stapler 58 and a puncher 59 are disposed on the shifting table 57 and hand units 60*a* and 60*b* are provided as a pair on either side of the puncher 59.

Figure 12:
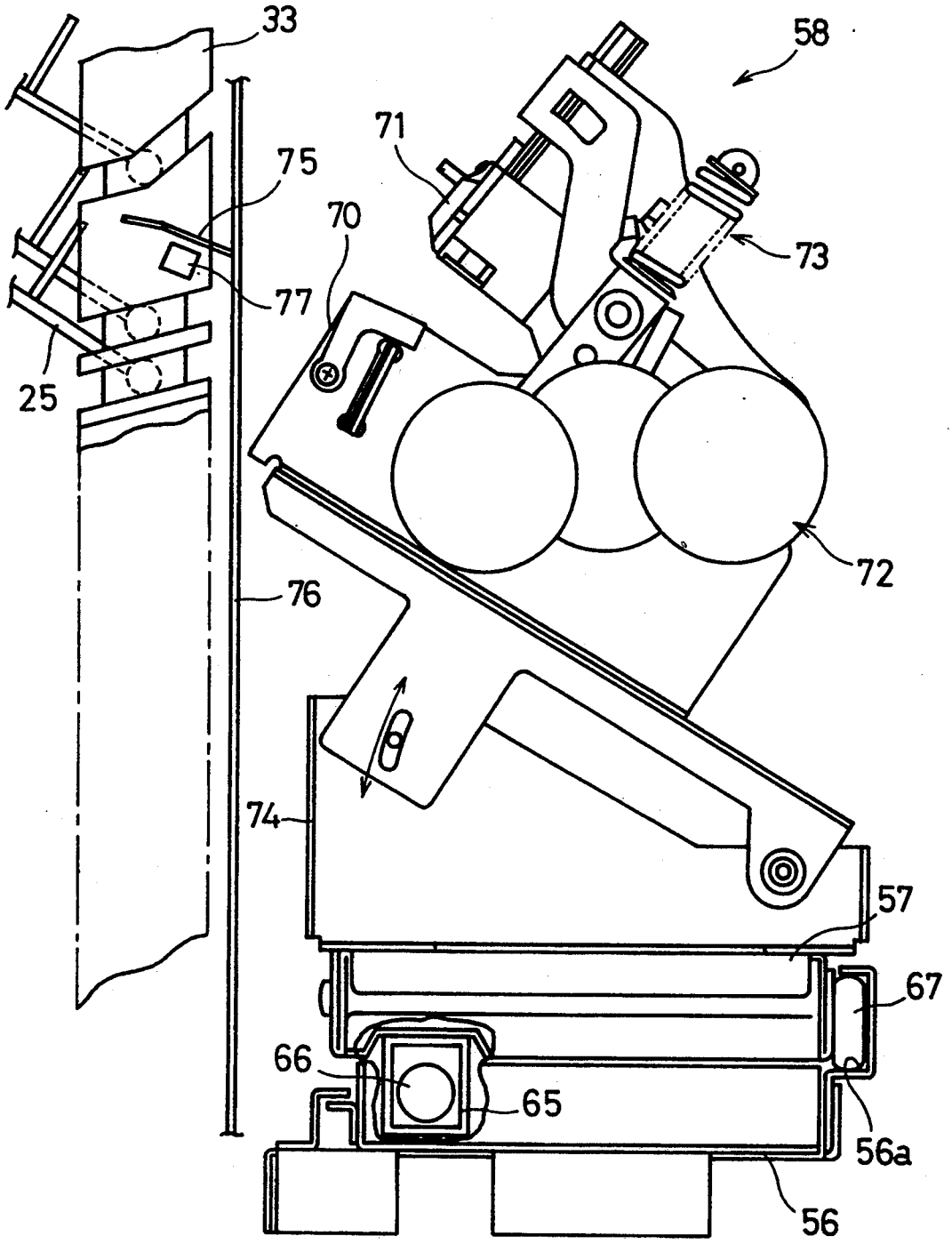
FIG. 12 is a front view of a stapler.

A stepping motor 61 for shifting the table 57 is fixed to the lower surface of the base table 56 on the rear side of the apparatus. A pulley 62 is fixed to the base table 56 on the front side of the apparatus. A timing belt 64 is wrapped around the pulley 62 and a pulley 63 fixed to an upper end of the stepping motor 61. A linking portion 57*a* formed on the lower surface of the table 57 is connected to the timing belt 64. As the timing belt 64 moves, the table 57 is shifted along the base table 56. A bearing 65 is fixed onto the lower surface of the table 57 as shown in FIG. 12 and it is movable along a guide rod 66 provided along the base table 56 in the front-to-rear direction of the apparatus. A plurality of guide rollers 67 provided on the side of the table 57 travel along a support portion 56*a* of the base table 56.

Referring to FIG. 11, a detect plate 68 is fixed to the forward end of the table 57 on its lower surface and a photosensor 69 for detecting a home position is fixed to a reference position of the base table 61. In addition, when the table 57 is in its home position, which is that shown in FIG. 11, the stapler 58 staples the stack of sheets withdrawn from the bin 25 at the corresponding front corner of the adjacent margin thereof. This stapling position is a reference position wherein the stack of sheets is to be stapled at only one point.

FIG. 12 schematically shows structure of the stapler 58.

The stapler 58 comprises a lower jaw 70, an upper jaw 71 pivotally mounted to the lower jaw 70, a staple drive 72 for ramming the upper jaw 71, and a return mechanism 73 for returning the upper jaw 71 to its initial position. The lower jaw 70 is pivotable within a predetermined range on one end of a support unit 74 fixed to the shifting table 57. Thus, the position of the whole stapler 58 can be vertically adjusted within a predetermined range. A sheet guide 75 for guiding the stack of sheets from the bin 25 is Fixed to a partition frame 76 on the left side of the stapler 58. A hole via which sheets are detected formed at one portion of a sheet guide 75, and a reflection-type sensor 77 for detecting a paper jam during a stapling operation is provided under the guide 75.

Figure 13:
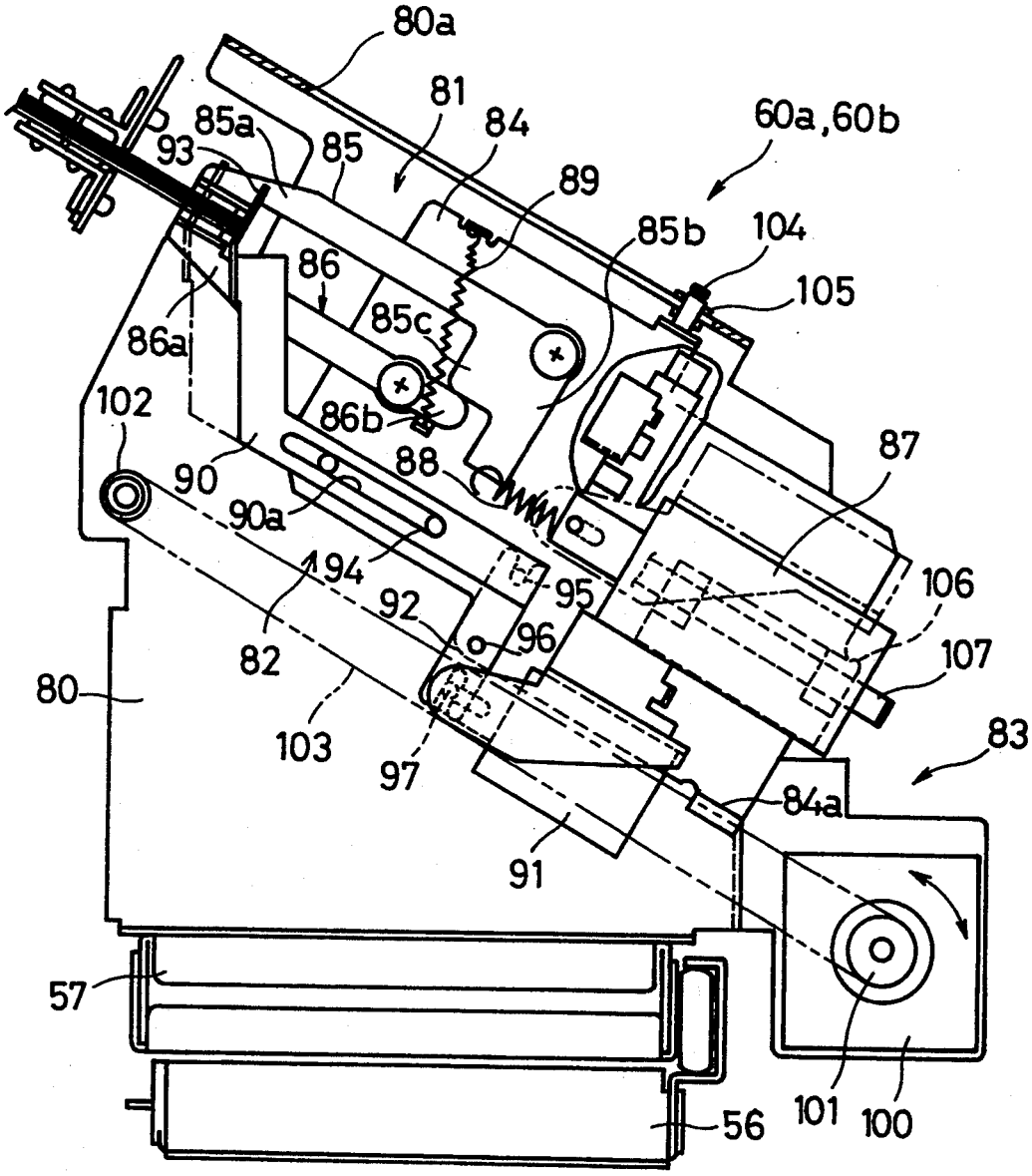
FIG. 13 is a front view of a land unit.

Referring to FIG. 13, each of the hand units 60*a* and 60*b* includes a mounting plate 80, a hand mechanism 81 mounted to the mounting plate 80, a stack shoving mechanism 82, and a drive mechanism 83 for shifting both mechanisms 81 and 82 toward the bin. The lower portion of the mounting plate 80 is fixed to the shifting table 57. The upper portion thereof is bent horizontally and a guide groove 80*a* for guiding the movement of the hand mechanism 81 is formed in the bent portion.

The hand mechanism 81 is fixed to a slider plate 84 and includes an upper hand 85 and a lower hand 86. The upper hand 85 is L-shaped in front view and includes a nipper 85*a* extending toward the bin 25 and a base portion 85*b* extending in the direction perpendicular to the nipper 85*a*. One end of the base portion 85*b* is pivotally fixed to the slide plate 84 and the other end thereof is connected to a solenoid 87 which opens and closes the hand mechanism 81 through a spring 88. The lower hand 86 includes a nipper 86*a* extending toward the bins 25 and an arm extension 86*b* extending in the direction opposite to the nipper 86*a* from a support point on which the base portion 86*b* is pivotally mounted to the slider plate 84. A contact portion 85*c* formed in the base portion 85*b* of the upper hand 85 rides on the arm extension, whereby the upper hand 85 moves in conjunction with the lower hand 86. The arm extension 86*b* of the lower hand 86 retains one end of a spring 89 and an upper portion of the slider plate 84 retains the opposite end. The lower and upper hands 85, 86, are opened by agency of the spring 89, whereas they are closed by the retreat of the solenoid 87 plunger when it is turned on.

The sheet shoving mechanism 82 includes an arm 90, a solenoid 91 and a lever 92 connecting the arm 90 to the solenoid 91. A shove plate 93 for shoving the adjacent end of the stack of sheets is fixed to the front end (on the bin side) of the arm 90. Along guide groove 90*a* is formed in the arm 90 parallel to the shoving direction and a pin 94 fixed to the slider plate 84 fits into the guide groove 90*a*. A pin 95 is fixed to the rear end of the arm 90 and is received by one end of the lever 92. The central portion of the lever 92 is pivotal about a pin 96. The other end of the lever 92 is connected to the plunger of the solenoid 91 through a pin 97. Thus, as the plunger of the solenoid 91 moves, the lever 92 pivots about the pin 96 such that the arm 90 shifts between a drawn position indicated by solid lines in FIG. 13, and a drawn position, indicated therein by single-dash broken lines.

The drive mechanism 83 includes a motor 100 for shifting the slider plate 84. A drive pulley 101 is provided in the motor 100. A driven pulley 102 is rotatably mounted onto the mounting plate 81 on the bin side and a timing belt 103 is wrapped around the drive pulley 101 and the driven pulley 102. A lower portion 84*a* of the slider plate 84 is fixed to the timing belt 103. A Pin 104 in a bearing 105, mounted onto the upper portion of the slider plate 84, slidably penetrates the guide groove 80*a*. A bearing 106, fixed to a portion of the slider plate 84, is supported by a guide rod 107 fixed to the mounting plate 80. The guide groove 80*a*, the timing belt 103 and the guide rod 107 are sloped so as to be approximately parallel to the bin 25 disposed at the process opening.

Figure 14:
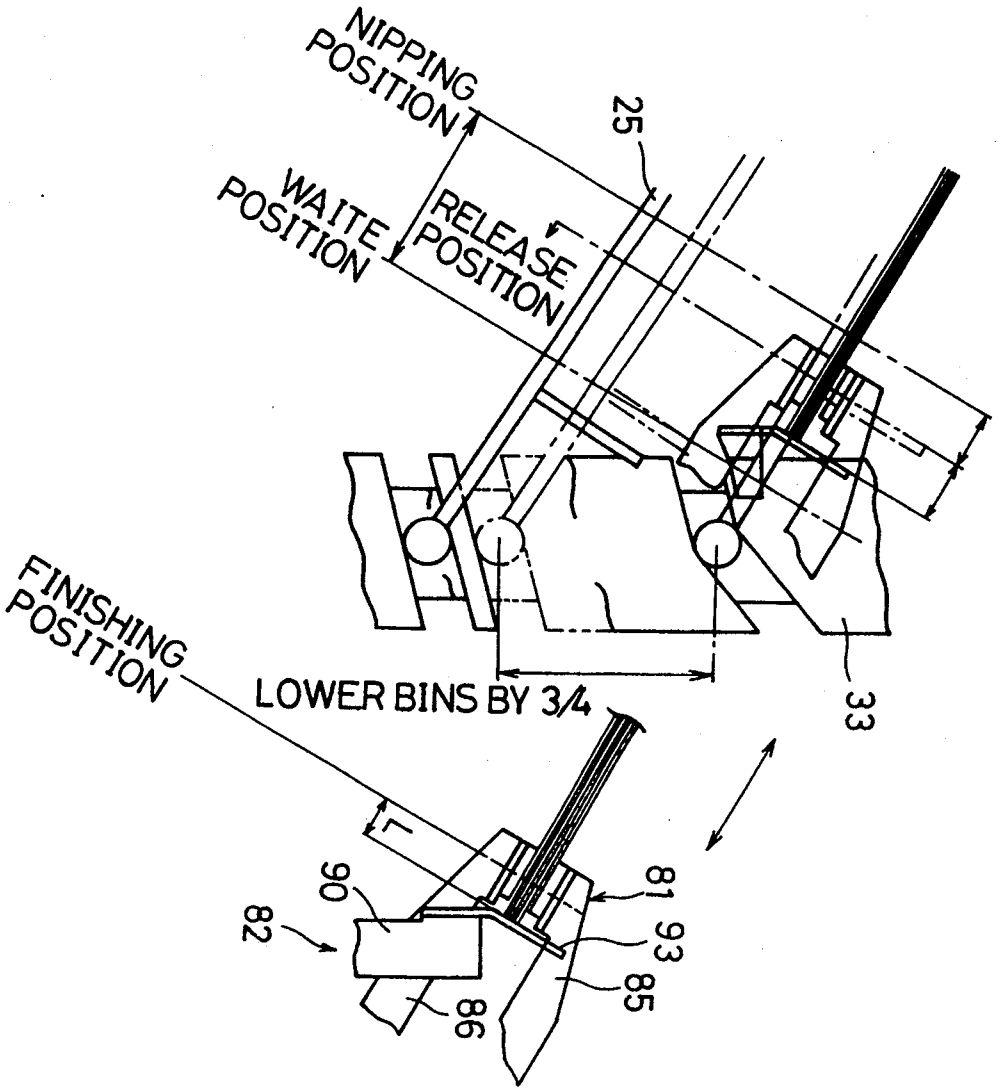
FIG. 14 is a view illustrating operation of the hand unit.

Referring to FIG. 14, the hand mechanism 81 shifts between its home position wherein a stapling operation is performed, a wait position adjacent to the end of the bin 25, and a nipping position for nipping the stack of sheets stored in the bin 25. In addition, a release position, wherein the hand mechanism 81 releases a finished stack of sheets in order to return it back to the bin 25, is set between the nipping position and the wait position. Meanwhile, in the home position of the hand mechanism 81, the shove plate 93 fixed to the end of the arm 90 of the stack shoving mechanism 82 is in its drawn position, wherein the plate is retreated by a distance L from the home position; and in the release position of the hand mechanism 81, the arm 80 travels toward the bin 25 until it reaches the center of the nipping portion of the hand mechanism 81.

As shown in FIG. 8, a sheet clasping mechanism 110 for holding the stack of sheets being processed is provided further to the front the apparatus from the stapler 58.

Figure 15:
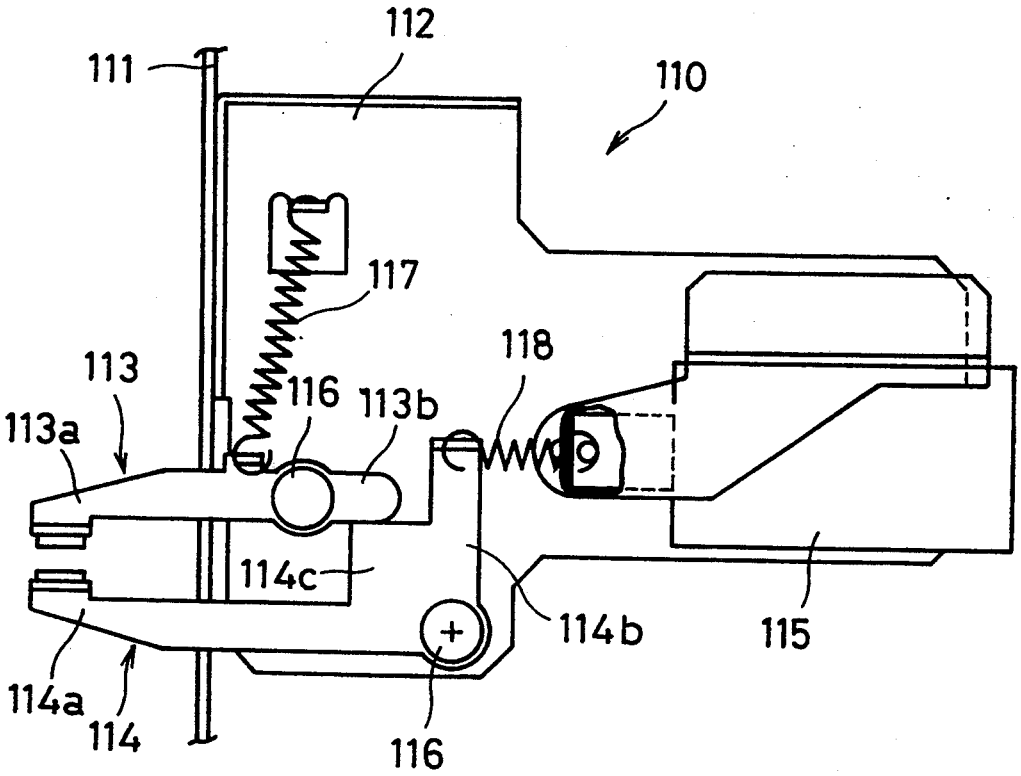
FIG. 15 is a view of a sheet holding unit, as seen from the left of the sorter.

Referring to FIG. 15, the sheet clasping mechanism 110 comprises a frame 112 fixed to a front side frame 111 of the sorter, and upper and lower hands 113 and 114 operated by a solenoid 115. The upper and lower lands 113 and 114 include respective nippers 113*a* and 114*a* extending in the sliding direction of the shifting table 57. Both hands 113 and 114 are pivotally mounted to the fixed frame 112 on pins 116. The lower hand 114 further includes a base portion 114*b* extending upward in an L from the pill 116, and a contact portion 114*c*, extending toward the upper hand 113 in the vicinity of its pin 116, on which an arm extension 113*b* of the upper hand 113 rides. The nipper 113*a* of the upper hand 113 retains one end of a spring 117 by which it is for opened, the opposite end of the spring 117 being retained by an upper portion of the fixed frame 112. Thus both the upper and lower hands 113 and 114 are opened by the spring 117. A plunger of the solenoid 115 is connected to the base portion 114*b* of the lower hand 114 through a spring 118. As the plunger of the solenoid 115 retreats, both hands 113 and 114 close.

Referring to FIG. 16, an outlet 111*a* is formed in the front side frame 111 through which the stack of sheets stored in the bin 25 in a position A (the discharge opening) is discharged toward the front side of the apparatus. The outlet 111*a* is opened and closed by a shutter member 121, against which sheets are registered widthwise. The shutter member 121, as can be seen from FIGS. 16 and 17, extends in the vertical direction and is positioned so as to provide an abutment along the adjacent edge of a standard minimum-sized sheet. All rail 121*a* is formed along the left side of the shutter member 121 (toward the sheet-forward end of the bins). In addition, a fall 121*b* formed approximate horizontal in the center of the shutter member 121 projects toward the front of the apparatus and is bent to the right, i.e., the sheet-incoming side. A vertical cutout 111*b* is formed in the front side frame 111 such that it connects with the outlet 111*a*. The shutter member 121 is disposed inside the front side frame 111 and the rails 121*a* and 121*b* project through the cutout 111*b* and extend beyond the front side frame 111. Guides 122*a* and 122*b* are fixed to edges of the cutout 111*b* of the front side frame 111. The guides 122*a* and 122*b* slidably travel on the rails 121*a* and 121*b* of the shutter member 121.

A shutter drive mechanism 125 for driving the shutter member 121 is disposed outside the front side frame 111. The drive mechanism 125 has a support frame which is C-shaped in section, and a motor 127 for driving the shutter member 121 is fixed inside the support frame 126. A rack 128 is vertically fixed to the outer surface of the shutter member 121. The rack 128 extends into the support frame 126 through the cutout 111*b* of the front side frame 111. A gear train 129 for transferring the rotation of the motor 127 to the rack 128 is provided in the support frame 126. Thus, the shutter member 121 moves between an opened position indicated by single-dash broken lines in FIG. 16 and a closed position indicated by solid lines. In the opened position, the stack of sheets stored in the bin 25 corresponding to the outlet 111*a* can be discharged toward the front side of the apparatus meanwhile in the closed position, the stack of sheets is blocked from being discharged from the outlet 111*a*.

Figure 17:
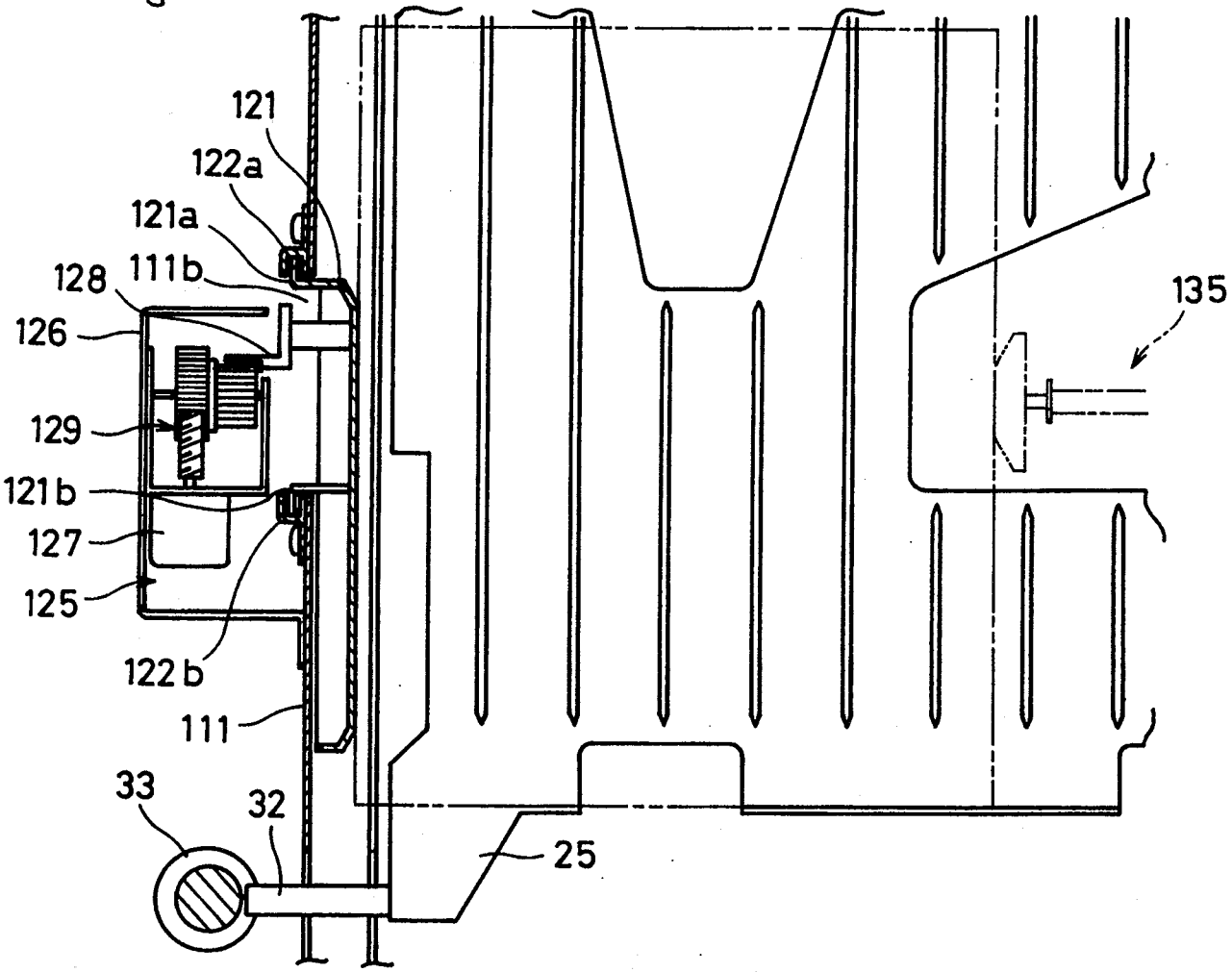
FIG. 17 is a partly in sectional plan view corresponding to FIG. 16.
Figure 18:
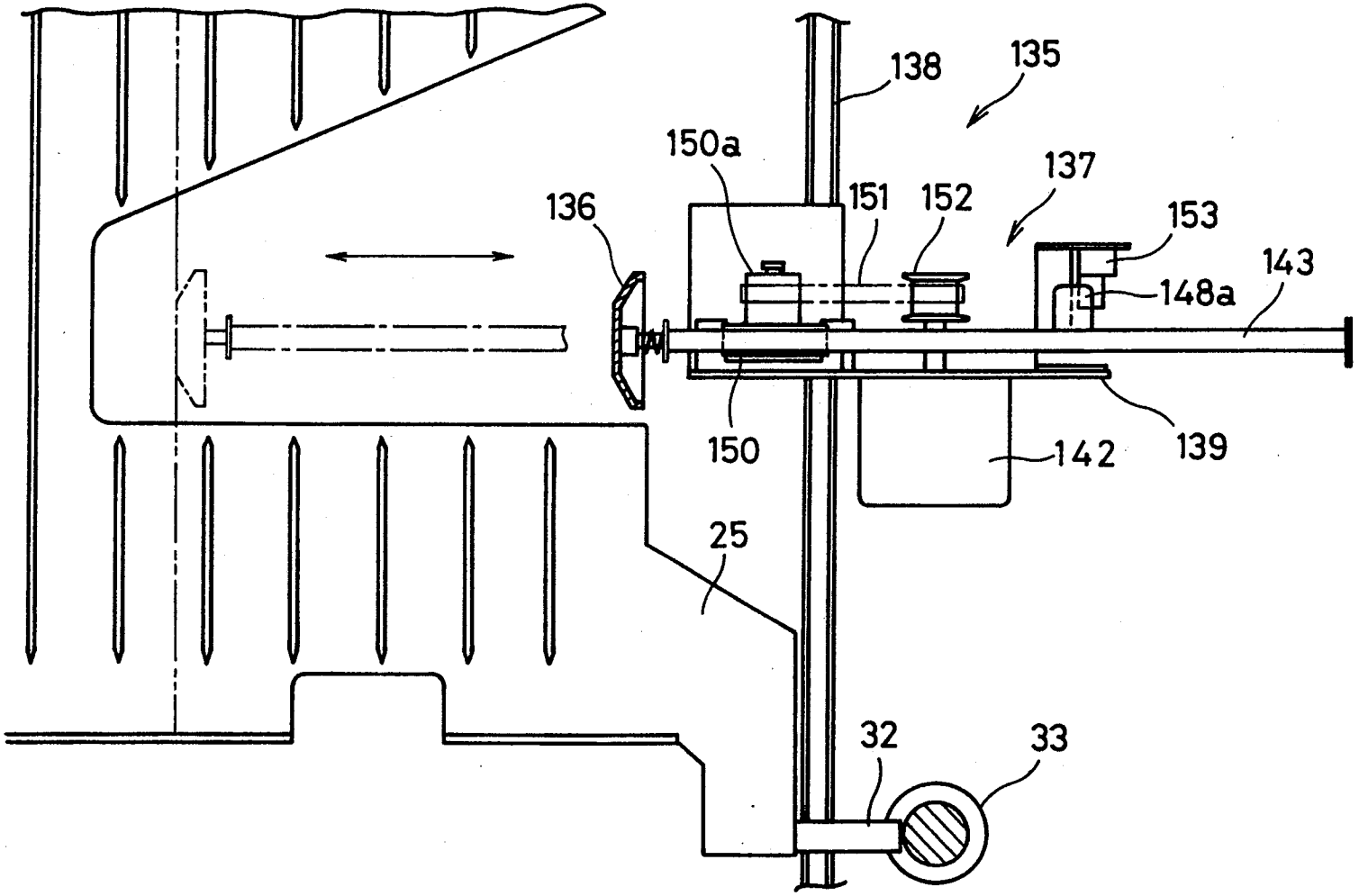
FIG. 18 is a plan view of a lateral tamper.
Figure 19:
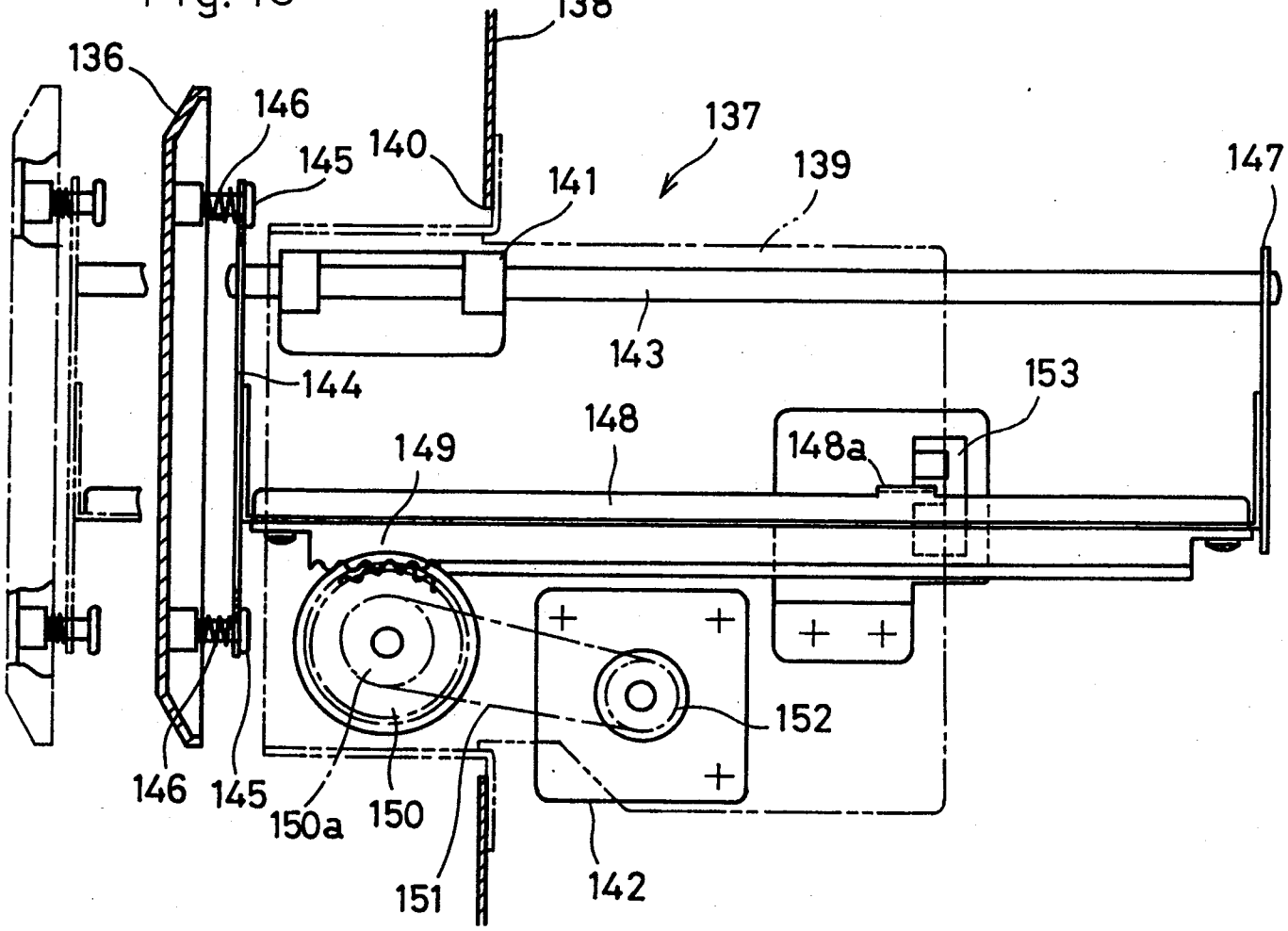
FIG. 19 is a cross sectional view of the lateral tamper.

Referring to FIGS. 17 through 19, a lateral tamper 135 is disposed behind the bins opposite the shutter member 121. The lateral tamper 135 includes a contact plate 136 and tamper drive mechanism 137 for shifting the contact plate back and forth.

As can be seen from FIG. 16, the contact plate 136 is of sufficient extent vertically that it can register the sheets stored in the three bins 25, that is, the bins positioned at the process and discharge openings, and the bin immediately above the bin positioned at the process opening. As shown in FIG. 19, the tamper drive mechanism 137 includes a contact frame 139 fixed to a rear side frame 138. One portion of the contact frame 139 is inserted into the apparatus through a cutout 140 formed in the rear side frame 138. A slide bearing 141 is fixed to the upper portion of the frame 139 and a motor 142 is fixed to the lower portion of the frame 139. A guide rod 143 is supported by the slide bearing 141 and one end of the guide rod 143 is fixed to a front mounting plate 144. The front mounting plate 144 extends vertically and abuts against upper and lower pins 145 fixed to the back surface of the contact plate 136. Springs 146 provided between the front mounting plate 144 and the contact plate 136 elastically press the latter. A rear mounting plate 147 which also extends vertically is fixed to the rear end of the guide rod 143. A connecting plate 148 is fixed between the front and rear mounting plates 144 and 147 so as to be parallel to the guide rod 143. A rack 149 having the same length as that of the connecting plate 148 is fixed to the lower surface thereof. The rack 149 is engaged with a pinion gear 150 rotatably mounted onto the lower portion of the frame 189. A pulley 150*a* is integrally fixed to the pinion gear 150, and is connected to a drive pulley 152 of the motor 142 by a timing belt 151. A detection tab 148*a* is formed on one portion of the connecting plate 148 whereby the home position of the contact plate 136 is detected by a photosensor 153 fixed to the frame 139.

The transport unit 28 of the sorter 2 includes a supply section 28*a*, a transport path 28*b* used when the sheets are to be sorted, and a transport path 28*c* diverging from the supply section 28*a* as shown in FIG. 2, used when the sheets are not sorted. Supply rollers 160 and a claw 161 are provided in the supply section 28*a*. The transport path 28*b* is provided between the supply section 28*a* and the bins 25 and guides a sheet to the process opening formed by the spiral cams 33. The transport path 28*c* is provided between a bin 162 disposed at the upper portion of the sorter 2, and the supply section 28*a*, and it guides sheets into the bin 162 in a non-sorting mode.

Stacker

Figure 21:
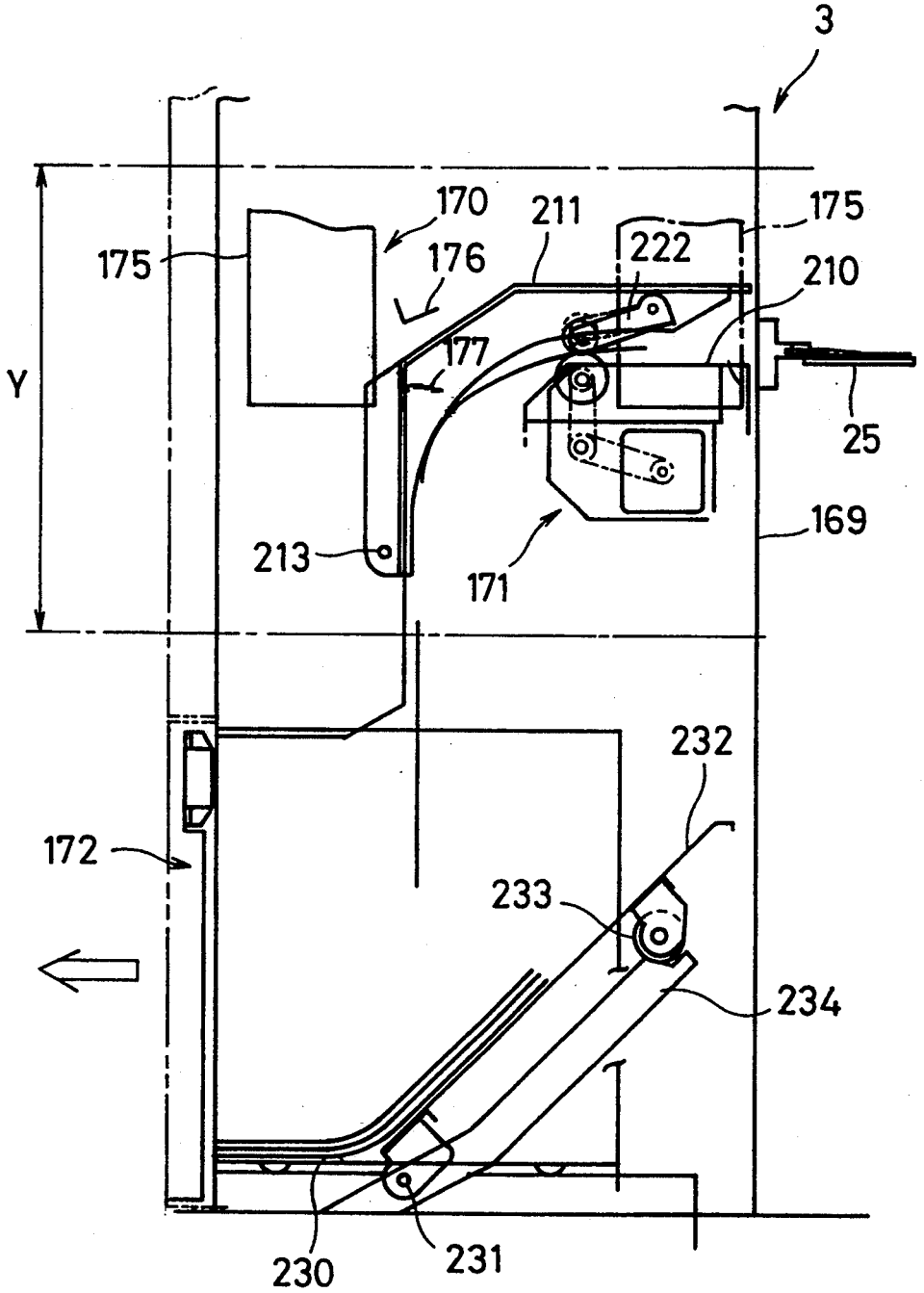
FIG. 21 is a spilt-section side view of the stacker.

FIGS. 20 and 21 show the overall structure of a stacker unit 3. FIG. 20 is a front view in which the discharger 3 is viewed from the front of the copying apparatus, and FIG. 21 is a schematic view in which the discharger 3 is viewed from the right side of the unit. A portion Y in FIG. 21 is viewed along direction Z, indicated in FIG. 20.

The discharger 3 includes a stacker hand mechanism 170 for nipping the finish-processed stack of sheets in the bin 25 positioned at the discharge opening and drawing the stack of sheets into the discharger 3, a discharge mechanism 171 for discharging the stack of sheets drawn toward the front of the apparatus by the stacker hand mechanism 170, and a reservoir 172 for housing the discharged stacks of sheets. The stacker hand mechanism 170, the discharge mechanism 171 and the reservoir 172 are disposed in a body frame 169.

Figure 22:
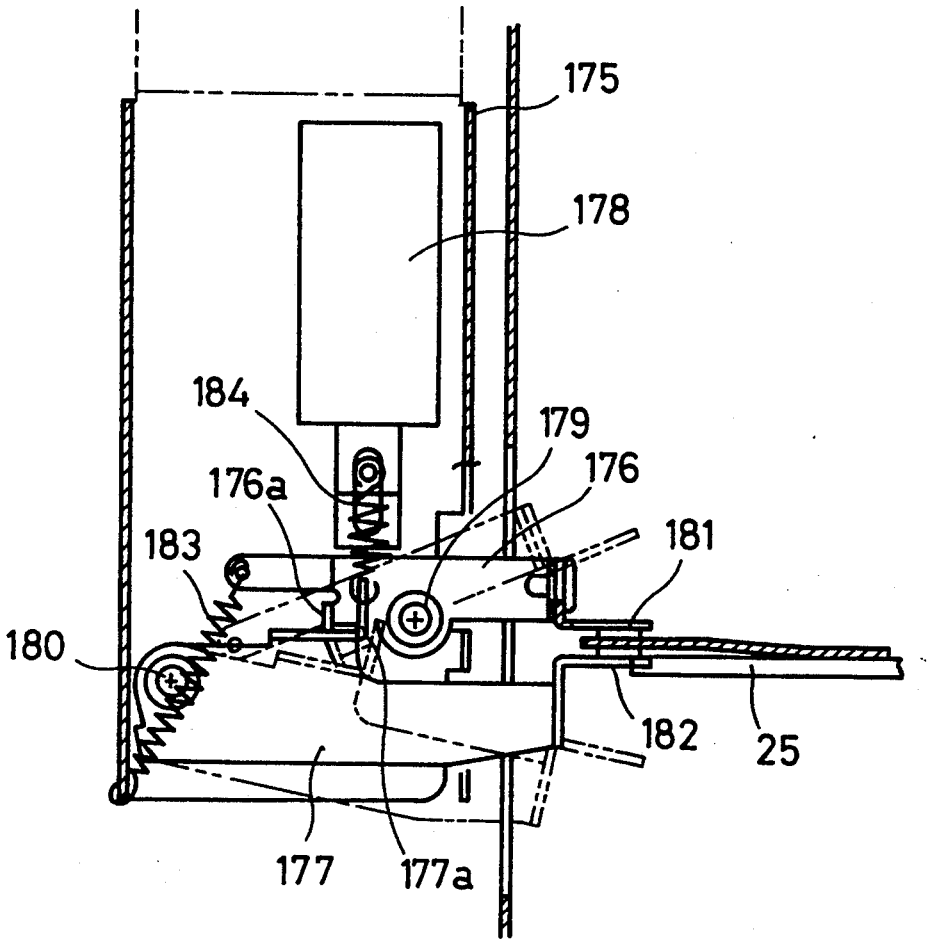
FIG. 22 is a side view of a stacker hand mechanism.

Referring to FIG. 22, the stacker hand mechanism 170 includes a shifting frame 175, an upper hand 176, a lower hand 177 and a solenoid 178 for driving the upper and lower hands 176 and 177. The central portion of the upper hand 176 is pivotally mounted to the shifting Frame 175 by a pin 179. The distal end of the lower hand 177 is pivotally mounted to the shifting frame 175 by a pin 180. Nippers 181 and 182, for nipping the side of the stack of sheets in the bin 25, are fixed to the front ends of the upper and lower hands 176 and 177, respectively. The distal end of the upper hand 176 retains one end of a spring 183 and the remaining end of the spring 183 is attached to the shifting frame 175. A contact portion 176*a* is formed on the upper hand 176 between the pin 179 and the spring 183. The contact portion 176*a* rides on a corresponding portion of the lower hand 177. Thus, under agevey of the elastic force of the spring 183, the upper and lower hands 176, 177 are swung into the opened position indicated by single-dash broken lines in FIG. 22. A contact portion 177*a* formed on the corresponding portion of the lower hand 177 is connected to a plunger of the solenoid 178 through a spring 184. Thus, as the plunger of the solenoid 178 retreats, both the upper and lower hands 176 and 177 are brought into the closed position indicated by solid lines in FIG. 22.

Figure 23:
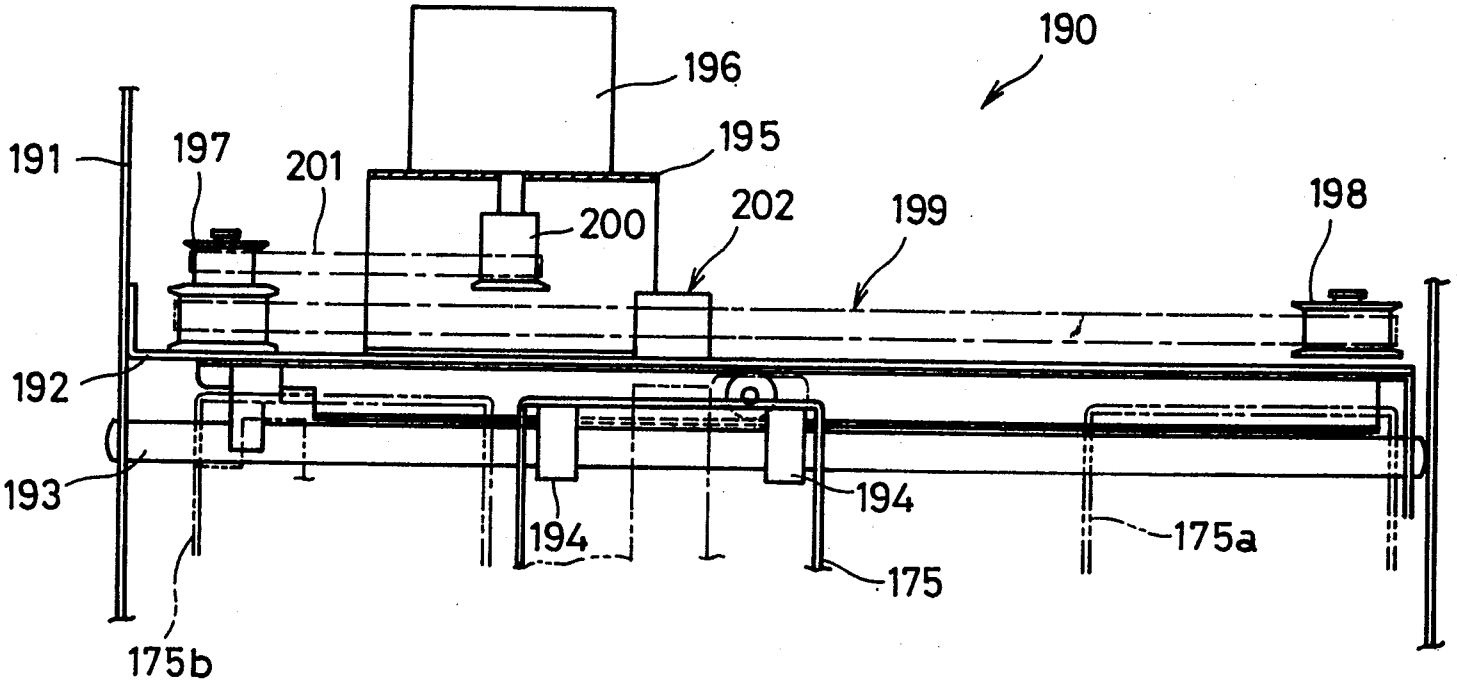
FIG. 23 is a side view of a stacker hand mechanism shifter.

The moving frame 175 is moved between a nipping position (175*a*) and a drawn position (175*b*) indicated by double-dash lines in FIG. 23 by a moving mechanism 190 shown therein.

The moving mechanism 190 is disposed in the upper portion of the discharger 3 as shown in FIG. 20. The moving mechanism 190 includes a frame 192 supported by a frame 191 of the stacker unit 3. In addition, the moving mechanism 190 includes a guide rod 193 extending in the front-to-rear direction of the apparatus. One end of the guide rod 193 is supported by the frame 191 and the other end of the guide rod 193 is fixed to an opposite end of the frame 192. The moving frame 175 includes a bearing 194 which is slidable along the guide rod 193 in the front-to-rear direction of the apparatus. A stepping motor 196 mounted on a support member 195 fixed to the upper surface of the frame 192. A two-stage pulley 197 and a pulley 198 are rotatably mounted on the upper surface of the frame 192 at the front and rear ends of the discharger 3, respectively. A timing belt 199 is wrapped around the lower pulley of the two-stage pulley 197, and the pulley 198. A drive pulley 200 is fixed to the end of the motor 196 and a timing belt 201 is wrapped around the drive pulley 200 and the upper pulley of the two-stage pulley 197. A joint member 202 projects upward from the upper surface of the moving frame 175 and the joint member 202 is connected to the timing belt 199. Thus, when the motor 196 rotates, the moving frame 175 moves along the guide rod 193 in the front-to-rear direction of the apparatus.

Figure 24:
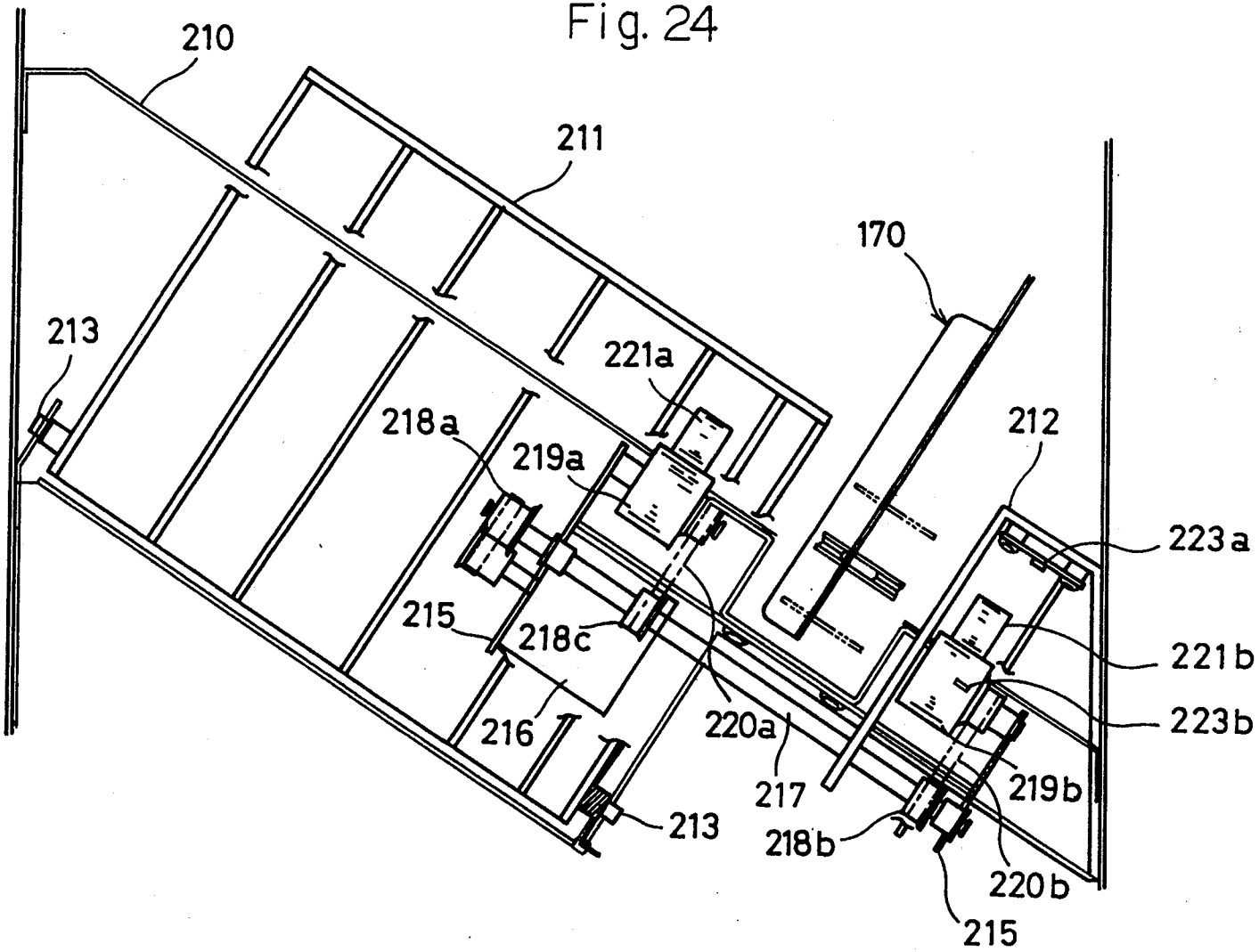
FIG. 24 is a front view of a discharger mechanism.

Referring to FIGS. 20, 21 and 24, the discharger mechanism 171 includes a plurality of guide plates 210, 211 and 212 for guiding the stack of sheets. The first guide plate 210 is disposed at the same height and slant as the bin 25 positioned at the discharge opening, and therein the stack of sheets is discharged onto the first guide plate 210. The second guide plate 211 is provided over the first guide plate 210 toward its front side. The lower end of the second guide plate 211 pivots about a support pin 213 so as to be opened or closed. The second and third guide plates 211 and 212 are disposed so as to be lateral to each other, flanking a moving path of the stacker hand mechanism 170 between.

The discharger mechanism 171 further includes a motor 216 supported by a support frame 215 as shown in FIG. 24. The support frame 215 flanks the moving path of the stacker hand mechanism 170. A rotator rod 217 is disposed under the first guide plate 210, approximately parallel to the surface of the first guide plate 210. Pulleys 218*a*, 218*b* and 218*c* are fixed to either end and the central portion of the rotator rod 217, respectively. Drive rollers 219*a* and 219*b* are rotatably mounted to the support frame 215 at a predetermined interval. The drive rollers 219*a* and 219*b* are rotated through connection to the pulleys 218*c* and 218*b* fixed to the rotator rod 217 by timing belts 220*a* and 220*b*, respectively. Driven rollers 221*a* and 221*b* are in contact with the driven rollers 219*a* and 219*b*, respectively. The stack of sheets drawn toward the front side of the apparatus by the hand mechanism 170 passes between the drive rollers 219*a*/219*b* and the driven rollers 221*a*/221*b*, whereby it is introduced into the reservoir 172. The driven rollers 221*a* and 221*b* are rotatably mounted to corresponding ends of a pivot arm 222 as shown in FIG. 21, so as to nip the stack of sheets with predetermined force. A pair of penetration-type photosensors 223*a* and 223*b* (referring to FIG. 24) is disposed in the path of the discharger mechanism 171 so as to detect occurrence of a paper jam in the discharging section.

As can be seen from FIG. 24, the rotator rod 217, the pairs of discharging rollers 219*a*/221*a*, and 219*b*/221*b* are disposed at the same slope as the bin 25 such that the side to the left in the figure is higher than the side to the right.

Consequently, if the pairs of rollers were to rotate at the same speed, the right lower corner portion in FIG. 24 of a discharging stack of sheets would fall first into the reservoir 172, likely damaging that portion of the stack. Therefore, the upper roller pair 219*a*/221*a* is rotated at a higher speed than is the lower roller pair 219*b*/221*b*. Thus, the stack of sheets discharged from the pairs of rollers passes through positions indicated at (1) to (4) in FIG. 25 and both lower corners of the stack of sheets reach the reservoir 172 approximately the same time, such that the only one corner portion will not be damaged.

The reservoir 172 can be drawn out of the discharger 3 toward the front side of the apparatus. As shown in FIG. 21, the reservoir 172 includes a horizontal tray 230 and a pivotal tray 232 mounted to a portion of the side wall of the reservoir 172 central in the front-to-rear direction so as to be pivotal about a pin 231. A roller 233 is fixed to the free end of the pivotal tray 232. Guide members 234 sloping upward from approximately the central portion of the side walls toward the rear of the apparatus are provided on the side walls of that portion of the discharger 3 in which the reservoir 172 is housed. The roller 233 fixed to the pivotal tray 232 tracks along the guide member 234. Thus, in the state wherein the reservoir 172 is housed in the discharger 3 (referring to FIG. 21), the stacks of sheets are stored in such a manner that they slope upward toward the rear side of the stacker 3, and in the state wherein the reservoir 172 is withdrawn, the pivotal tray 232 is approximately horizontal, such that the stacks of sheets are readily discharged.

Control Block

Figure 26:
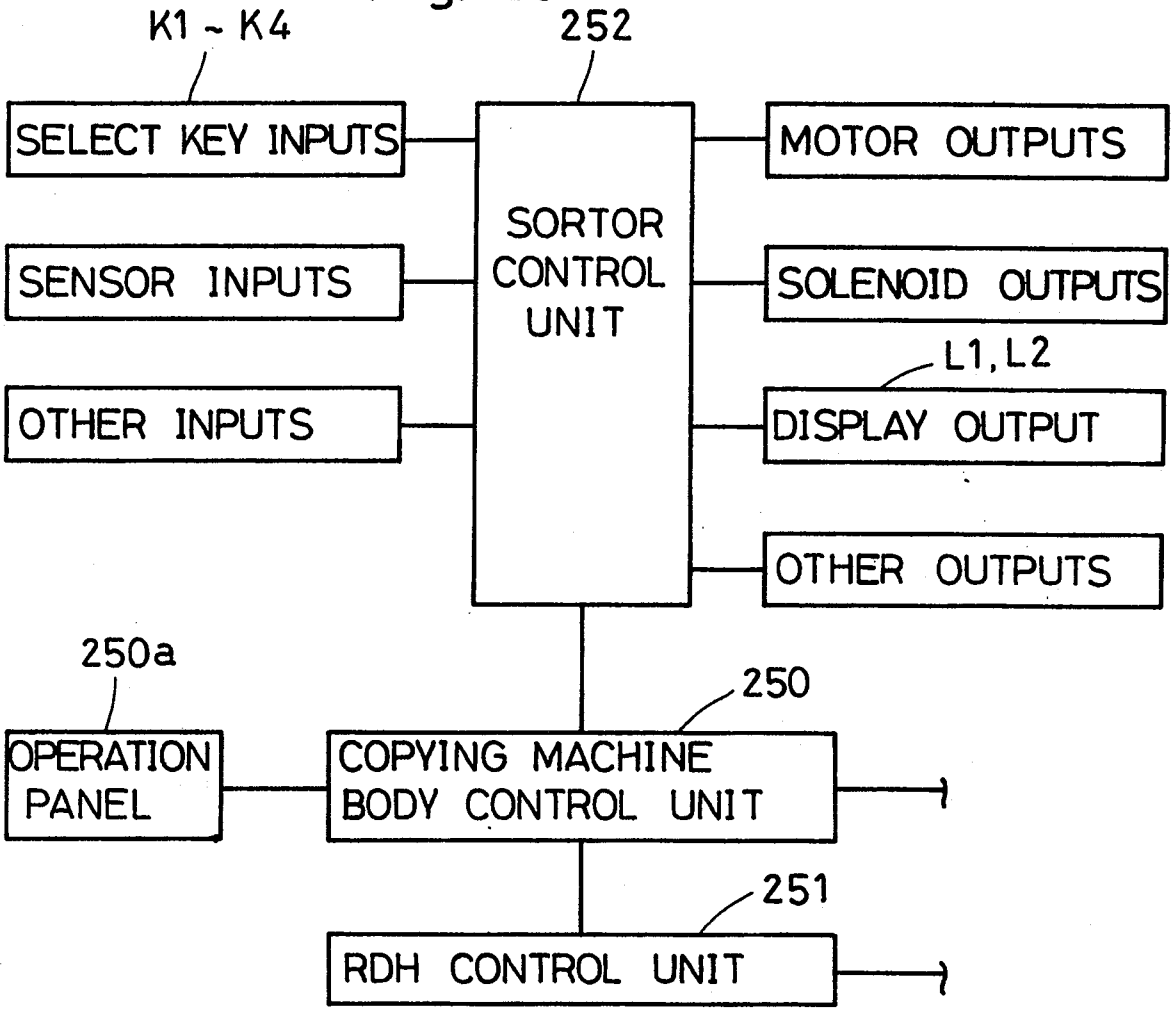
FIG. 26 is a control system block diagram.
Figure 27:
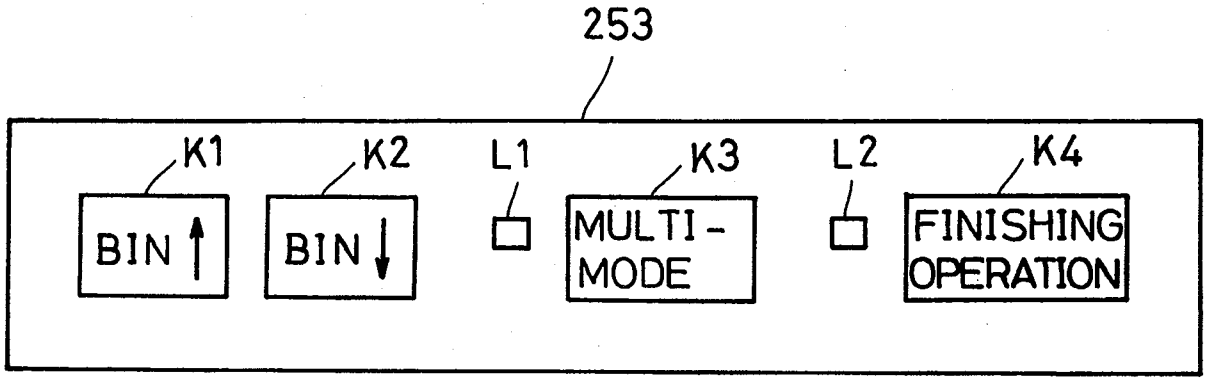
FIG. 27 is a schematic plan of an operation panel of the sorter.

Referring to FIG. 26, the copying machine body 1 of the copying apparatus includes a copying apparatus main control unit 250 and the automatic original transport unit 11 includes an RDH control unit 251. A sorter control unit 252 is provided in the sorter 2. The sorter and the discharger 3 both are controlled by the sorter control unit 252. Each of the control units 250 to 252 comprises a microcomputer including a ROM, a RAM and a CPU. Select keys K1, K2, K3 and K4 provided on an operation panel 253 of the sorter diagramed in FIG. 27, sensors in the sorter 2 and the discharger 3, and other inputs are connected to the sorter control unit 252. In addition, motors and solenoids of the sorter 2 and the discharger 3, LED's (display outputs) L1 and L2 on the sorter operation panel, and other outputs are connected to the sorter control unit 252. The sorter control unit 252 is connected to the copying apparatus main control unit 250, as is the RDH control unit 251. An operation panel 250*a* on which various keys including mode-select and decimal keys are arranged is connected to the copying apparatus main control unit 250.

The key K1 on the sorter operation panel 253 is for raising the bin unit 27, and the key K2 is for lowering it. The key K3 is for selecting an operational mode (referred to as multioperation hereinafter) in which the process unit 29 and the discharger 3 operations are executed in parallel. The key K4 is for executing the operation by the process unit 29. The LED's L1 and L2 indicate, respectively, ON or OFF of the multi-mode and operation by the process unit 29.

General Operation

Several operational modes are specified in the copying machine body 1. More specifically, it can be set whether a sorting operation is performed during a discharging operation or not, whether the finish-processed stack is discharged to the reservoir 172 or not, and whether either of the stapling or punching operations is to be performed by the process unit 29 of the sorter 2 or not. In addition, if the multi-operation is selected, a number of stacks of sheets greater than the number of the bins can be processed.

Sorting Operation

When the sorting mode is selected, sheets discharged from the copying machine body 1 are transferred to the transport path 28*b* by the claw 161 and introduced into each bin 25 of the bin unit 27. Each bin 25 of the bin unit 27 is sequentially lifted or lowered for the sorting operation by rotation of the spiral cam 33. While the bins 25 are vertically translated, the adjacent bin spacing 25 increases between those bins positioned at the process opening and the discharge openlag beneath it. At this time, if the trailing edge of sheet curls upward, the sheet could slip over the standing wall 25*b* of the bin 25. However, during vertical translation of the bins, the stops 51 are in the position wherein it blocks the sheets from slipping off the stack, such that none will drop out from the bins 25.

Meanwhile, when the non-sorting mode is selected, the discharged sheet is transferred to the transport path 28*c* by the claw 161 and then sequentially discharged into the bin 162.

Finish-Processing Operation

When the mode for performing either the stapling or the punching operation is selected, the stacks of sheets stored in the bins 25 are finish-processed.

At this time, if after the sorting operation the lowermost bin storing a stack of sheets is positioned at the process opening (in which case the number of originals is an odd number), a finish-processing operation is started from that position. Meanwhile, if the lowermost bin is not positioned at the process opening (i.e., the number of originals is an even number), the bins 25 are translated so that the lowermost bin may be positioned at the process opening.

Then, the stops 51 are swung into the position allowing the stack of sheets to drop and the hand units 60*a* and 60*b* are extended whereby the hand mechanisms 81 nip the end of the stack of sheets in the bin 25. In this state, the spiral cam 22 is rotated by $\frac{3}{4}$ such that the bin 25 positioned at the process opening is lowered by a predetermined distance. In this position, the lowermost edge along the ends of the sheets held by the hand mechanism 81 is left above the standing wall 25*d*. Then, when the hand units 60*a* and 60*b* are returned to their home position, the feed-trailing edge of the stack of sheets is brought into the stapling position of the stapler 58. Then, the stack of sheets is released. One or both of the hand units 60*a* and 60*b* are used accordingly suitable to the present sheet size. More specifically, for lesser sheet widths, only the hand unit 60*a* is used, and for greater widths, both hand units 60*a* and 60*b* are used.

In the usual case wherein the apparatus frontward corner of the received end of the stack of sheets is to be stapled, the stapling operation is performed in this position. In case the rearward corner of the leading edge of the stack of sheets is to be stapled, the stapler 58 is shifted rearward by driving the shifting table 57, wherein it executes the stapling operation at a predetermined position. Further, in the case wherein the stapling operation is to be performed at both frontward and rearward widthwise positions along the adjacent end of the stack of sheets, the stapler 58 staples the stack at the frontward location and then is shifted into a position to execute further stapling operation at the rearward location. When the punching operation is performed, the shifting table 57 is also moved into a predetermined position in the front-to-rear direction of the apparatus and then the stack of sheets is punched by the punching unit 59 in that position. After the stack of sheets is moved into the finish-processing position, wherein the above operations are to be performed, the front corner along the adjacent end of the stack of sheets is clasped by the sheet clasping mechanism 110 before the hand mechanism(s) 81 release the stack of sheets, whereby the stack of sheets is restrained against disarrangement during finish-processing, ensuring that the operations are performed in the right position(s).

Following the above operation(s), the stack of sheets is nipped by the hand mechanism(s) 81 again and the hand units 60*a* and 60*b* extend, whereby the stack of sheets is moved in the sheet-feeding direction into the higher portion of the bin 25. Then, the hands 85 and 86 are opened and the stack of sheets is released. In this state, the arm 90 of the sheet shoving mechanism 82 shoves the trailing edge of the stack of sheets such that the trailing edge slips out of the hands 85 and 86. The stack of sheets is thereby returned into the bin 25. Thus, since the trailing edge of the stack of sheets is pushed by the arm 90 after being released from the hands 85 and 86, the stack of sheets is returned surely from the hands 85 and 86 into the bin 25.

After the above operation. The hand mechanism(s) 81 are moved to their home position and then the spiral cam 33 is further rotated by $\frac{1}{4}$, whereby the bin 25 in which the processed stack of sheets is stored is moved into position adjacent the discharge opening.

Adjusting Operation

With the above sorting operation, when the sheets have been introduced into each bin 25, an operation to register the sheets laterally is performed, wherein the above finish-processing operation is to be executed, the registering operation is performed before the stack of sheets is nipped by the hand units 60*a* and 60*b*.

In this registering operation. The shutter member 121 is lowered to close the outlet 111a. Then, the contact plate 136 is moved forward by a predetermined distance according to a sheet size. Thus. The sheets in the bin 25 are moved toward the front side of the apparatus, registering them widthwise between the shutter member 121 and the contact plate 136.

Multi-operation

Wherein the multi-operation mode is selected. The finish-processed stacks of sheets in succeeding bins 25 are discharged, at the same time the finish-processing operation such as stapling or punching operation is performed on the stacks in each bin immediately preceding.

In this case, the stacker hand mechanism 170 is moved toward the rear side of the apparatus, that is, toward the bin 25 positioned at the outlet 111*a*, in order to nip the front end of the stack of sheets in the bin 25. After the stacker hand mechanism 170 nips the front end of the sheets stack, the stack stored in the bin 25 is drawn from the outlet 111*a* toward the front side of the apparatus along the first guide plate 210 as shown in FIG. 21. At this time, the roller pairs of the discharger mechanism 171 rotate in synchronization with the moving speed of the hand mechanism 170. When the hand mechanism 170 moves forward and comes to the rollers of the discharger mechanism 171, the side end of the stack of sheets is seized by the roller pair. The movement of the hand mechanism 170 and the rotation of the roller pairs are stopped and the hands 176 and 177 of the hand mechanism 170 are then opened to release the sheets. The hand mechanism 170 then travels further forward, and the stack of sheets separates from the hands 176 and 177 such that it remains in the discharger mechanism 171. Then, by rotating the roller pairs of the discharger mechanism 171, the stack of sheets is transported toward the front side of the apparatus, guided downward along the second guide plate 211 and thus stored in the reservoir 172.

According to the foregoing, by executing the above multioperation, if the number of bins is 20 for example, the sorting and finish-processing operations nevertheless can be performed onto more than 20 stacks of sheets.

When the stacks of sheets stored in the reservoir 172 are to be taken out, the reservoir 172 is drawn frontward of the apparatus. Therein, the pivotal tray 232 moves down along the guide member 234 while pivotal about the pin 231 clockwise in FIG. 21. When the reservoir 172 has been withdrawn to the utmost, the rotatable tray 232 is approximately horizontal, such that the stacks of sheets in the reservoir 172 can be easily taken out.

Figure 25:
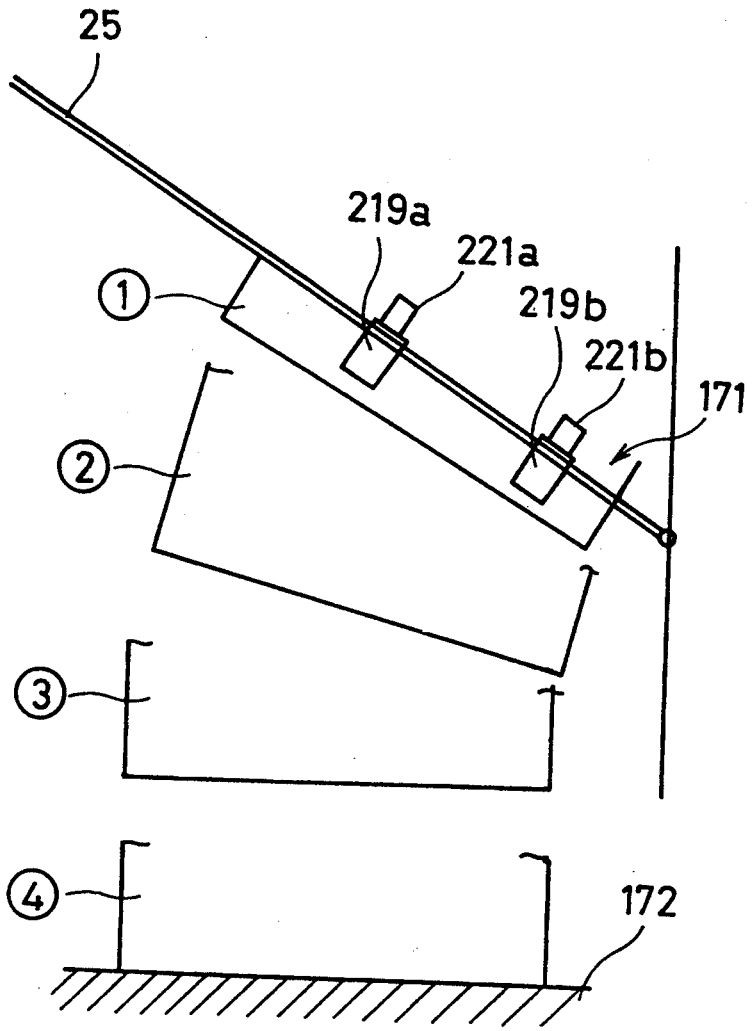
FIG. 25 is a view illustrating an operation of the discharging mechanism.

As each stack of sheets is discharged from the roller pairs of the discharger mechanism 171, since the bin-upward roller pair rotates faster than the bin downward roller pair, as indicated in FIG. 25 the stack of sheets falls through positions (1), (2) and (3) to reach position (4) therein. Consequently, since the frontward corners of the stack of sheets both reach the tray of the reservoir 172 at almost the same time, the right corner of the stack of sheets will not itself be damaged.

In order to carry out maintenance on the stapler 58 and associated devices, a cover 260 on the front side of the sorter 2 is opened and the base table 56 is drawn frontward therefrom. Maintenance is readily performed in this state, since the stapler 58, the punching unit 59 and the hand units 60*a* and 60*b* on the base table 56 are dismounted from the sorter 2.

Control Operation

The copying machine 1 is controlled by the copying apparatus main control unit 250, as well as the sorter control unit 252 as will be described later.

Main Control of Copying Machine

Figure 28:
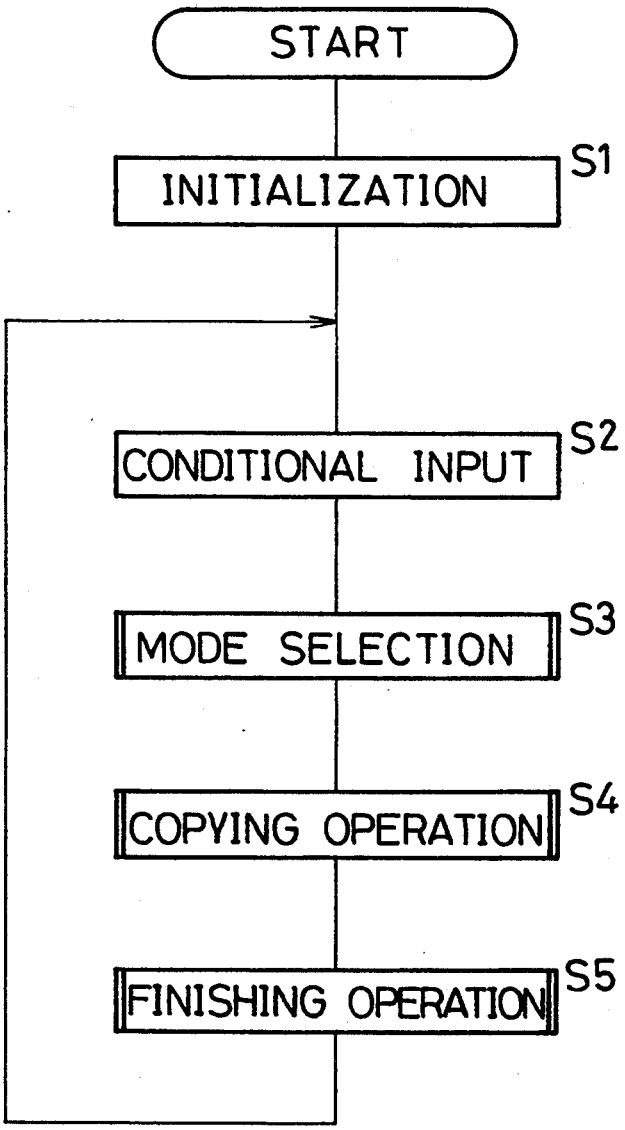
FIG. 28 is a flow chart of the copying machine body main process control.

The copying apparatus main control unit 250 controls each of associated units according to the routine diagramed in the flow chart of FIG. 28.

When a main switch of the apparatus is turned on, an initialization procedure is carried out at step S1, wherein, for example, the number of copies is set to be one. Then, at step S2, a conditional input operation is performed wherein, for example, an input setting the number of copies is received. An operating mode is selected at step S3, a copying operation is performed at step S4, and a finish-processing operation is performed at step S5. In this example, the finish-processing operation will be described with regard to the stapling operation and the multi-operation.

Mode Selecting Operation

Figure 29:
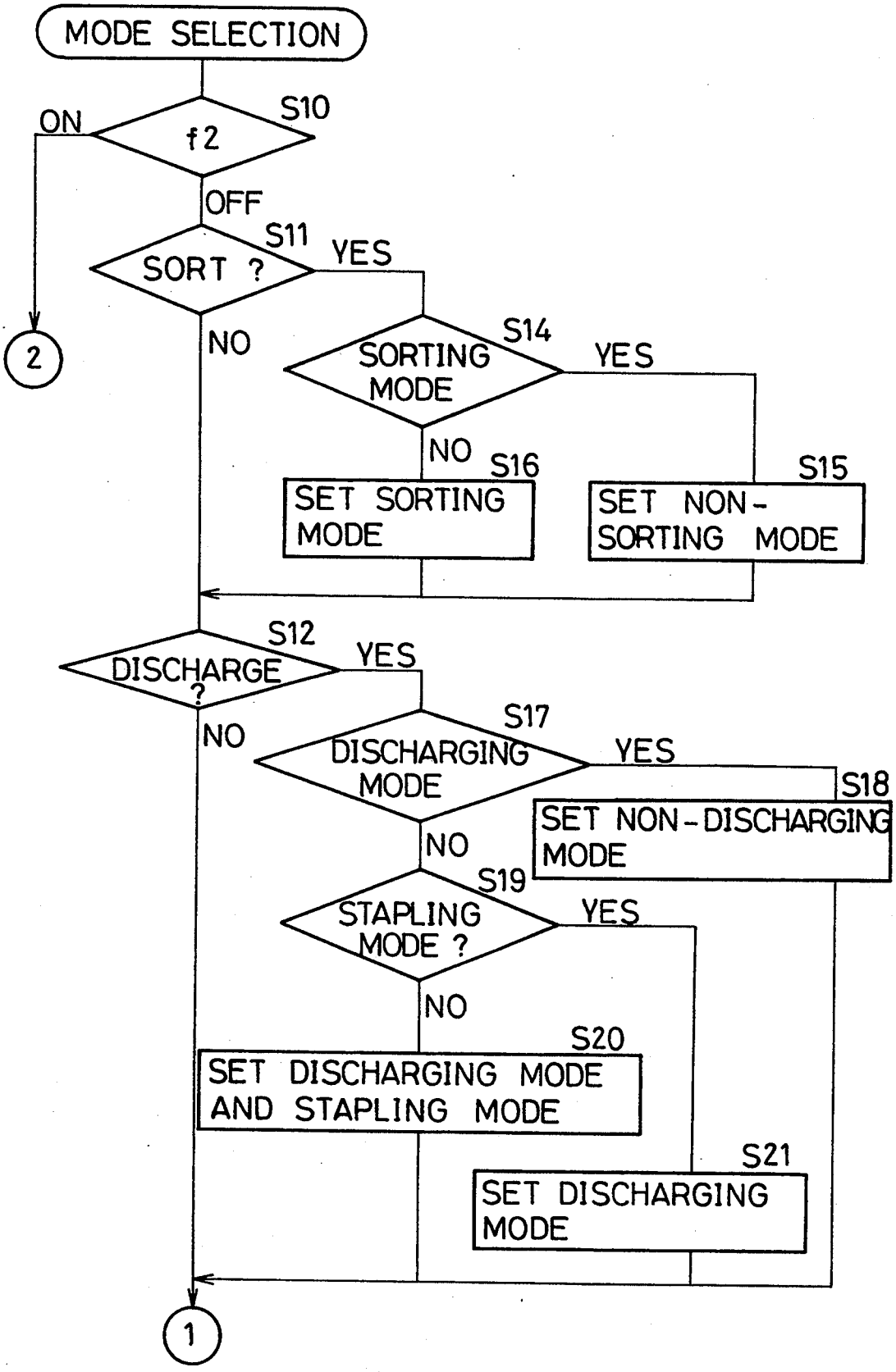
FIGS. 29 and 30 are flow charts of a mode selecting operation process control.
Figure 30:
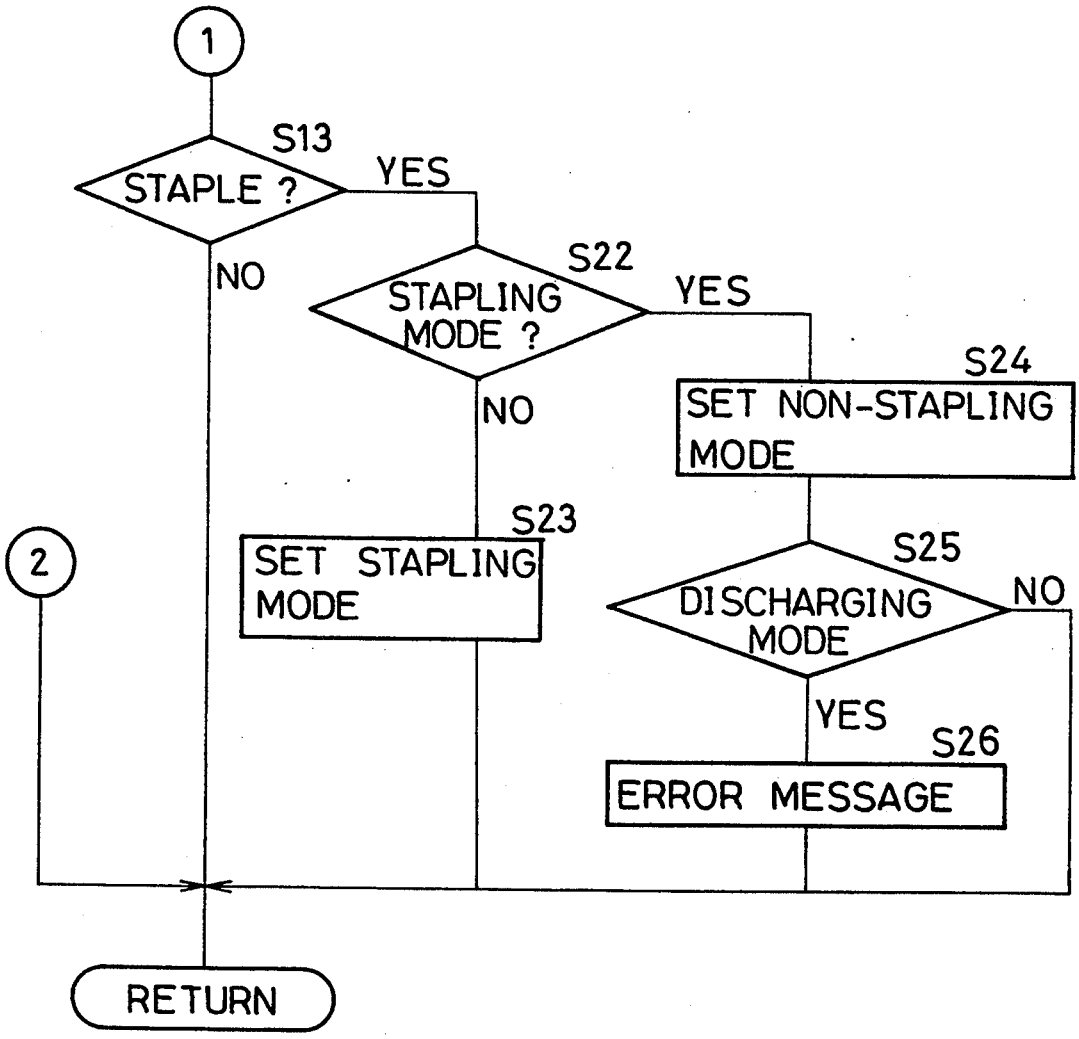

FIGS. 29 and 30 show the mode selecting operation at step S3.

In the mode selecting operation, it is determined at step S10 whether a mode decision flag f2 is on or off. The mode decision flag f2 is on when the operating mode is decided (for example, during a copying operation) and it is off when the mode is not decided. Since the mode decision flag f2 is off at the initialization, the program proceeds from step S10 to step S11. Meanwhile, the flag f2 is on while a copying operation or the like is performed, such that the mode selecting operation is not carried out. It is determined at step S11 whether the key for selecting the sorting mode is pressed or not. The program also determines whether the discharging mode is selected at step S12, and whether the stapling mode is selected at step S13. The discharging mode is that in which the operation for discharging the stacks of sheets in the bins 25 to the reservoir 172 of the discharger 3 is executed. In this case, both the stapling and discharging operations are performed in parallel (multioperation). The multi-operation is selected by key K3 provided oil the sorter operation panel 253.

When the key for selecting the sorting mode is pressed, the program proceeds from step S11 to step S14. It is determined at step S14 whether the sorting mode has been already set or not. If the sorting mode has been already set, the program proceeds to step S15 and the operation mode is set to the non-sorting mode. If the sorting mode has not been selected, the program proceeds to step S16 to set the sorting mode. Thus, either the sorting mode is selected or if it has been already set it is canceled by pressing the sorting-mode select.

When the key (multi-key K3) for selecting the discharging mode is pressed, the program proceeds from step S12 to step S17. It is determined at step S17 whether the discharging mode has been already selected or not. If the discharging mode has been selected, the program proceeds to step S18 to set the non-discharging mode. Meanwhile, If the discharging mode has not been selected, the program proceeds from step S17 to step S19. It is determined at step S19 which the stapling mode is selected or not. If the discharging mode were to be selected though the stapling mode is not, stack of sheets would be discharged without being stapled and would become disarranged. Therefore, when the discharging mode is set but the stapling mode is not, the program proceeds from step S19 to step S20, wherein the discharging mode is set and the stapling mode is automatically set also. Wherein the stapling mode has been already set, the program proceeds from step S19 to step S21 to set the discharging mode.

When the key for selecting the stapling mode is pressed, the program proceeds from step S13 to step S22. It is determined at step S22 whether the stapling mode has been already set or not. If it has not been set, the program proceeds to step S23 to set the stapling mode. If the stapling mode has been already set, the program proceeds from step S22 to step S24 and cancels the stapling mode. The non-stapling mode is set at step S24. Then, it is determined at step S25 whether the discharging mode has been selected or not. If the discharging mode has been set, the program proceeds to step S26. An error message is displayed at step S26. More specifically, if the discharging mode were to be executed as set in the non-stapling mode, the sheets would become disarranged in the reservoir 172 as described above. Therefore, the error message is displayed to draw the operator's attention. When the error message is displayed, a discharging-mode setting signal is not applied to the control unit 252 of the sorter, thereby prohibiting the discharging operation. When the discharging mode has not been set, the program returns from step S25 to the main routine.

Copying Operation

Figure 31:
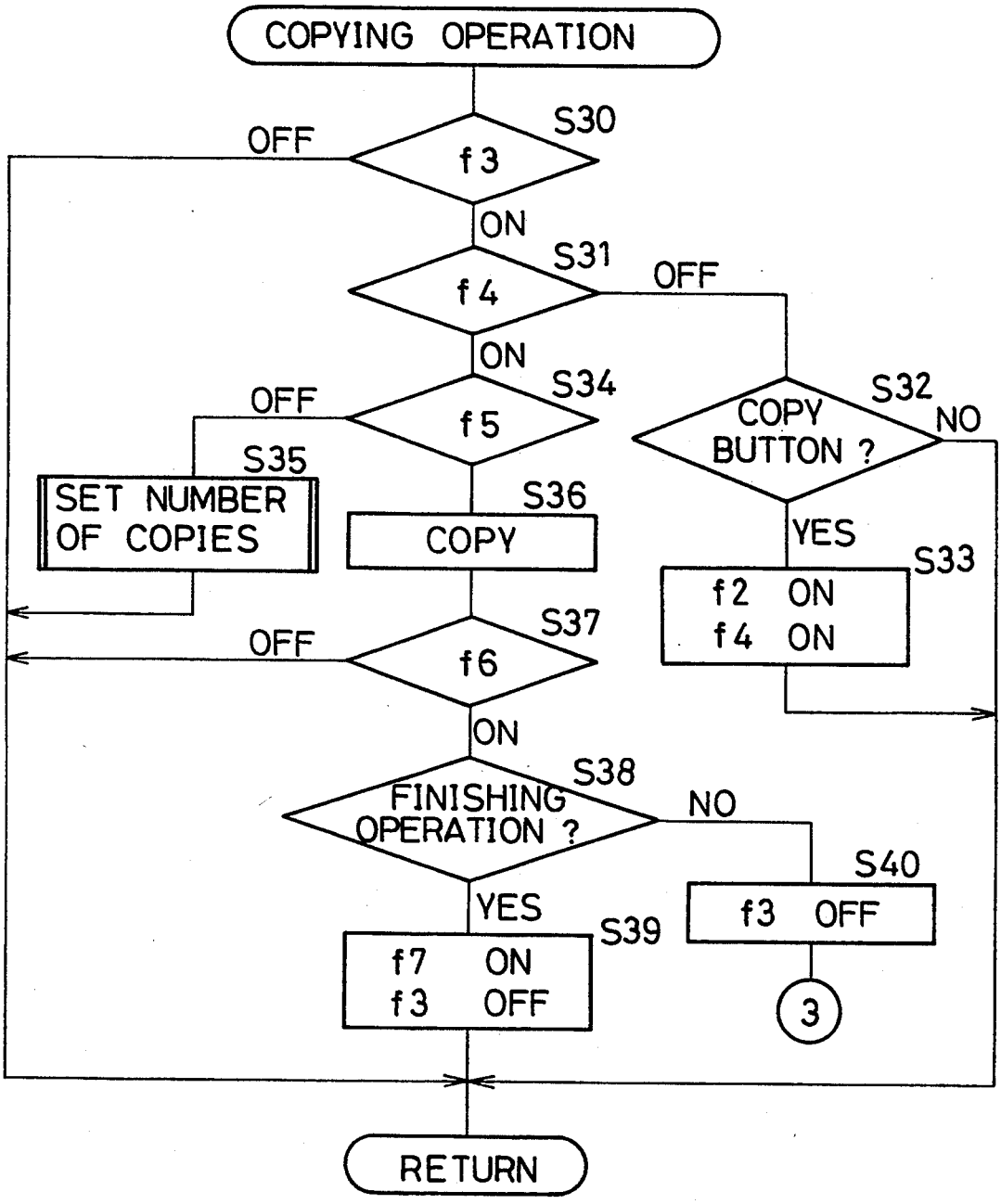
FIG. 31 and 32 are flow charts of a copying operation process control.

Next, the copying operation at step S4 will be described with reference to FIG. 31.

It is determined at step S30 whether a copying acceptance permission flag f3 is on or off. If the flag f3 is on, the copying operation can be accepted, and then the program proceeds from step S30 to step S31. Meanwhile, if it is off, a copying operation cannot be performed and the program skips through this process routine. Then, It is determined at step S31 whether a flag f4 indicating that a copying operation is in process is on or off. If the flag f4 is on, the copying operation proceeds. If the flag f4 is off, the program proceeds to step S32. It is determined at step S32 whether the "copy" button is pressed or not. If it has not been pressed, the program returns to the main routine. Meanwhile, if the copy button has been pressed to start the copying operation, the program proceeds to step S33. The flags f2 and f4 go on at step S33 and then the program returns to the main routine.

If the flag f4 is on, the program proceeds from step S31 to step S34. It is determined at step S34 whether a copy number set flag f5 is on or off. The copy number set flag f5 is set in accordance with the number of copies set by an operator and the number of bins 25. If the flag f5 is off, the program proceeds to step S35 to execute an operation for setting the number of copies, which will be described later. Meanwhile, if the flag f5 is on, the program proceeds to step S36. A normal copying operation is performed at step S36. More specifically, image information of the original is read, and corresponding sheet size is determined whereby a sheet accordingly is fed from a feed cassette; and then an image forming operation is performed on the sheet and the image-formed sheet is transported to the sorter.

Figure 32:
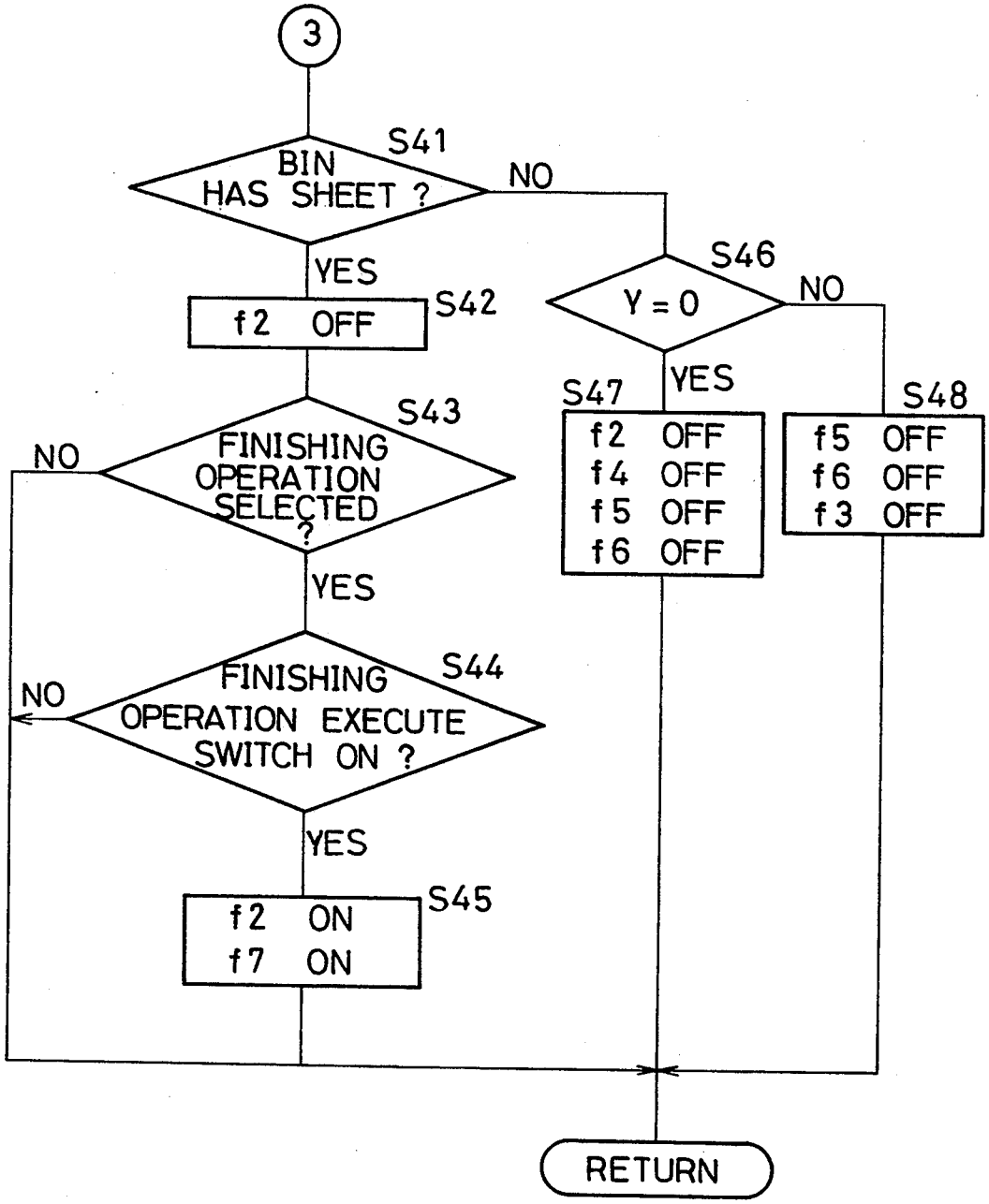

It is then determined at slop S37 whether a flag f6 for indicating that the copying operation is completed is on or off. If the copying operation including the sorting operation by the sorter 2 is completed, flag f6 goes off. If the preset number of copies is greater than the number of bins, flag f6 goes on when a number of operations corresponding to the number of bins is completed. If the operations are not completed, the program returns to the main routine and the copying operation or the like is repeated. If the flag f6 is on, the program proceeds to step S38. It is determined at step S38 whether the finishing operation mode has been selected or not. If it has been selected, a flag f7 indicating permission to proceed to the stapling operation goes on and flag 3 goes off, and then the program returns to the main routine. The flag f7 is on when the program proceeds to the stapling operation. Meanwhile, if the finishing operation has not been selected, the program proceeds to step S40. Flag f3 goes off at step S40 and then the program proceeds to step S41 of FIG. 32.

It is determined at step S41 whether there are any stacks of sheets in the bins 25 or not. If there are any, the program proceeds to step S42, wherein flag f2 goes off, and then the program proceeds to step S43. It is determined at step S43 whether or not the key for selecting the finishing operation is pressed either during the copying operation, or after the copying and the sorting operations are completed. The key is provided on the operation panel 250*a* of the copying machine body 1. Thus, even if the finishing operation is not selected before the copying operation, it can be selected later. If the finishing operation is selected before the copying operation, the program proceeds from step S43 to step S44. It is determined at step S44 whether a switch K4 for executing the finishing operation on the operation panel 253 of the sorter 2 is pressed or not. Then, if the switch is on, the program proceeds to step S45. Flags f2 and f7 go on at step S45, and then the program returns to the main routine.

Meanwhile, if there is no stack of sheets in the bins 25, the program proceeds from step S41 to step S46. It is determined at step S41 whether a variable Y indicating the number of copies outstanding is "0" or not. The number of copies Y outstanding is a value obtained by subtracting the number of bins from the preset number of copies (B) set by the operator. If the preset number is smaller than the number of bins, the variation is set "0". If the number of copies Y outstanding is "0", the program proceeds to step S47. Flags f2, f4, f5 and f6 go off at step S47 and the program returns to the main routine. Meanwhile, if the number of copies Y outstanding is not "0", the program proceeds from step S46 to step S48. Flags f5 and f6 go off and flag f3 goes on at step S48, and then the program returns to the main routine.

Next, the operation at step S35 for setting the number of copies will be described.

Figure 33:
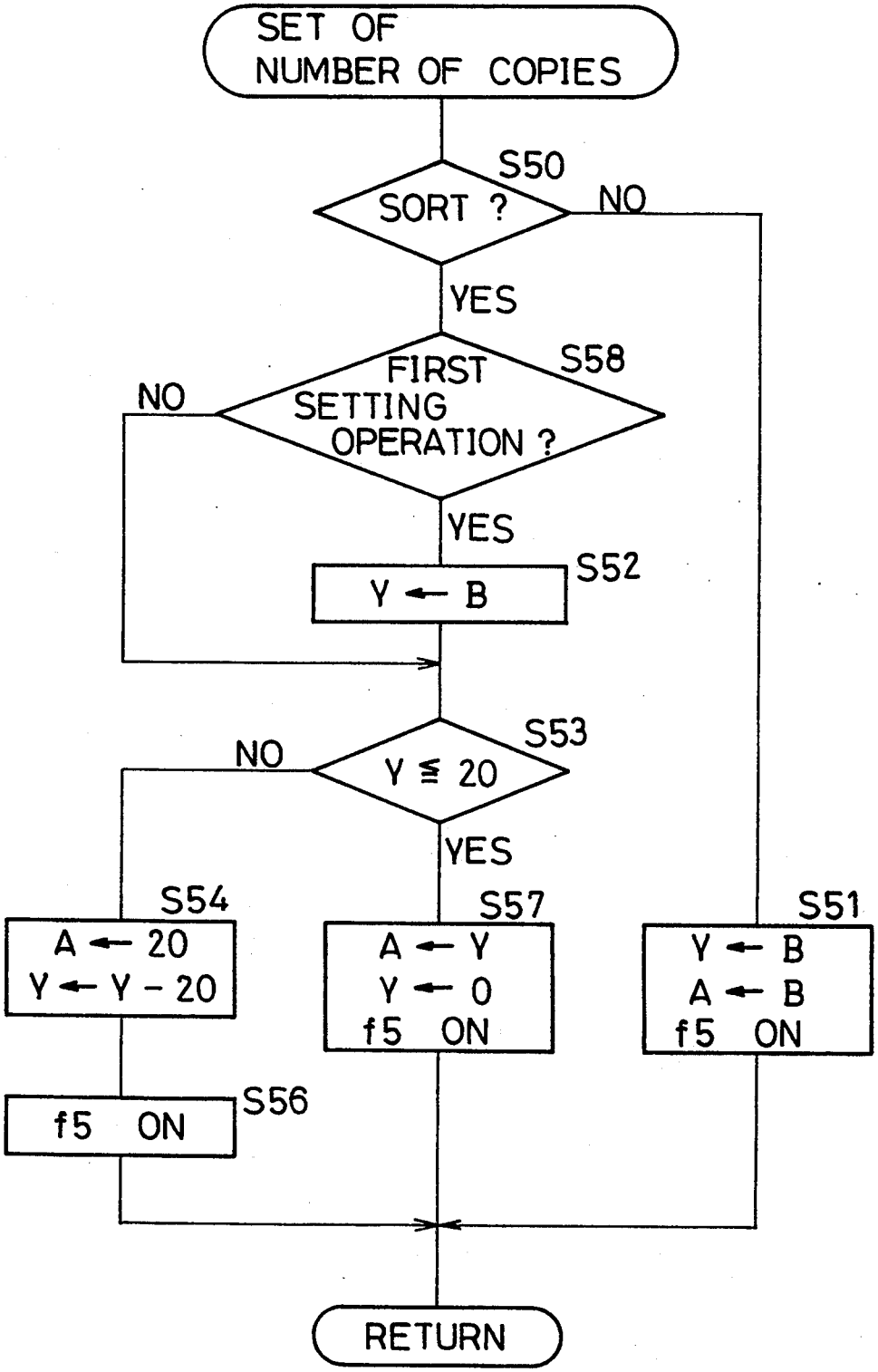
FIG. 33 is a process control flow chart of an operation for setting copy number.

Referring to FIG. 33, in the copy number setting operation it is determined at step S50 whether the sorting mode is selected or not. If the sorting mode is not selected, the program proceeds to step S51. At step S51, the preset number of copies B is set as the outstanding number of copies Y and the preset number of copies B is set as a number A of copies to be processed; then flag f5 goes oil at step S51, and the program returns to the main routine.

Meanwhile, if the sorting mode has been selected, the program proceeds from step S50 to step S58. It is determined at step S58 whether the operation for setting the number of copies is performed for the first time or not. If it is the first operation, the program proceeds to step S52. At step S52, the preset number of copies B is set as the outstanding number of copies Y, and then the program proceeds to step S53. Meanwhile, if the operation has been performed twice or more, the program skips step S52 and proceeds to step S53. It is determined at step S53 whether the outstanding number of copies Y is less than the number of bins ("20" in this case) or not. If the number Y exceeds the number of bins. The program proceeds to step S54. At step S54, the number of copies to be processed A is set at "20" and the outstanding number of copies Y is set at "Y−20", then the program proceeds to step S56. Flag f5 goes on at step S56 and the program returns to the main routine.

Meanwhile, if the number of copies Y outstanding is less than the number of bins, the program proceeds from step S53 to step S57. At step S57, the number of copies to be processed A is set as Y, Y is in turn set to "0" and flag f5 goes on. Then the program returns to the main routine.

As described above, when the preset number of copies is set at "30" for example, the number of copies to be processed A is divided into "20" and "10". When it is "50" for example, the number A is divided into "20", "20" and "10".

Finishing Operation of the Copying Machine Body

Figure 34:
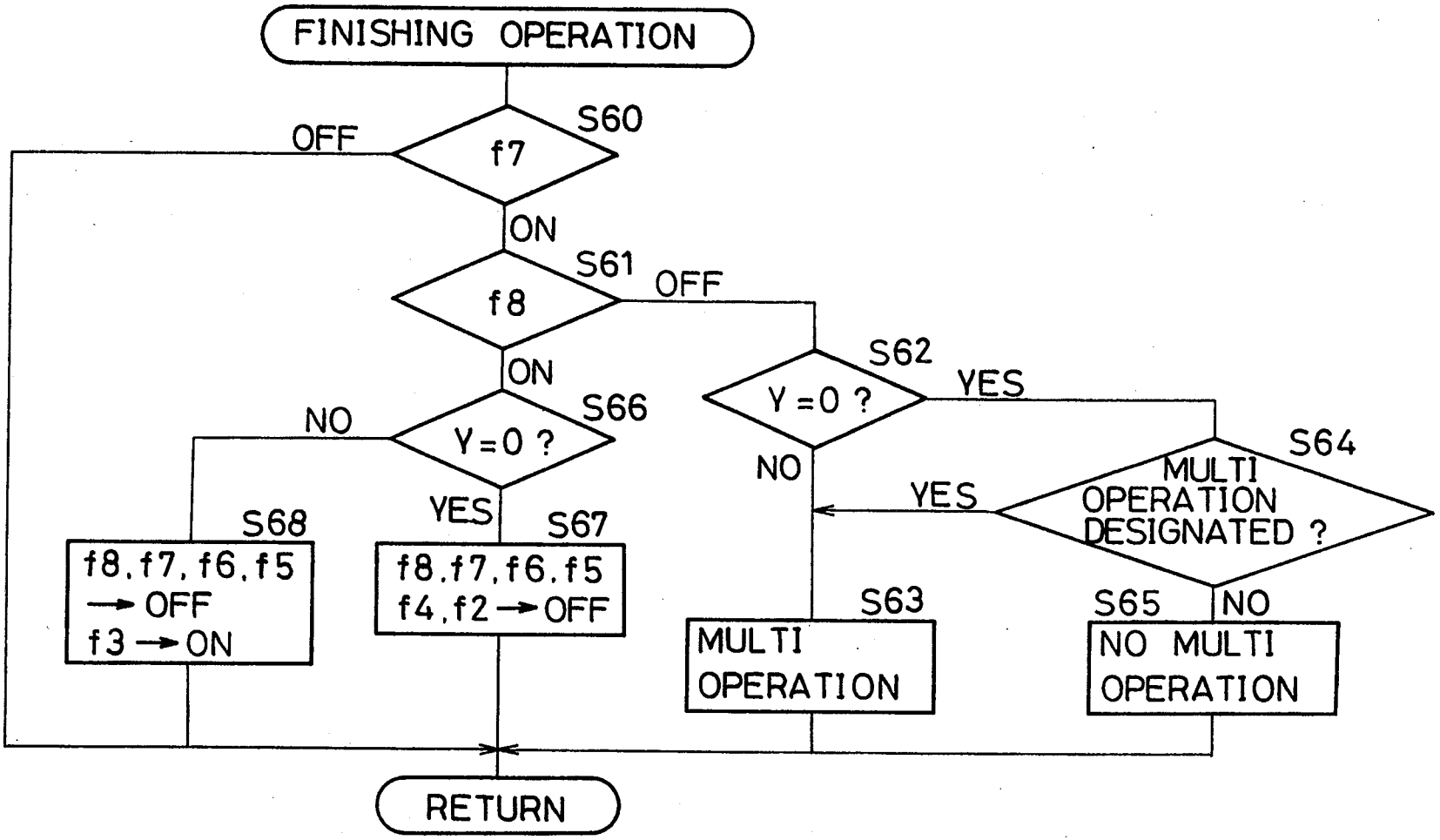
FIG. 34 is a process control flow chart of a finishing operation.

The finishing operation control of the copying apparatus will be described in reference to the flow chart of FIG. 34.

In this finishing operation, first it is determined at step S60 whether a flag f7 indicating permission to proceed to the finishing operation is on or off. If it is off, the program returns to the main routine. Meanwhile, if the flag f7 is on, the program proceeds to step S61. It is determined at step S61 whether a flag 8 indicating completion of the finishing operation is on or off. Flag f8 goes on when the operation with regard to the number of copies to be processed A shown in FIG. 33 is completed. When only the sorting operation, for example, is completed, the program proceeds frown step S61 to step S62. It is determined at step S62 wile ther the outstanding number of copies Y is "0" or not. When It is not "0", the program proceeds to step S63, wherein the multi-operation is set, and then the program returns to the main routine. Meanwhile, If the number Y is smaller than the number of bins, since Y is "0" at step S57 of FIG. 33, the program proceeds to step S64. It is determined at step S64 whether the multi-operation has been designated or not. If the multi-operation has been designated, the program proceeds to step S63. Meanwhile, If the multi-operation has not been designated, the program proceeds to step S65, wherein "no multi-operation" is set, and then the program returns to the main routine.

Figure 39:
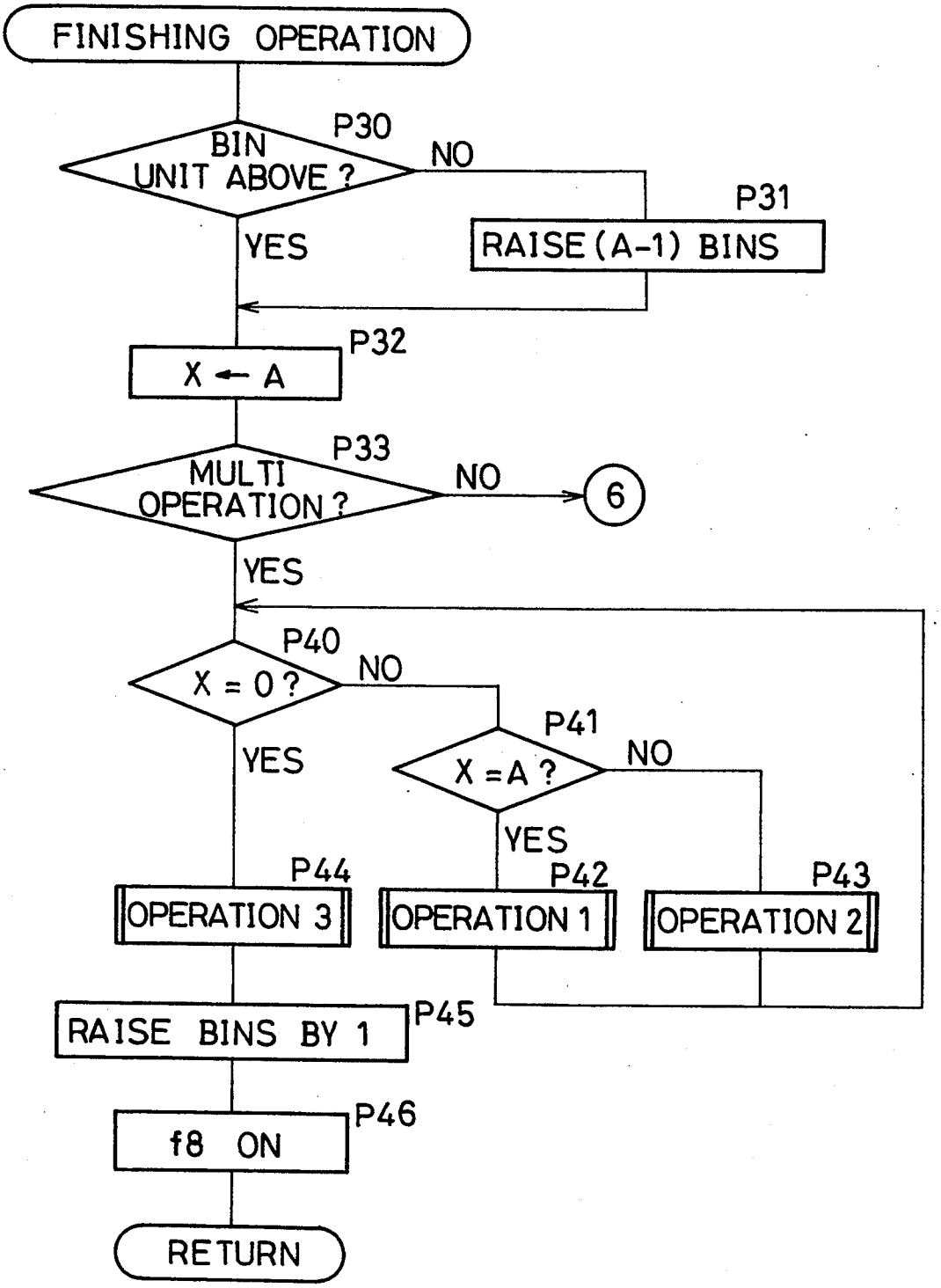
FIGS. 39 and 40 are process control flow charts of the finishing operation.
Figure 40:
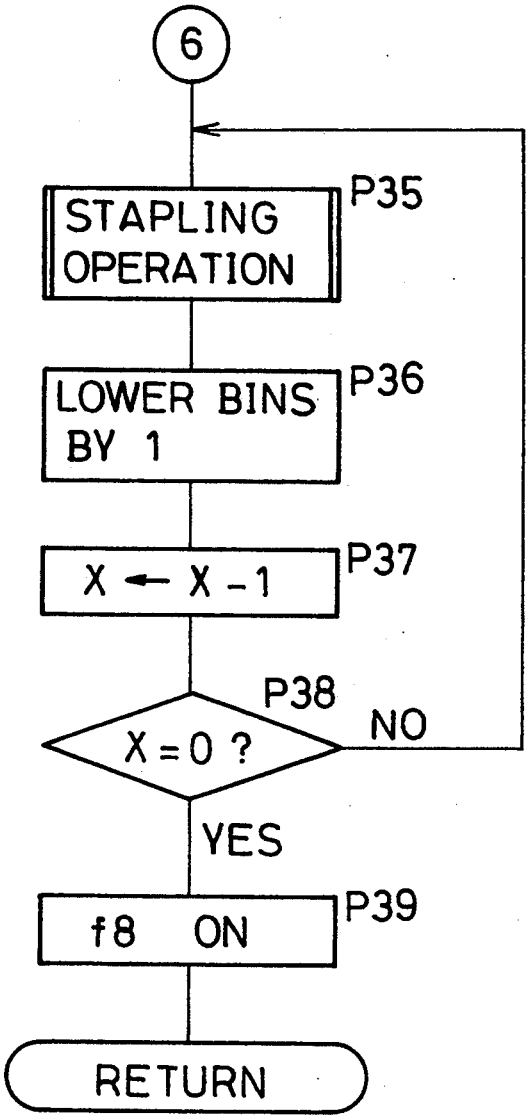

Upon completion of the operation with regard to the number of copies to be processed A, flag f8 goes on as shown at step P46 in FIG. 39, and the program proceeds from step S61 to step S66. It is determined at step 66 whether the outstanding number of copies Y is "0" or not. If it is "0", the program proceeds to step S67, wherein flags f8, f7, f6, f5, f4 and f2 go off, and then the program returns to the main routine. If it is not "0", the program proceeds to step S68, wherein flags f8, f7, f6 and f5 go off and flag f3 goes on, and then the program returns to the main routine.

Control of the Sorter

Figure 35:
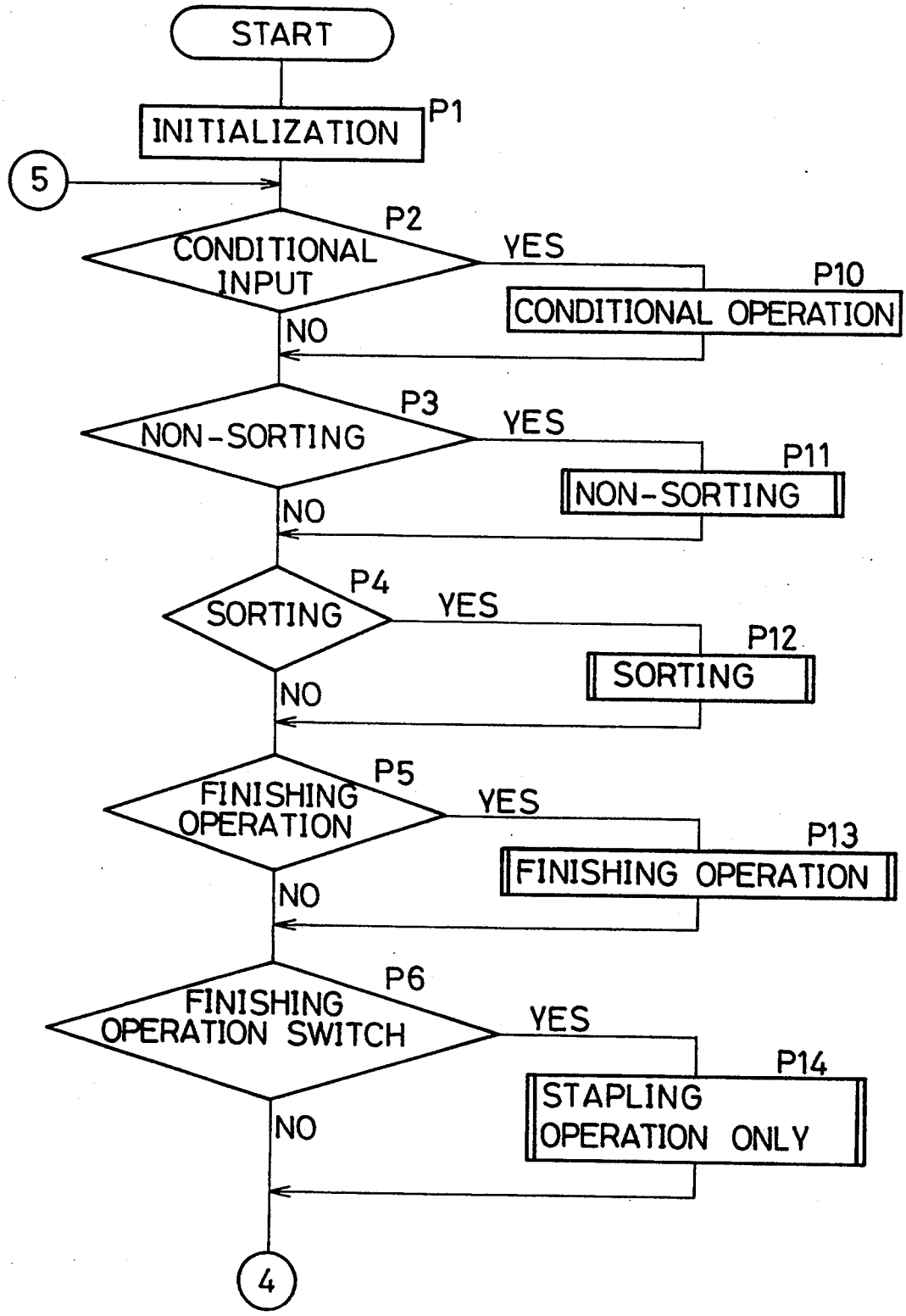
FIGS. 35 and 36 are flow charts of the sorter main process control.
Figure 36:
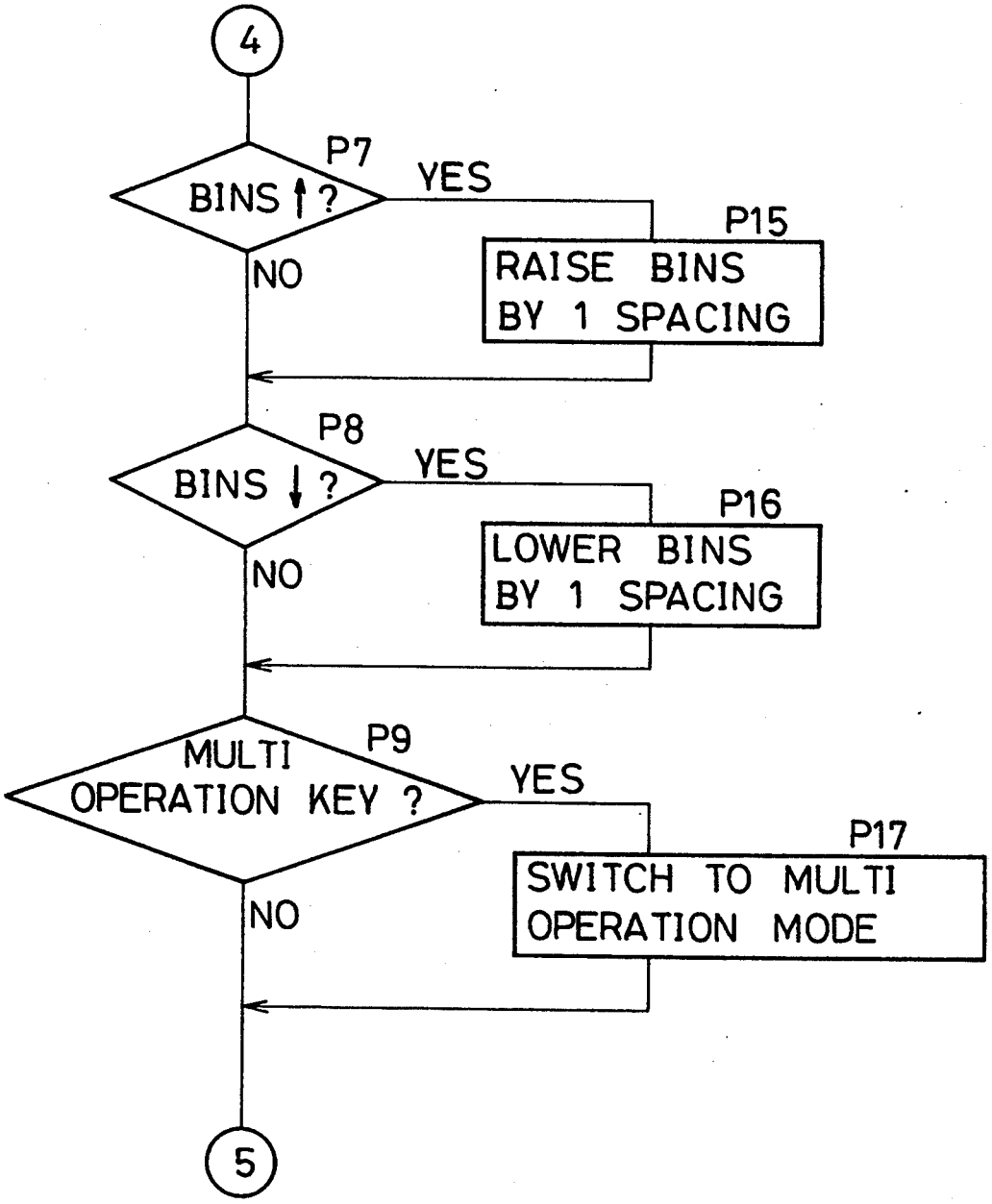

Process control executed by the sorter control unit 252 follows the program out lined in the flow chart of FIG. 35.

An initialization procedure is carried out at step P1, wherein, for example, each unit is returned to its initial position or the solenoid 52 is turned off. It is then determined at step P2 whether a conditional input, such as the operation mode or flag data, is received from the copying apparatus main control unit 250. It is also determined at P3 whether a conditional input from the copying apparatus main control unit 250 is non-sorting mode data, at step P4 whether it is sorting mode data, and at step P5 whether or not it is finishing operation mode data. It is determined whether the key K4 on the sorter 2 operation panel 253, for executing the processing operation, is pressed or not at step P6; whether the key K1 for raising the bin unit 27 is pressed or not at step P7; whether the key K2 for lowering the bin unit is pressed or not at step P8; whether the key K3 for the multi-operation is pressed or not at step P9.

When there is a change in operational conditions such as the operation mode or flag data, and when the conditional input is transmitted from the copying apparatus main control unit 250, the program proceeds from step P2 to step P10, wherein the operation mode corresponding to the operational status is set. If the non-sorting mode is set at step P10, the program proceeds from step P3 to step P11. At step P11, the claw 161 is switched to transfer sheets discharged from the copying machine body 1 to the transport path 28*c* for the non-sorting operation discharging the sheet into the bin 162.

If the sorting mode is set, the program proceeds from step P4 to step P12, wherein the sorting operation is performed. If the finishing operation mode is set, the program proceeds from step P5 to step P13, wherein the finishing operation is performed. If the finishing operation execute key K4 on the operation panel 253 of the sorter 2 is pressed, the program proceeds from step P6 to step P14. The stapling operation is performed at step P14. Therein, the operator supplies the stack of sheets by hand and then the stack of sheets is stapled. If the key K1 for raising the bin unit 27 is pressed, the program proceeds from step P7 to step P15, at which the bin unit 27 is raised by a distance corresponding to a adjacent bin spacing. If the key K2 for lowering the bin unit 27 is pressed, the program proceeds from step P8 to step P16 to lower the bin unit 27 by a distance corresponding to the spacing between adjacent bins. If the key K3 for the multi-operation is pressed, the program proceeds from step P9 to step P17. At step P17, the multi-operation mode is inverted. That is, when the multi-operation mode is set, when the key K3 for the multi-operation is pressed, the multi-operation mode is canceled. Alternatively, when the multi-operation mode is not set, when the key K3 is pressed, the multi-operation mode is set. In accordance with the mode set as in the foregoing, the mode selecting operations at step S12 and steps S17 to S21 as described earlier are performed.

Sorting Operation

Figure 37:
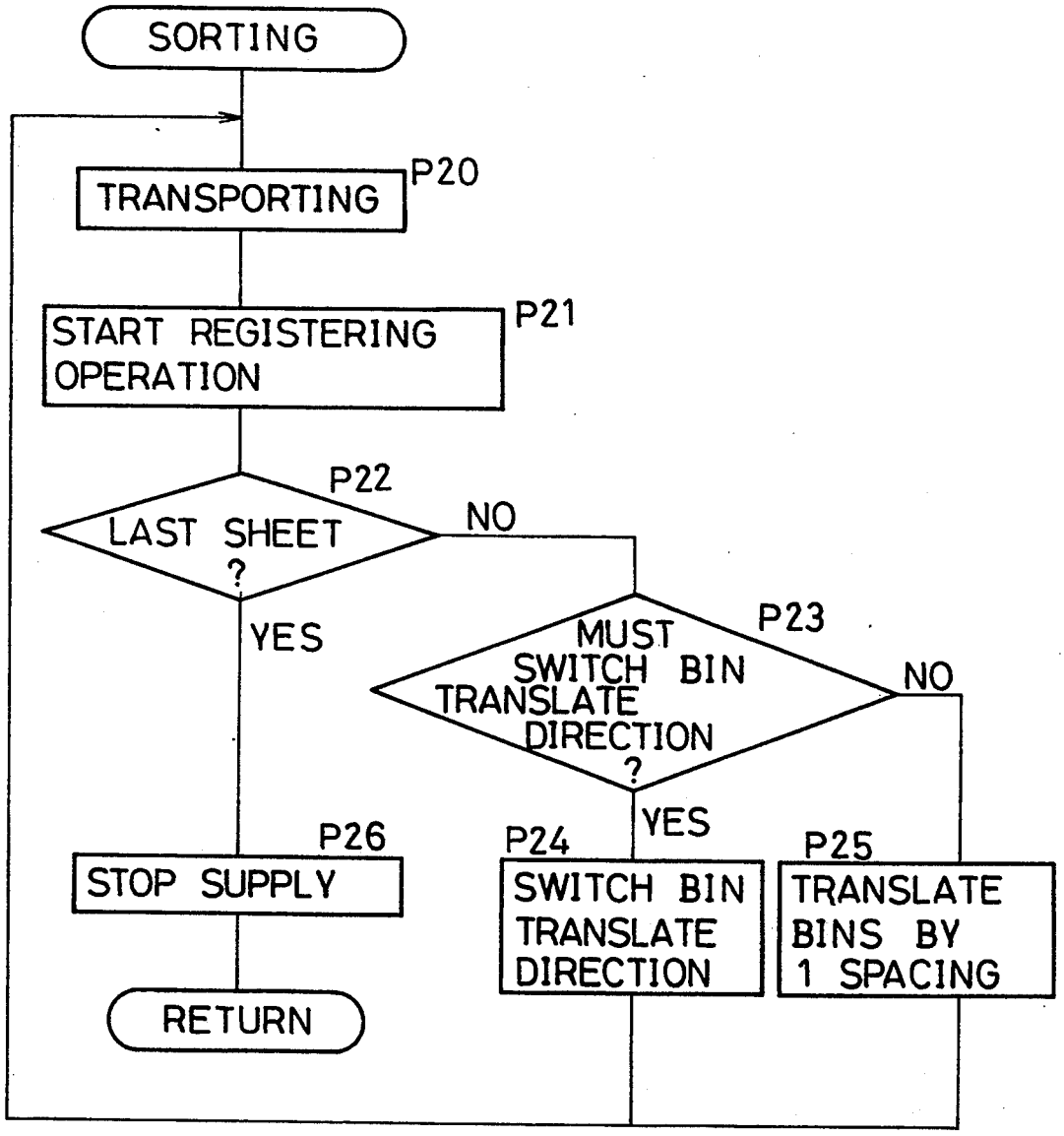
FIG. 37 is a process control flow chart of a sorting operation.

If the sorting mode is selected, the sorting program outlined in FIG. 37 is executed. In this case, a transporting operation for sorting is performed at step P20. More specifically, the claw 161 is switched to guide each sheet from the copying machine body i to the transport path 28*b* meanwhile the motor 39 is driven to sequentially translate each bin 25 of the bin unit 27 vertically so as to supply the sheet to the bin 25 positioned at the process opening.

At step P21, the contact plate 136 is moved frontward to register the sheet in the width direction. It is then determined at step P22 whether the sheet introduced into the sorter 2 is the last sheet or not. If not, the program proceeds to step P23. It is determined at step P23 whether or not it is necessary to switch the bin translate direction. If all of the bins are positioned either higher or lower than the process opening, the translate direction has to be switched. In this case, the program proceeds from step 23 to step P24, wherein the translated direction of the bin unit 27 is switched. Alternatively, if it is not necessary to switch the direction, the program proceeds from step P23 to step P25, wherein the bins are translated by a distance corresponding to the adjacent bin spacing in the same direction. Thus, the sheets are sorted into each bin 25 until the last sheet, and then the program proceeds from step P22 to step P26. The drive to the supply unit 28*a* of the sorter 2 is stopped at step P26.

Figure 38:
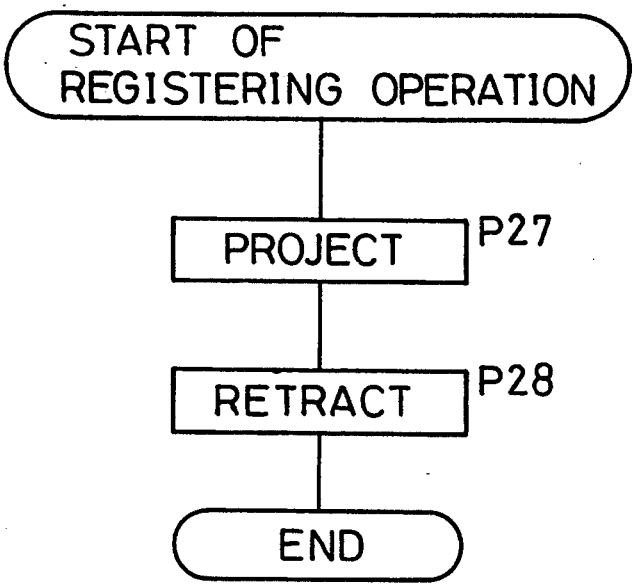
FIG. 38 is a process control flow chart of an operation for widthwise registration of sheets.

When the operation for widthwise registration of the sheets is begun at step P21, a registering operation performed according to the routine of FIG. 38. In this operation, the motor 142 is driven at step I27 to rotate the pinion 150 through the pulleys 152 and 150*a* and the timing belt 151, and the contact plate 136 is extended through the driven movement of the rack 149. After the contact plate 136 is extended a predetermined distance, it is withdrawn through a procedure reverse to that at step P28 as described. The distance that the contact plate 136 is extended is controlled according to the sheet size. The sheets in the bins 25 thus are properly registered along the front side of the apparatus by the register operation.

Finishing Operation

When the finishing operation mode is selected, operations are executed according to the routines outlined in FIGS. 39 to 44.

First, it is determined at step P30 whether the bin unit 27 is positioned above the process opening or not. If the bin unit 27 is not positioned above the process opening when the sorting operation is completed, the program proceeds to step P31, wherein (A-1) bins 25 are raised (A: the number of copies to be finish-processed; i.g., when the number of bins is 20, 19 bins are raised). Otherwise, If the bin unit 27 is positioned above the process opening, the program proceeds from step P30 to step P32. The number or copies to be processed A (referring to FIG. 33) is set at step P32 as a variable X indicating which bin is to provide sheets for processing. Then, it is determined at step whether the multi-operation has been designated or not. If it has not been designated, the program proceeds to step P35.

The stapling operation, described later, is performed at step P35. The bins 25 are lowered at step P36 by the distance corresponding to the spacing between the adjacent bins, and then "1" is subtracted from the variable X at step P37. The program then proceeds to step P38. It is determined at step P38 whether the variable X is "0" or not. If is it not "0", the program proceeds to step P35 and the operations at step, P35 to P38 are repeated. When all stacks of sheets in the bins 25 are stapled, it is determined at step P38 that the variable X is "0". Subsequently, flag f8 goes on at step P39, and the program returns to the main routine.

Wherein it is determined at step P33 that the multioperation has been designated, the program proceeds to step P40. It is determined at step P40 whether the variable X is "0" or not. Therein, until the last bin is positioned at the process opening the determination at step P40 is that the variable X is not "0", such that the program proceeds to step P41, wherein it is determined whether the variable X is A or not. More specifically, the step P41 determination is whether the bin for finish-procesing is the first bin or not. If it is the first bin, the program proceeds to step P42, wherein an operation 1 to be described later is performed. If the bin is not the first bin, the program proceeds from step P41 to step P43, wherein an operation 2, also described later, is performed. It is determined YES at step P40 when the bin for finish-procesing is the last bin, and then the program proceeds to step P44, wherein an later-described operation 3 is performed. The bins are raised by the distance corresponding to the spacing between the adjacent bins at step P45 and flag f8 goes on at step P46, and then the program returns to the main routine. The operation at step P45 is performed to receive the sheets from the copying machine body 1 at the process; opening.

In the finishing operation, for example, if the preset number of copies B is 25 and the number of bins is 20, the number of copies to be processed is set at "20" as the variable X. After the finishing operation on the 20 stacks of sheets is completed, the status is changed to "A=5" If the multi-operation is designated, the remaining number of copies "5" is set as the variable X and then the same finishing operation is performed.

Figure 41:
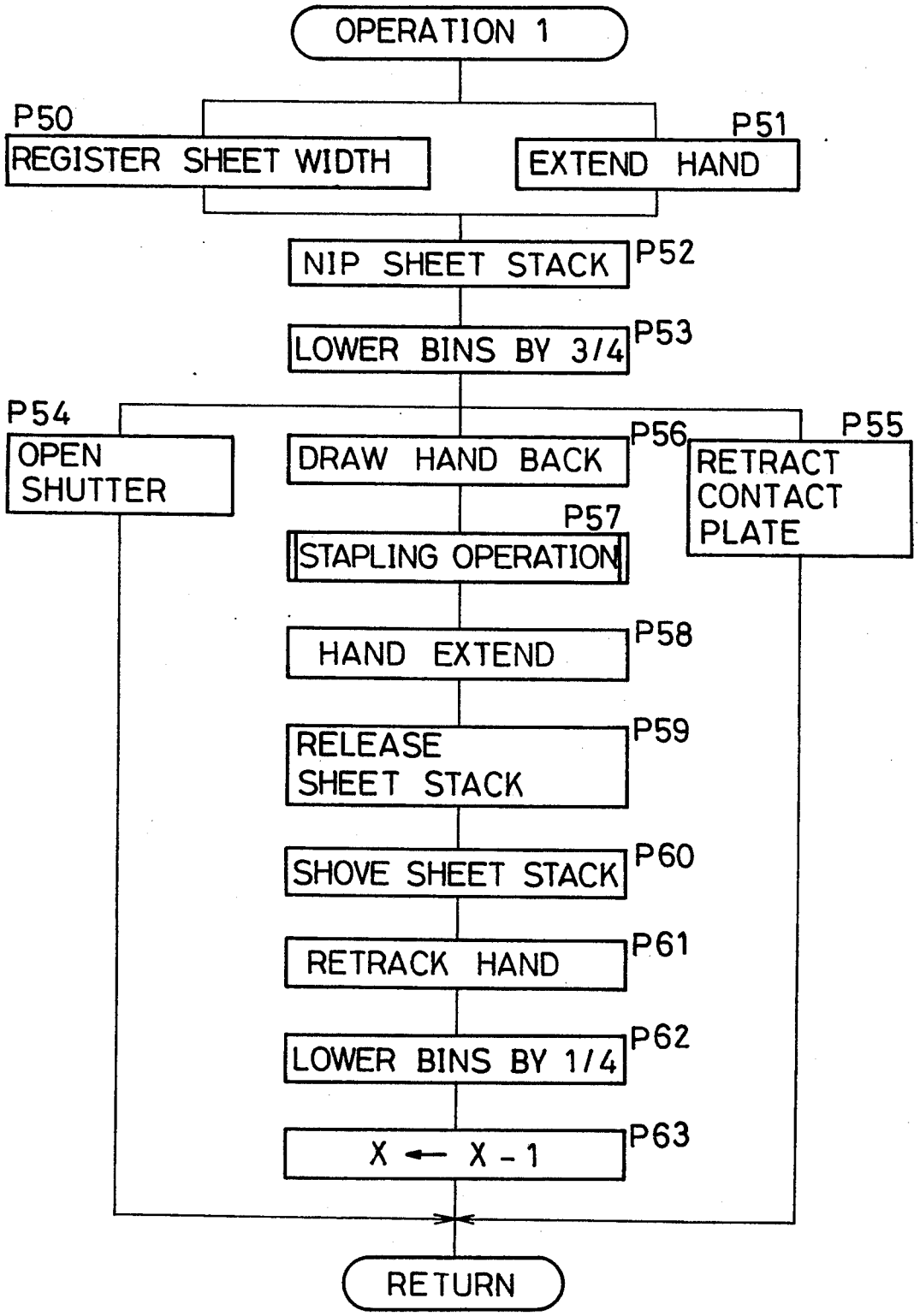

Operation I will be described in reference to FIG. 41.

In this operation, the registering operation at step 50 and the hand extending operation at step P51 are performed in parallel. The registering operation at step P50 is the same as the operation at step P21 and step P27. In the hand projecting operation at step P51, the solenoid 52 is activated to move the stops 51 into the position allowing the stack of sheets to drop. The motor 100 is then activated to drive the timing belt 103 and consequently the slider plate 84 is extended toward the bin 25. Next, the end of the band mechanism(s) 81 are moved into the notches 25*c* of the bin 25. Since the sheet size will have been detected during the copying operation as aforedescribed. Either one or both band units 60*a* and 60*b* is selected and used accordingly.

The solenoid 87 of either hand mechanism 81 is then activated and the end of the stack of sheets is nipped by the hands 85 and 86 at step P52. Then, the bins 25 are lowered by ¾ the spacing between the adjacent bins by accordingly controlling the rotation of the spiral cam 33. When the bins 25 are lowered by ¾, the end of the stack of sheets nipped by the hands 85 and 86 is retained over the standing wall 25*d* of the bin 25.

Operations at step P54, step P55 and steps P56 to step P63 are subsequently performed in parallel. At step P54, the motor 127 is driven to lift the shutter member 121 through the rack 128. The contact plate 136 is retracted at step P55. Then, at step P56, the motor 100 is rotated in the direction opposite to its previous rotation and the hand mechanism 81 is thereby returned to its home position. Thus, the stack of sheets is drawn from the bin 25 into the stapling position. At step P57, the later-described stapling operation is performed. When the stapling operation is completed, the program proceeds to P58, wherein the hand mechanism 81 is extended. At step P59 the stapled stack of sheets is moved back above the bin 25, then the solenoid 87 is deactivated to open the hands 85 and 86 and thereby release the stack or sheets. Next, at step P60, the solenoid 91 is activated to extend the arm 90. Thus, the trailing edge of the stack of sheets is shoved and separates clear from the hands 85 and 86, storing into the bin 25. The hand mechanism 81 is then returned its home position at step P61, and at step P62 the bins 25 are lowered by ¼ the spacing between the adjacent bins and the bin 25 storing the stapled stack of sheets is moved into the discharge position opposite the outlet 111*a*. Then, "1" is subtracted from the variable X at step P63, whereupon the program returns to step P33 of FIG. 39.

When the bin for finish-processing is not the first bin, the program proceeds, through step P40 and step P41, to step P43 as shown in FIG. 39, wherein operation 2 outlined in FIG. 42 is executed. In this operation 2, the operation for widthwise registration of sheet stacks at step P70, the operations executing the stapling operation at step P71 and following, and the operations for discharging the stack of sheets toward the front side of the apparatus at step P72 and following are performed in parallel. The operations at step P71 and step P73 are the same as those at step P51 and step P52, respectively.

It is determined at step P74 whether the stack of sheets is drawn frontward 30 mm by the stacker hand mechanism 170 through a process to be described later. When the stack has been drawn out, the program proceeds to step P75. The reason wily the stack of sheets are drawn 30 mm frontward at this time by the stacker hand mechanism 170 is that the stacker hand mechanism 170 would not be able to nip the stack of sheets were the bins to be lowered for the subsequent stapling operation in the above-adjacent bin prior to start of the discharging operation. The operations for retracting the contact plate at step P76 and the operations at steps P77 to P83 are the same as the operations at step P55 and at steps P56 to P61, respectively, in the aforementioned operation 1.

While the above stapling operation is performed, the below-adjacent stack of sheets is discharged toward the front side of the apparatus.

More specifically, the stacker hand mechanism 170 is extended backward (toward the bins 25) at step P72. At step P85, the solenoid 178 is activated, whereby the hands 176 and 177 nip the portion of the stack of sheets along the front side. Then, at step P86. The motor 196 of the shifter 190 is driven to draw the stacker hand mechanism 170 toward the front side of the apparatus through the timing belt 199, while the roller pairs 219/221 of the discharger mechanism 171 are rotated in synchronization with the shifting speed of the stacker hand mechanism 170. As the stacker hand mechanism 170 shifts, the stapled stack of sheets in the bins 25 is discharged into the discharger 3. Then, it is determined at step P87 whether the stacker hand mechanism 170 has reached the position for releasing the stack of sheets. At this position, the front side portion of the stack of sheets is nipped by the roller pairs of the discharger mechanism 171. When the stacker hand mechanism 170 reaches the position for releasing the stack of sheets, the program proceeds to step P88, wherein the stacker hand mechanism 170 drawing operation and the rotation of the roller pairs 219/221 are halted and the solenoid 178 is deactivated to release the stack of sheets. Then, at step P89, the stacker hand mechanism 170 further retracted frontward. Then, it is determined at step P90 whether or not the stacker hand mechanism 170 is fully retracted into the position wherein it does not interfere with the stack of sheets in discharge from the roller pairs 219/221. When the stacker hand mechanism 170 is retracted fully into the foregoing position, the program proceeds to step P91 and the roller pairs 219/221 are driven again. Thereupon, the stack of sheets is transported into the frontward side, and guided downward along the second guide plate 211, wherein it is stored into the reservoir 172.

Since the roller pairs 219/221 are halted in the course of the sheet stack drawing operation, whereupon the stacker hand mechanism 170 releases the stack of sheets, the stack of sheets is smoothly transferred from the stacker hand mechanism 170 into the discharger mechanism 171 without need of any special auxiliary device.

It is determined at step P92 whether the stack of sheets has passed through the discharger mechanism 171 and fallen into the reservoir 172. If the stack of sheets has passed through, the program proceeds to P93. It is determined at step P93 whether or not the bins 25 should be lowered by ¼. If the bins need not be lowered, the program proceeds to step P94, wherein the stacker hand mechanism 170 is extended toward the sorter 2 again and preparation for discharging the stacks of sheets in the next bin is made.

When the foregoing stapling and sheet discharging operations are completed, "1" is subtracted from the variable "X" at step P95.

Figure 43:
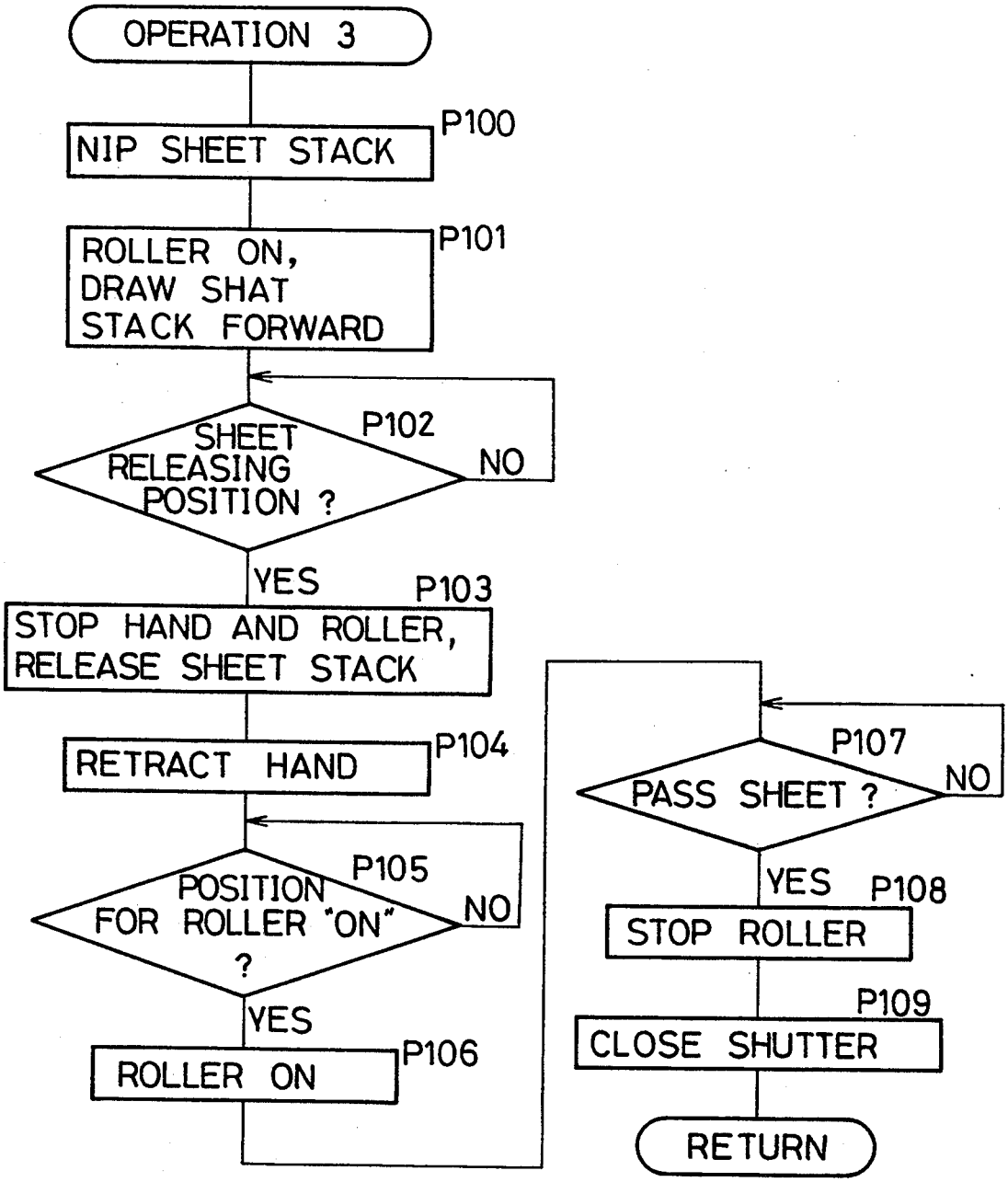

With regard to the last bin, the operation 3 outlined in FIG. 43 is performed.

In the operation 3, since the stacker hand mechanism 170 has been already extended toward the bins 25 in the operation 2, the program starts with step P100, wherein the stack of sheets is nipped. Operations at steps P100 to P107 are the same as operations at corresponding steps P85 to P92 in the aforementioned operation 2. Then, after step P107, the program proceeds to step P108, wherein the roller pairs 219/221 of the discharger mechanism 171 are halted. Then, at step P109, the shutter member 121 is lowered to close the outlet 111*a*. After the above operations are completed, the program returns to the main routine.

Figure 44:
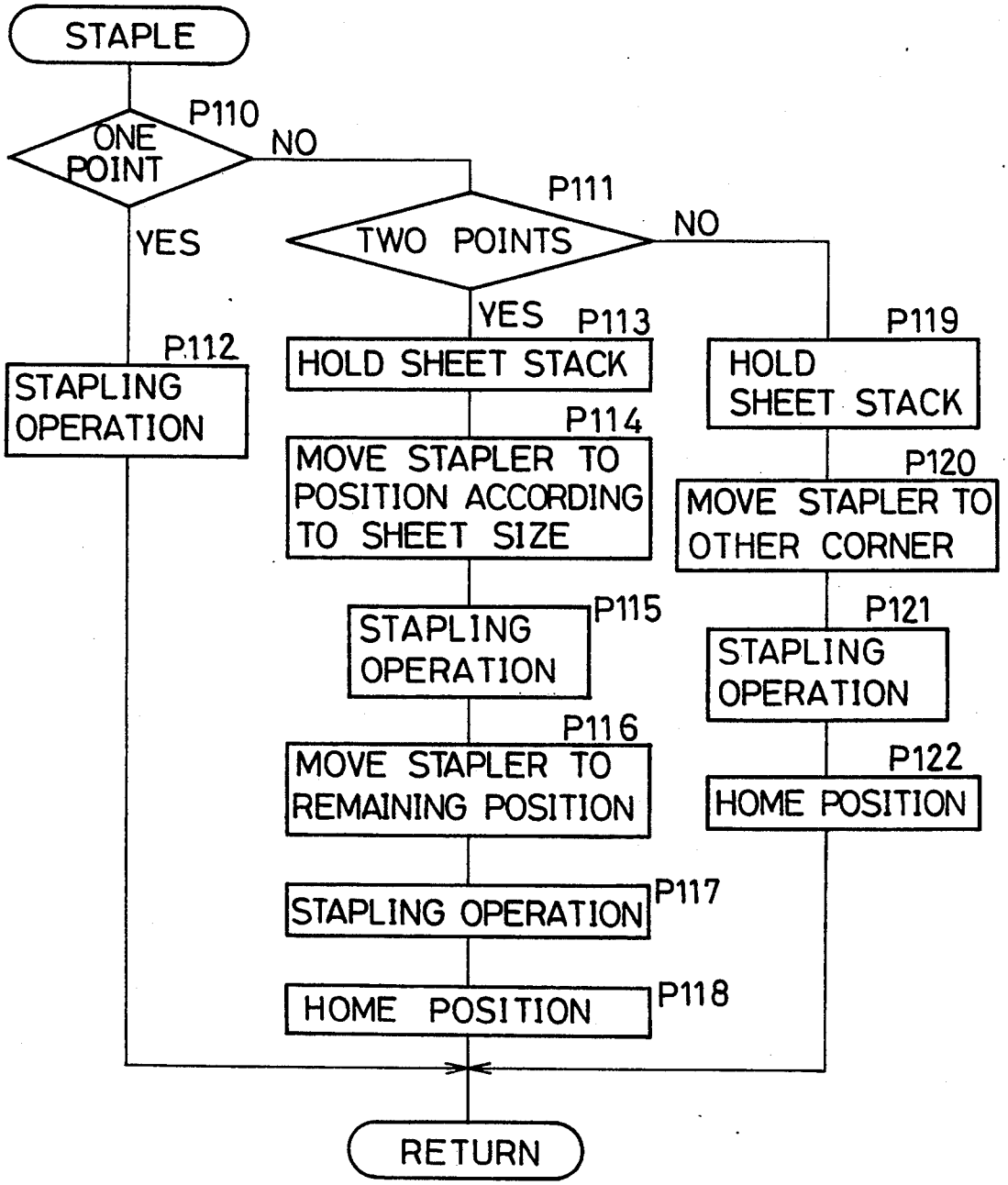
FIG. 44 is a flow chart of a stapling operation process control.

Next, the stapling operation will be described with reference to the flow chart diagramed in FIG. 44.

It is determined at step P110 whether or not the stapling operation is to be performed at the one point. If so, the frontward corner of the process-opening adjacent edge of the stack of sheets, i.e., the reference position thereof, is stapled by the stapler 58 in its home position. If not, it is determined at step P111 whether or not the stapling operation is to be performed at two points along the adjacent edge of the stack of sheets widthwise. When the stapling operation is performed at the point of the reference position, the program proceeds from step P110 to step P112. At step P112, the staple drive 72 of the stapler 58 is driven to ram the lower jaw 71 so as to execute the stapling operation. Meanwhile, if the stapling operation is to be performed at two points, the program proceeds from step P111 to step P113. At step P113. The adjacent corner along the frontward edge of the stack of sheets is held by the sheet clasping mechanism 110. Then, at step P114, the stapler 58 is moved to the nearer of the two stapling positions according to the sheet size, and then at step P115, the stapler 58 performs a stapling operation. The stapler 58 is then moved to the other stapling position at step P116, whereupon the stapling operation is performed at step P117. When the stapling operations are completed, the stapler 58 is moved back into its home position at step P118, whereupon the control of the stapling operation is completed.

Meanwhile, of the stapling operation is to be performed at the rearward corner along the adjacent edge of the stack of sheets opposite the reference position, NO is determined at steps 110 and 111, whereupon the program proceeds to step P119. At step P119, the front end portion of the stack of sheets is nipped by the sheet clasping mechanism 110 likewise as at step P113. Then, at step P120, the stapler 58 is shifted toward the rear of the apparatus to reach the rear corner of the sheet stack. The aforementioned stapling operation is then performed at step P121 and the stapler 58 is returned into its home position again. Control of the stapling operation is then completed.

Various details of the invention may be changed without departing from its spirit not its scope. Furthermore, the foregoing description of the embodiment according to the present invention is provided for the purpose of illustration only, and not for the purpose of limiting the invention as defined by the appended claims and their equivalents.

What is claimed is:

1. A sheet finish-processing unit for finish-processing sheets discharged from an image forming apparatus, comprising:

sheet storing means capable of storing sheets discharged from an image forming apparatus in stacks, said sheet storing means including a plurality of vertically translatable bins, and bin movement control means for vertically indexing said plurality of bins, wherein each bin is brought sequentially into a processing position;

sheet stack finish-processing means, mounted laterally of an image forming apparatus-directed end of said sheet storing means so as to be shiftable along an adjacent margin of stored stacks of sheets in a direction transverse to a direction of sheet discharge from said image forming apparatus, for performing an operation which finishes a stack of sheets;

finish-processing means drive means for shifting said sheet stack finish-processing means in the transverse direction; and sheet stack handling means for drawing a stack of sheets stored in said sheet storing means at said processing position into a finishing locale of the sheet stack finish-processing means, and for returning a drawn stack of sheets to said sheet storing means subsequent to a finishing operation being executed by said sheet stack finish processing means;

sheet stack discharge means disposed on an image forming apparatus user-directed front side of said sheet storing means, for withdrawing a stack of sheets frontward from said bins at said processing position and discharging a stack of sheets therefrom in a discharge operation, said sheet stack discharge means including nipping means, shiftable between a nipping position, at which said nipping means nips a stack of sheets stored in one of said bins, and a drawn position in a front portion of said sheet stack discharge means, said nipping means being positioned for drawing a stack of sheets stored in said bin toward said drawn position, nipping means drive means for shifting said nipping means, and a discharge roller unit for seizing a stack of sheets drawn toward said drawn position by said nipping means and subsequently discharging that stack of sheets into a reservoir; and said reservoir for storing stacks of sheets discharged from said bins by said sheet stack discharge means.

2. A sheet finish-processing unit according to claim 1, further including:

operation selection means for selecting execution of a finishing operation by said sheet stack finish-processing means, and execution of a discharge operation by said sheet stack discharge means; and operation control means for controlling operations executed by said sheet stack finish-processing means and said sheet stack discharge means.

3. A sheet finish-processing unit according to claim 2, wherein said operation control means controls said finishing operation and said discharge operation to execute in parallel when both operations are concurrently selected.

4. A sheet finish-processing unit according to claim 3, wherein said operation control means prohibits execution of said discharge operation when only said discharge operation has been selected through said operation selection means.

5. A sheet finish-processing unit according to claim 4, further including an image forming apparatus having means for setting a number of copies to be made by said image forming apparatus; and wherein exclusively when execution of said finishing operation has been selected through said operation selection means and a number of copies to be made by said image forming apparatus set through said setting means is greater than a number of said plurality of bins, said operation control means directs forcible discharge of finish-processed stacks of sheets from said plurality of bins upon detecting that each of said bins stores a stack of sheets.

6. A sheet finish-processing unit for finish-processing sheets discharged from an image forming apparatus, comprising:

sheet storing means capable of storing sheets discharged from an image forming apparatus in stacks, said sheet storing means including a plurality of vertically translatable bins, an end of each of said plurality of bins adjacent said image forming apparatus-directed end of said sheet storing means having a standing wall so angled as to register common ends of a discharged set of stored sheets into a stack; and bin movement control means for vertically indexing said plurality of bins, wherein each bin is brought sequentially into a processing position;

sheet stack finish-processing means, mounted laterally of an image forming apparatus-directed end of said sheet storing means so as to be shiftable along an adjacent margin of stored stacks of sheets in a direction transverse to a direction of the sheet discharge from said image forming apparatus, for performing an operation which finishes said stack of sheets;

finish-processing means drive means for shifting said sheet stack finish-processing means in the transverse direction; and sheet stack handling means for drawing a stack of sheets stored in said sheet storing means at said processing position into a finishing locale of the sheet stack finish-processing means, and for returning said stack of sheets to said sheet storing means subsequent to a finishing operation being executed by said sheet stack finish processing means upon said stack of sheets, said bin movement control means being arranged such that said indexing of said plurality of bins by said bin movement control means differentiates spacing between said plurality of bins such that a bin translated into said processing position is vertically spaced further apart from upper and lower immediately adjacent bins than remaining bins of said plurality are spaced apart from one another, to thereby provide said sheet stack handling means unimpeded access to a bin in said processing position, and said bin movement control means successively translates each bin such that as said sheet stack handling means draws a stack of sheets from a bin at said processing position, an upper edge of said standing wall of that bin at said processing position is translated below said sheet stack handling means, while an immediately adjacent upper bin remains positioned above said sheet stack handling means.

7. A sheet finish-processing unit according to claim 6, further including sheet stack hold means for holding a portion of a stack of sheets drawn into said finishing locale by said sheet stack handling means, wherein shifting of said sheet stack finish-processing means is not impeded.

8. A sheet finish-processing unit according to claim 7, wherein said sheet stack handling means includes a plurality of stack nipping apparatus arranged at predetermined intervals in the transverse direction.

9. A sheet finish-processing unit according to claim 8, further including:

sheet size detecting means for determining a size of a sheet discharged into the unit; and means for selecting one or more of said stack nipping apparatus to be operational from said plurality thereof according to a size determination made by said size detecting means.

10. A sheet finish-processing unit according to claim 9, wherein said stack nipping apparatus are shiftable between said processing position of said plurality of bins, said stack nipping apparatus therein nipping an adjacent margin of a stack of sheets, and said finishing locale of said sheet stack finish-processing means, said stack nipping apparatus therein retaining a stack of sheets during said finishing operation as executed by said sheet stack finish-processing means; and said sheet stack handling means further includes:

stack shover means, wherein when a stack of sheets has been shifted by said sheet nipping apparatus toward one of said plurality of bins in said processing position, said stack shover means shoves that stack of sheets on an adjacent marginal end thereof, thereby clearing that stack of sheets from said sheet nipping apparatus and returning that stack of sheets fully into said one of said plurality of bins in said processing position.

11. A sheet finish-processing unit according to claim 10, wherein said bin movement control means is vertically disposed and includes spiral cams, each of said cams being threaded in a cylindrically peripheral spiral groove such that each of two pitches of a portion of each cam adjacent said sheet stack handling means is greater than remaining pitches thereof; and each of said plurality of bins is provided on opposite sides thereof with laterally protruding trunnions for engagement with corresponding grooves of said spiral cams.

12. A sheet finish-processing unit for finish-processing sheets discharged from an image forming apparatus, comprising:

sheet storing means capable of storing sheets discharged from an image forming apparatus in stacks, said sheet storing means including a plurality of vertically translatable bins, each of said bins being sloped such that, in a direction of sheet discharge from an image forming apparatus, ends of said bins in a sheet-forward direction are higher than opposite ends adjacent an image forming apparatus;

bin movement control means for vertically indexing said plurality of bins, wherein each bin is brought sequentially into a processing position;

sheet stack finish-processing means, mounted laterally of an image forming apparatus-directed end of said sheet storing means so as to be shiftable along an adjacent margin of stored stacks of sheets in a direction transverse to a direction of the sheet discharge from said image forming apparatus, for performing an operation which finishes said stack of sheets;

finish-processing means drive means for shifting said sheet stack finish-processing means in the transverse direction, said finish-processing means including a stop mechanism disposed between said sheet stack finish-processing means and said sheet storing means for preventing sheets stored in a bin at said processing position from falling out of that bin, said stop mechanism including a stop movable between a first position, in which said stop abuts on and thereby registers adjacent common ends of a stack of sheets stored in a bin at said processing position, and a second position, which allows a stack of sheets to be drawn out from a bin, and stop operator means for operating said stop to move between the first and second positions; and sheet stack handling means for drawing a stack of sheets stored in said sheet storing means at said processing position into a finishing locale of the sheet stack finish-processing means, and for returning said stack of sheets to said sheet storing means subsequent to a finishing operation being executed by said sheet stack finish processing means upon said stack of sheets.

13. A sheet finish-processing unit for finish-processing sheets discharged from an image forming apparatus, comprising:

sheet storing means capable of storing sheets discharged from an image forming apparatus into stacks;

sheet stack finish-processing means, mounted lateral of an image forming apparatus-directed end of said sheet storing means so as to be shiftable along an adjacent margin of a stack of sheets in a direction transverse to a direction of sheet discharge from an image forming apparatus, for performing an operation which finishes a stack of sheets;

finish-processing means drive means for shifting said sheet stack finish-processing means in the transverse direction;

sheet stack handling means for drawing a stack of sheets stored in said sheet storing means into a finishing locale of the sheet stack finish-processing means, and for returning a stack of sheets to said sheet storing means subsequent to a finishing operation being executed by said sheet stack finish processing means upon that stack of sheets, said sheet stack handling means including a plurality of stack nipping apparatus arranged at predetermined intervals in the transverse direction;

sheet size detecting means for determining a size of a sheet discharged into the unit; and means for selecting one or more of said stack nipping apparatus to be operational from said plurality thereof according to a determination of sheet size made by said size detecting means.

14. A sheet sort-processing unit for sort-processing sheets discharged from an image forming apparatus, comprising:

a plurality of bins, each of which is for storing discharged sheets in a stack;

sheet supply means for supplying sheets from an image forming apparatus into said bins;

a body frame supporting said plurality of bins and containing an outlet on an image forming apparatus user-directed front-side wall thereof, through which outlet a stack of sheets in each of said bins may be discharged frontward; and shutter means for opening and closing said outlet of said body frame.

15. A sheet sort-processing unit according to claim 14, wherein said plurality of bins is vertically translatable; said unit further comprising bin driving means for vertically indexing said plurality of bins.

16. A sheet sort-processing unit according to claim 15, further including:

a sheet registering unit for registering in a widthwise direction stacks of sheets stored in each of said plurality of bins, while moving those stacks of sheets toward a front side of the unit; and shutter control means for controlling said shutter means such that said outlet is closed while those stacks of sheets are registered widthwise by said sheet registering unit.

17. A sheet sort-processing unit according to claim 16, wherein said shutter means includes a vertically shiftable shutter member which assumes a position whereby when a stack of sheets are registered widthwise, that stack of sheets under registration abuts on an inward surface of said shutter member.

18. A sheet discharge-processing unit for discharging a stack of sheets from sheet storing means, comprising:

a body housing for disposal on an image forming apparatus user-directed front side of a sheet storing means;

sheet stack discharging means disposed within said body housing, for withdrawing stacks of sheets frontward from a sheet storing means and discharging stacks of sheets therefrom, said sheet stack discharging means includes nipping means, shiftable between a nipping position, in which said nipping means nips a stack of sheets stored in said sheet storing means, and a drawn position in a front portion of the unit, wherein said nipping means draws a stack of sheets in said sheet storing means toward said drawn position, nipping means drive means for shifting said nipping means, and a discharge roller unit for seizing a stack of sheets drawn into said drawn position by said nipping means and subsequently discharging that stack of sheets into a reservoir; and said reservoir for storing stacks of sheets discharged by said sheet stack discharge means.

19. A sheet discharge-processing unit according to claim 18, further including:

seize detecting means for detecting that a stack of sheets drawn by said nipping means is seized by said roller unit; and discharge control means for directing:

a rotating drive of said roller unit until said detecting means detects that said roller unit has seized a stack of sheets, a halt of said roller unit rotating drive and of action of said nipping means after detection of roller unit seizure of a stack of sheets, in order to release that stack of sheets from said nipping means, said sheet nipping means to be drawn frontward into said drawn position, and restart of said roller unit rotating drive.

20. A sheet discharge-processing unit according to claim 19, further including:

stack detecting means for detecting whether there is a next stack of sheets to be discharged from said sheet storing means; and nipping means drive control means for shifting said nipping means into said nipping position while a latest stack of sheets is discharged by said roller unit when a next stack of sheets exists.

21. A sheet discharge-processing unit for discharging a stack of sheets from sheet storing means, comprising:

sheet storing means, an end of said sheet storing means storing a stack of sheets in a sheet-forward direction with respect to a direction of sheet discharge from an image forming apparatus being higher than an opposite end adjacent an image forming apparatus;

a body housing for disposal on an image forming apparatus user-directed front side of a sheet storing means;

sheet stack discharging means disposed within said body housing, for withdrawing stacks of sheets frontward from a sheet storing means and discharging stacks of sheets therefrom, the sheet stack discharging means including a discharge roller unit having an upper roller pair and a lower roller pair for seizing a stack of sheets drawn from said sheet storing means and discharging that stack of sheets into a reservoir, said discharge roller unit being rotatingly driven such that a discharge speed of said upper roller pair is greater than a discharge speed of said lower roller pair; and said reservoir for storing the stacks of sheets discharged by said sheet stack discharge means.

22. A sheet discharge-processing unit for discharging a stack of sheets from sheet storing means, comprising:

a body housing disposed on an image forming apparatus user-directed front side of a sheet storing means;

sheet stack discharging means disposed within said body housing, for withdrawing stacks of sheets frontward from a sheet storing means and discharging stacks of sheets therefrom; and a reservoir for storing stacks of sheets discharged by said sheet stack discharge means, said reservoir including a receiving tray which is drawable from said body housing frontward of the unit.

23. A sheet processing unit according to claim 22, wherein said receiving tray, when restored into said body housing, assumes an angled position in which a rearward portion of said receiving tray is higher than an opposite, frontward portion thereof; and when drawn frontward of the unit, said receiving tray assumes a flat, extended position.

24. An image forming apparatus comprising:

an image forming apparatus body for forming an image onto a sheet;

setting means for setting a number of copies to be made by said image forming apparatus;

sheet storing means including a plurality of bins, each bin being capable of storing a set of sheets discharged from said image forming apparatus in a stack;

sheet stack finish-processing means for performing an operation which finishes a stored stack of sheets;

finished-stack detecting means for detecting that each of said plurality of bins stores a finished stack of sheets;

sheet stack discharge means for discharging a stack of sheets finished by said sheet stack finish-processing means from one of said plurality of bins in a discharge operation;

operation selection means for selecting execution of a finishing operation by said sheet stack finish-processing means, and execution of a discharge operation by said sheet stack discharge means;

operation control means for controlling operations executed by said sheet stack finish-processing means and said sheet stack discharge means such that exclusively when execution of said finishing operation has been selected through said operation selection means and a number of copies to be made by said image forming apparatus set through said setting means is greater than a number of said plurality of bins, said operation control means directs forcible discharge of stacks of sheets which have been finish-processed from said plurality of bins upon the detection of those stacks of sheets which have been finish-processed as stored in each of said plurality of bins by said finished-stack detecting means.

25. An image forming apparatus according to claim 24, wherein said sheet stack discharge means discharges a stack of sheets from one of said plurality of bins toward a user-directed front side of said image forming apparatus body.

26. An image forming apparatus according to claim 25, further including a reservoir disposed in front of said sheet storing means, for storing stacks of sheets discharged from said bins by said sheet stack discharge means.

27. An image forming apparatus according to claim 26, wherein said operation control means controls said finishing operation and said discharge operation to execute in parallel when both operations are concurrently selected.

28. An image forming apparatus according to claim 27, wherein said operation control means prohibits execution of said discharge operation only when said discharge operation has been selected through said operation selection means.

29. An image forming apparatus according to claim 28, wherein when only said discharge operation has been selected through said operation selection means, said operation control means informs a user that an abnormal selection has been made.

* * * * *